US011685152B2

(12) United States Patent
Takagi et al.

(10) Patent No.: US 11,685,152 B2
(45) Date of Patent: Jun. 27, 2023

(54) PRINT HEAD AND LIQUID EJECTING APPARATUS

(71) Applicant: Seiko Epson Corporation, Tokyo (JP)

(72) Inventors: Eiji Takagi, Shiojiri (JP); Masanori Koizumi, Suwa (JP); Shunya Komatsu, Matsumoto (JP); Shuichi Nakano, Shiojiri (JP); Masashi Kamiyanagi, Matsumoto (JP); Toru Matsuyama, Matsumoto (JP)

(73) Assignee: SEIKO EPSON CORPORATION

( * ) Notice: Subject to any disclaimer, the term of this patent is extended or adjusted under 35 U.S.C. 154(b) by 64 days.

(21) Appl. No.: 17/032,125

(22) Filed: Sep. 25, 2020

(65) Prior Publication Data

US 2021/0094280 A1 Apr. 1, 2021

(30) Foreign Application Priority Data

Sep. 27, 2019 (JP) ..... 2019-178015

(51) Int. Cl.
*B41J 2/045* (2006.01)
*B41J 2/165* (2006.01)

(52) U.S. Cl.
CPC ..... *B41J 2/04536* (2013.01); *B41J 2/0451* (2013.01); *B41J 2/16535* (2013.01); *B41J 2002/16573* (2013.01)

(58) Field of Classification Search
CPC .. B41J 2/04536; B41J 2/0451; B41J 2/04501; B41J 29/38
See application file for complete search history.

(56) References Cited

U.S. PATENT DOCUMENTS

| | | | | |
|---|---|---|---|---|
| 6,688,729 | B1 | 2/2004 | Imanaka et al. | |
| 6,945,633 | B2 | 9/2005 | Imanaka et al. | |
| 10,464,326 | B2 | 11/2019 | Fujimori et al. | |
| 2004/0036743 | A1 | 2/2004 | Imanaka et al. | |
| 2008/0097770 | A1* | 4/2008 | Low | B41J 2/17509 705/304 |
| 2017/0279044 | A1* | 9/2017 | Ge | H01L 45/1633 |
| 2018/0079207 | A1* | 3/2018 | Hiyoshi | B41J 2/04586 |
| 2018/0281478 | A1* | 10/2018 | Oguchi | B41J 2/16511 |
| 2019/0023017 | A1 | 1/2019 | Fujimori et al. | |
| 2019/0291412 | A1* | 9/2019 | Tsuchihashi | B41J 25/34 |

FOREIGN PATENT DOCUMENTS

| | | | |
|---|---|---|---|
| JP | H06-320732 | A | 11/1994 |
| JP | 2000-334935 | A | 12/2000 |
| JP | 2000-334938 | A | 12/2000 |
| JP | 2001-058411 | A | 3/2001 |
| JP | 2004-188634 | A | 7/2004 |
| JP | 2004-314351 | A | 11/2004 |
| JP | 2006-130828 | A | 5/2006 |
| JP | 2011-073392 | A | 4/2011 |
| JP | 2017-071067 | A | 4/2017 |
| JP | 2019-018503 | A | 2/2019 |
| JP | 2019-131358 | A | 8/2019 |

* cited by examiner

*Primary Examiner* — Scott A Richmond
(74) *Attorney, Agent, or Firm* — Harness, Dickey & Pierce, P.L.C.

(57) ABSTRACT

A print head assembled to a liquid ejecting apparatus ejecting a liquid with respect to a medium includes an ejecting portion ejecting the liquid in response to a drive signal and an electrically erasable non-volatile memory, and the non-volatile memory stores history information changing in accordance with an operation state of the print head.

26 Claims, 20 Drawing Sheets

FIG. 13

| SI[b1, b2, b3] | Ts1 | | | Ts2 | | |
|---|---|---|---|---|---|---|
| | Sa | Sb | Sc | Sa | Sb | Sc |
| [1, 1, 0] | H | L | L | H | L | L |
| [1, 0, 0] | H | L | L | L | H | L |
| [0, 1, 0] | L | H | L | H | L | L |
| [0, 0, 0] | L | H | L | L | H | L |
| [0, 0, 1] | L | L | H | L | L | H |

FIG. 19

| STORAGE REGION | STORAGE INFORMATION |
|---|---|
| M1 | TPth1 |
| M2 | TPth2 |
| M3 | TPth3 |
| M4 | TPc |
| M5 | LDth1 |
| M6 | LDth2 |
| M7 | LDth3 |
| M8 | LDc |
| M9 | ECth1 |
| M10 | ECth2 |

| STORAGE REGION | STORAGE INFORMATION |
|---|---|
| M11 | ECth3 |
| M12 | ECc |
| M13 | CECth1 |
| M14 | CECth2 |
| M15 | CECth3 |
| M16 | CECc |
| M17 | CPth1 |
| M18 | CPth2 |
| M19 | CPth3 |
| M20 | CPc |

| STORAGE REGION | STORAGE INFORMATION |
|---|---|
| M21 | CLth1 |
| M22 | CLth2 |
| M23 | CLth3 |
| M24 | CLc |
| M25 | WPth1 |
| M26 | WPth2 |
| M27 | WPth3 |
| M28 | WPc |

PRINT HEAD AND LIQUID EJECTING APPARATUS

The present application is based on, and claims priority from JP Application Serial Number 2019-178015, filed Sep. 27, 2019, the disclosure of which is hereby incorporated by reference here in its entirety.

BACKGROUND

1. Technical Field

The present disclosure relates to a print head and a liquid ejecting apparatus.

2. Related Art

From the viewpoint of environmental load reduction in recent years, attention has been focused on so-called refurbished products in which a product having an initial defective product, a used product, or the like is refurbished, finished so as to become comparable to an unused product, and then re-distributed in a market. The amount of waste can be reduced by such refurbished products, and a reduction in environmental load can be achieved as a result. Regarding such efforts and liquid ejecting apparatuses such as ink jet printers, efforts for re-market distribution as recycled machines have been made by, for example, refurbishing and finishing of used ink cartridges, print heads, and so on into a state comparable to a state of non-use.

For example, JP-A-2004-314351 discloses a method for distinguishing whether an ink cartridge is a new product or a used product in a case where the ink cartridge is reused by reading attribute data stored in the ink cartridge used in an ink jet printer that is an example of a liquid ejecting apparatus.

However, in a case where a print head constituting a liquid ejecting apparatus is reused, it may be impossible to visually confirm the state of an ejecting portion where ink is ejected from the print head and the degree of deterioration of the ejecting portion of the print head that is reused may vary with the situation of use of the print head. Accordingly, even in a case where the technique described in JP-A-2004-314351 is applied to the print head, there is room for improvement from the viewpoint of appropriately recognizing the state of the print head that is reused.

SUMMARY

One aspect of a print head according to the present disclosure is a print head assembled to a liquid ejecting apparatus ejecting a liquid with respect to a medium.

The print head includes an ejecting portion ejecting the liquid in response to a drive signal and an electrically erasable non-volatile memory.

The non-volatile memory stores history information changing in accordance with an operation state of the print head.

In one aspect of the print head, the non-volatile memory may be an EEPROM.

In one aspect of the print head, the non-volatile memory may be a flash memory.

One aspect of the print head may further include a first ejecting module including a first ejecting portion as the ejecting portion, a second ejecting module including a second ejecting portion as the ejecting portion, and a circuit substrate electrically coupled to the first ejecting module and the second ejecting module.

The non-volatile memory may be disposed on the circuit substrate.

One aspect of the print head may further include an ejecting module including the ejecting portion, a circuit substrate electrically coupled to the ejecting module, and a housing to which the circuit substrate and the ejecting module are assembled.

The non-volatile memory may be disposed in the ejecting module.

In one aspect of the print head, the operation state may include a state where the liquid is ejected from the ejecting portion and the history information may include a cumulative printing surface count of the medium where the liquid is ejected by the ejecting portion after the assembly of the print head to the liquid ejecting apparatus.

In one aspect of the print head, the operation state may include a state where the print head is assembled in the liquid ejecting apparatus and the history information may include an elapsed day count since the assembly of the print head to the liquid ejecting apparatus.

In one aspect of the print head, the operation state may include a state where an error occurs in the print head and the history information may include how many times the error occurs in the print head after the assembly of the print head to the liquid ejecting apparatus.

In one aspect of the print head, the operation state may include a state where a transport error occurs in the medium transported to the print head and the history information may include how many times the transport error occurs after the assembly of the print head to the liquid ejecting apparatus.

In one aspect of the print head, the operation state may include a state where capping processing of attaching a cap to a nozzle where the liquid is ejected from the ejecting portion is executed and the history information may include how many times the capping processing is executed after the assembly of the print head to the liquid ejecting apparatus.

In one aspect of the print head, the operation state may include a state where wiping processing of wiping a nozzle surface provided with a nozzle where the liquid is ejected from the ejecting portion is executed and the history information may include how many times the wiping processing is executed after the assembly of the print head to the liquid ejecting apparatus.

In one aspect of the print head, the operation state may include a state where cleaning processing is executed in the ejecting portion and the history information may include how many times the cleaning processing is executed after the assembly of the print head to the liquid ejecting apparatus.

In one aspect of the print head, the operation state may include a state where the liquid is ejected from the ejecting portion and the history information may include a cumulative printing surface count of the medium where the liquid is ejected by the ejecting portion after the assembly of the ejecting module to the housing.

In one aspect of the print head, the operation state may include a state where the ejecting module is assembled in the housing and the history information may include an elapsed day count since the assembly of the ejecting module to the housing.

In one aspect of the print head, the operation state may include a state where an error occurs in the ejecting module and the history information may include how many times the error occurs in the ejecting module after the assembly of the ejecting module to the housing.

In one aspect of the print head, the operation state may include a state where a transport error occurs in the medium transported to the print head and the history information may include how many times the transport error occurs after the assembly of the ejecting module to the housing.

In one aspect of the print head, the operation state may include a state where capping processing of attaching a cap to a nozzle where the liquid is ejected from the ejecting portion is executed and the history information may include how many times the capping processing is executed after the assembly of the ejecting module to the housing.

In one aspect of the print head, the operation state may include a state where wiping processing of wiping a nozzle surface provided with a nozzle where the liquid is ejected from the ejecting portion is executed and the history information may include how many times the wiping processing is executed after the assembly of the ejecting module to the housing.

In one aspect of the print head, the operation state may include a state where cleaning processing is executed in the ejecting portion and the history information may include how many times the cleaning processing is executed after the assembly of the ejecting module to the housing.

One aspect of a liquid ejecting apparatus according to the present disclosure is a liquid ejecting apparatus including a drive signal output circuit outputting a drive signal and a print head assembled to the liquid ejecting apparatus ejecting a liquid with respect to a medium.

The print head includes an ejecting portion ejecting the liquid in response to the drive signal and an electrically erasable non-volatile memory.

The non-volatile memory stores history information changing in accordance with an operation state of the print head.

In one aspect of the liquid ejecting apparatus, the non-volatile memory may be an EEPROM.

In one aspect of the liquid ejecting apparatus, the non-volatile memory may be a flash memory.

In one aspect of the liquid ejecting apparatus, the print head may include a first ejecting module including a first ejecting portion as the ejecting portion, a second ejecting module including a second ejecting portion as the ejecting portion, and a circuit substrate electrically coupled to the first ejecting module and the second ejecting module.

The non-volatile memory may be disposed on the circuit substrate.

In one aspect of the liquid ejecting apparatus, the print head may include an ejecting module including the ejecting portion, a circuit substrate electrically coupled to the ejecting module, and a housing to which the circuit substrate and the ejecting module are assembled.

The non-volatile memory may be disposed in the ejecting module.

In one aspect of the liquid ejecting apparatus, the operation state may include a state where the liquid is ejected from the ejecting portion and the history information may include a cumulative printing surface count of the medium where the liquid is ejected by the ejecting portion after the assembly of the print head to the liquid ejecting apparatus.

In one aspect of the liquid ejecting apparatus, the operation state may include a state where the print head is assembled in the liquid ejecting apparatus and the history information may include an elapsed day count since the assembly of the print head to the liquid ejecting apparatus.

In one aspect of the liquid ejecting apparatus, the operation state may include a state where an error occurs in the print head and the history information may include how many times the error occurs in the print head after the assembly of the print head to the liquid ejecting apparatus.

In one aspect of the liquid ejecting apparatus, the operation state may include a state where a transport error occurs in the medium transported to the print head and the history information may include how many times the transport error occurs after the assembly of the print head to the liquid ejecting apparatus.

In one aspect of the liquid ejecting apparatus, the operation state may include a state where capping processing of attaching a cap to a nozzle where the liquid is ejected from the ejecting portion is executed and the history information may include how many times the capping processing is executed after the assembly of the print head to the liquid ejecting apparatus.

In one aspect of the liquid ejecting apparatus, the operation state may include a state where wiping processing of wiping a nozzle surface provided with a nozzle where the liquid is ejected from the ejecting portion is executed and the history information may include how many times the wiping processing is executed after the assembly of the print head to the liquid ejecting apparatus.

In one aspect of the liquid ejecting apparatus, the operation state may include a state where cleaning processing is executed in the ejecting portion and the history information may include how many times the cleaning processing is executed after the assembly of the print head to the liquid ejecting apparatus.

In one aspect of the liquid ejecting apparatus, the operation state may include a state where the liquid is ejected from the ejecting portion and the history information may include a cumulative printing surface count of the medium where the liquid is ejected by the ejecting portion after the assembly of the ejecting module to the housing.

In one aspect of the liquid ejecting apparatus, the operation state may include a state where the ejecting module is assembled in the housing and the history information may include an elapsed day count since the assembly of the ejecting module to the housing.

In one aspect of the liquid ejecting apparatus, the operation state may include a state where an error occurs in the ejecting module and the history information may include how many times the error occurs in the ejecting module after the assembly of the ejecting module to the housing.

In one aspect of the liquid ejecting apparatus, the operation state may include a state where a transport error occurs in the medium transported to the print head and the history information may include how many times the transport error occurs after the assembly of the ejecting module to the housing.

In one aspect of the liquid ejecting apparatus, the operation state may include a state where capping processing of attaching a cap to a nozzle where the liquid is ejected from the ejecting portion is executed and the history information may include how many times the capping processing is executed after the assembly of the ejecting module to the housing.

In one aspect of the liquid ejecting apparatus, the operation state may include a state where wiping processing of wiping a nozzle surface provided with a nozzle where the liquid is ejected from the ejecting portion is executed and the history information may include how many times the wiping processing is executed after the assembly of the ejecting module to the housing.

In one aspect of the liquid ejecting apparatus, the operation state may include a state where cleaning processing is executed in the ejecting portion and the history information may include how many times the cleaning processing is executed after the assembly of the ejecting module to the housing.

BRIEF DESCRIPTION OF THE DRAWINGS

FIG. 13 is a diagram illustrating the content of decoding performed by a decoder.

FIG. 19 is a diagram illustrating an example of ejecting portion-related information stored in a storage circuit.

DESCRIPTION OF EXEMPLARY EMBODIMENTS

Preferred embodiments of the present disclosure will be described below with reference to the drawings. The drawings that are used are for convenience of description. It should be noted that the embodiments described below do not unduly limit the content of the present disclosure described in the claims. In addition, not all of the configurations described below are essential configuration requirements of the present disclosure. It should be noted that an ink jet printer that ejects ink as an example of a liquid from a print head and performs printing by the ejected ink landing on a medium will be described as an example of a liquid ejecting apparatus in the following description.

1. First Embodiment

1.1 Overview of Liquid Ejecting Apparatus

Figure 1:
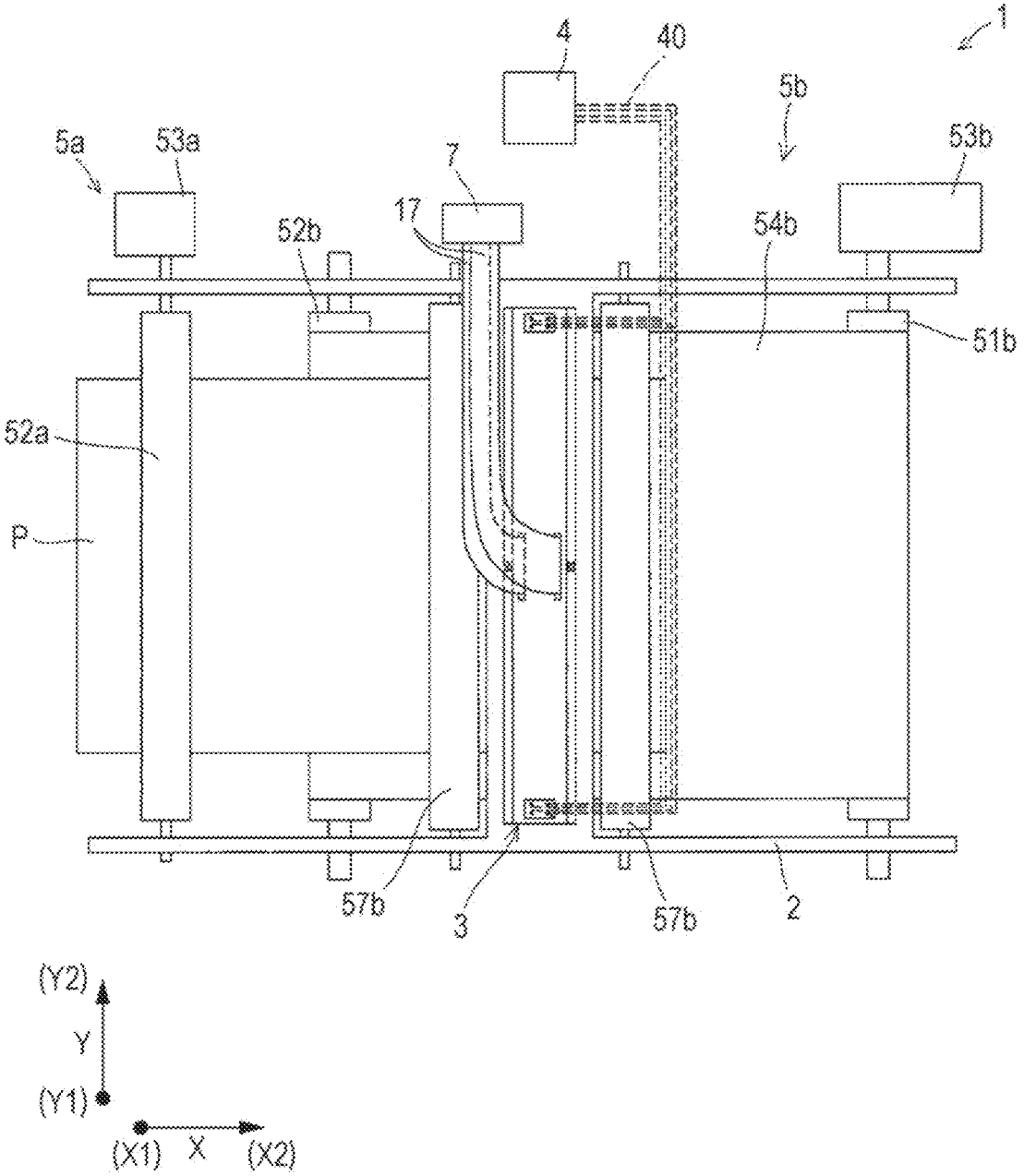
FIG. 1 is a top view illustrating a schematic configuration of a liquid ejecting apparatus.
Figure 2:
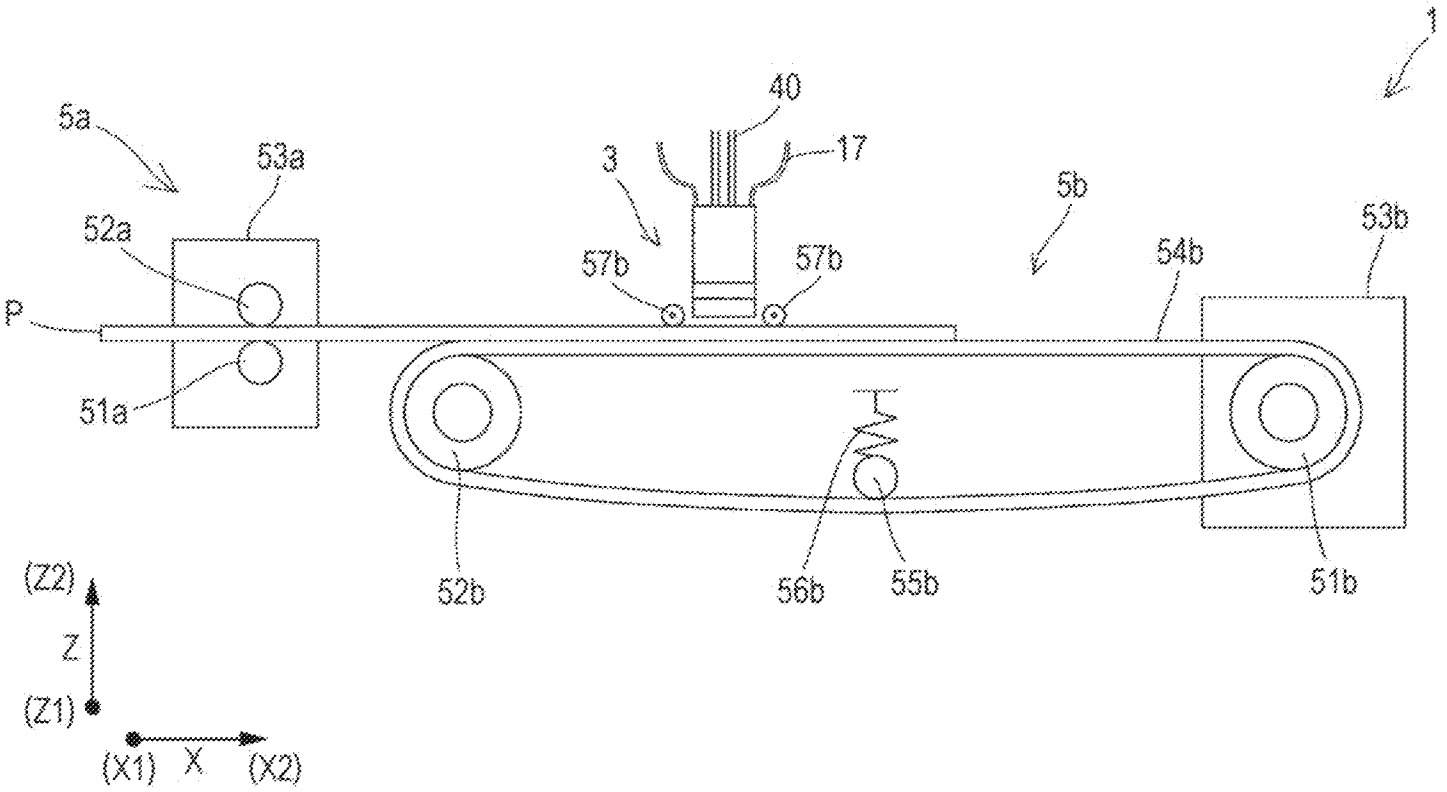
FIG. 2 is a side view illustrating a schematic configuration of the liquid ejecting apparatus.

FIG. 1 is a top view illustrating a schematic configuration of a liquid ejecting apparatus 1. In addition, FIG. 2 is a side view illustrating a schematic configuration of the liquid ejecting apparatus 1. As illustrated in FIGS. and 2, in the present embodiment, the liquid ejecting apparatus 1 will be described by a so-called line-type ink jet printer that performs printing simply by transporting a medium P to which ink is ejected being exemplified. It should be noted that the liquid ejecting apparatus 1 is not limited to the line-type ink jet printer and may be a so-called serial-type ink jet printer in which a print head moves in synchronization with the transport of the medium P.

Here, the transport direction in which the medium P is transported in the following description will be referred to as a direction X, the upstream of the transport of the medium P will be described as an X1 side, and the downstream of the transport of the medium P will be described as an X2 side. In addition, in the in-plane direction of a landing surface where the ink lands on the medium P, a direction orthogonal to the direction X will be referred to as a direction Y, one end of the liquid ejecting apparatus 1 in the direction Y will be described as a Y1 side, and the other end of the liquid ejecting apparatus 1 in the direction Y will be described as a Y2 side. Further, a direction that is orthogonal to both the direction X and the direction Y and in which the ink ejected from a print head 3 to the medium P is ejected will be referred to as a direction Z and the ink ejected from the print head 3 is ejected from a Z2 side toward a Z1 side of the direction Z in the following description. Here, the ejection direction of the ink ejected from the print head 3 with respect to the medium P is ideally orthogonal to the landing surface where the ink lands on the medium P. In other words, the direction Z is also a direction orthogonal to the surface of the medium P where the ink lands. It should be noted that configurations of the liquid ejecting apparatus 1 are not limited to being disposed so as to be mutually orthogonal although the directions X, Y, and Z in the present embodiment are described as mutually orthogonal axes.

As illustrated in FIGS. 1 and 2, the liquid ejecting apparatus 1 has an apparatus main body 2, the print head 3, storage means 4, first transport means 5*a*, and second transport means 5*b*.

The storage means 4 is fixed to the apparatus main body 2. Further, the ink supplied to the print head 3 is stored in the storage means 4. An ink cartridge, a bag-shaped ink pack formed of a flexible film, an ink tank that can be replenished with ink, or the like is used as the storage means 4 in which such ink is stored. The ink stored in the storage means 4 is supplied to the print head 3 via a supply pipe 40 such as a tube. Here, the storage means 4 may store ink of a plurality of colors such as black, cyan, magenta, yellow, red, and gray. Accordingly, the storage means 4 may include a plurality of ink cartridges, a plurality of ink packs, and a plurality of ink tanks corresponding to the colors of the stored ink and the supply pipe 40 may include a plurality of tubes corresponding to the colors of the ink stored in the storage means 4. It should be noted that the storage means 4 may be mounted on the print head 3.

A signal for controlling ink ejection is supplied from a print head drive circuit substrate 7 to the print head 3 via a cable 17. The print head 3 ejects the ink supplied from the storage means 4 by an amount corresponding to the signal supplied from the print head drive circuit substrate 7 and at a timing corresponding to the signal supplied from the print head drive circuit substrate 7. It should be noted that details of the print head 3 will be described later.

The first transport means 5*a* is provided on the X1 side of the print head 3. In addition, at least a part of the second transport means 5*b* is provided on the X2 side of the print head 3. Further, the first transport means 5*a* and the second transport means 5*b* transport the medium P from the X1 side toward the X2 side in a direction along the direction X.

The first transport means 5*a* includes a transport roller 51*a*, a driven roller 52*a*, and a drive motor 53*a*. The transport roller 51*a* is provided on the side of the surface that is opposite to the ink landing surface of the medium P, that is, the Z1 side of the medium P. A drive force is supplied from the drive motor 53*a* to the transport roller 51*a*. The transport roller 51*a* is driven in accordance with the drive force supplied from the drive motor 53*a*. In addition, the driven roller 52*a* is provided on the side of the ink landing surface of the medium P, that is, the Z2 side of the medium P. The driven roller 52*a* pinches the medium P with the transport roller 51*a*. Then, the driven roller 52*a* is driven by the driving of the transport roller 51*a*. Further, the driven roller 52*a* includes a biasing member such as a spring (not illustrated) and presses the medium P toward the transport roller 51*a* by the stress that is generated by the biasing member.

The second transport means 5*b* includes a transport roller 51*b*, a driven roller 52*b*, a drive motor 53*b*, a transport belt 54*b*, a tension roller 55*b*, a biasing member 56*b*, and a pressing roller 57*b*.

The transport roller 51*b* is positioned on the X2 side of the print head 3 in the direction X. A drive force is supplied from the drive motor 53*b* to the transport roller 51*b*. Then, the transport roller 51*b* is driven in accordance with the drive force supplied from the drive motor 53*b*. The driven roller 52*b* is positioned on the X1 side of the print head 3 in the direction X. The transport belt 54*b* is an endless belt and hung on the outer periphery of the transport roller 51*b* and the driven roller 52*b*. The transport belt 54*b* is positioned on the Z1 side of the medium P. Further, the transport belt 54*b* is driven by the transport roller 51*b* being driven in accordance with the drive force supplied from the drive motor 53*b* and the driven roller 52*b* is driven as a result. The tension roller 55*b* is positioned between the transport roller 51*b* and the driven roller 52*b* so as to abut against the inner peripheral surface of the transport belt 54*b*. The tension roller 55*b* applies tension to the transport belt 54*b* by the biasing force that is generated by the biasing member 56*b* such as a spring. As a result, the surface of the transport belt 54*b* that is between the transport roller 51*b* and the driven roller 52*b* and faces the print head 3 becomes planar.

The pressing roller 57*b* is provided on each of the X1 side and the X2 side of the print head 3 on the Z2 side of the medium P. The posture of the medium P is kept planar by the medium P being pinched between the pressing roller 57*b* and the transport belt 54*b*.

In the liquid ejecting apparatus 1 configured as described above, the medium P is transported from the X1 side toward the X2 side in a direction along the direction X and the print head 3 ejects ink to the medium P at a predetermined timing by the first transport means 5*a* and the second transport means 5*b* being driven. As a result, the ink ejected from the print head 3 lands at a desired position of the medium P. As a result, a desired image is formed on the medium P.

1.2 Structure of Print Head

Figure 3:
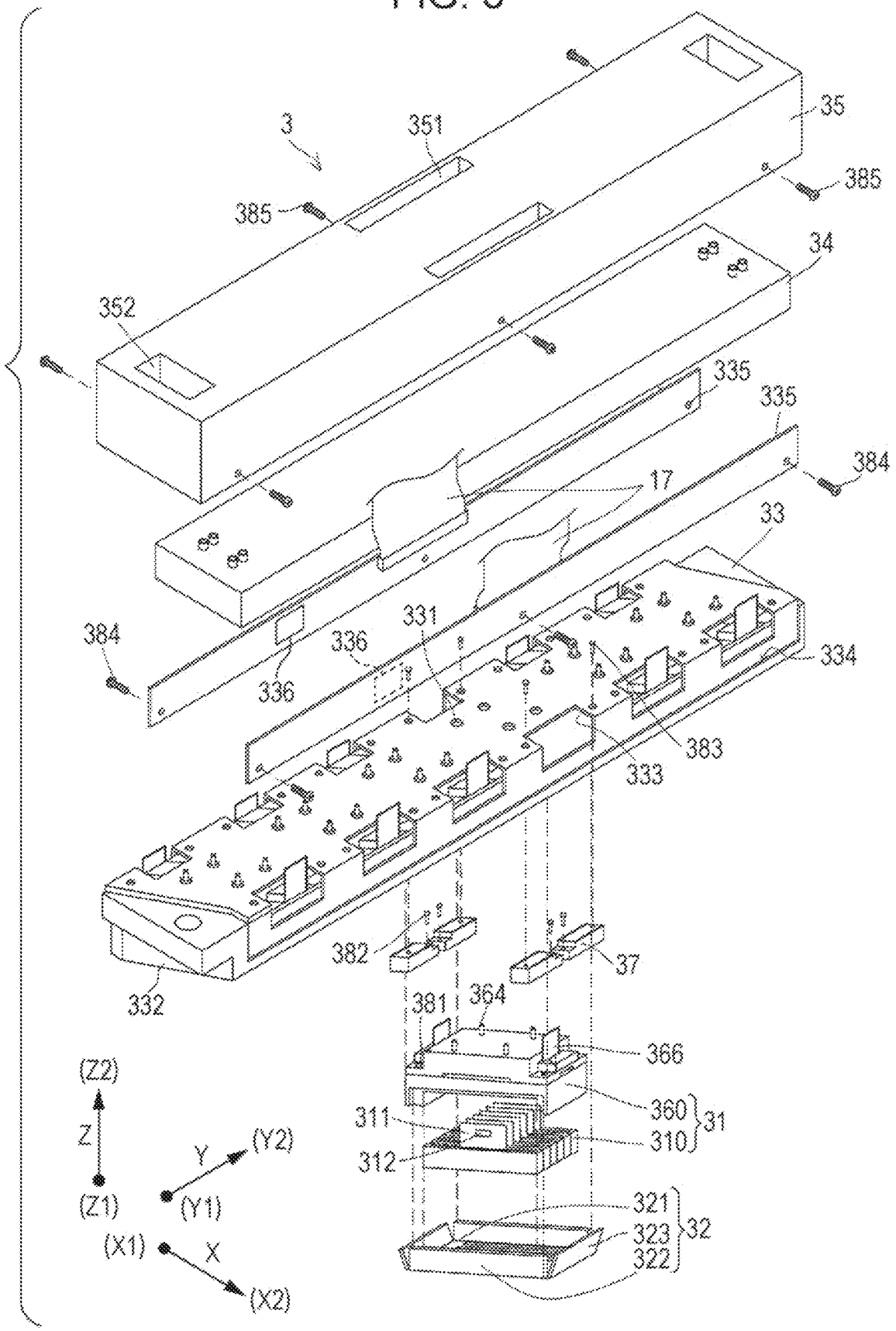
FIG. 3 is an exploded perspective view illustrating the structure of a print head.

Next, the structure of the print head 3 will be described. FIG. 3 is an exploded perspective view illustrating the structure of the print head 3. As illustrated in FIG. 3, the print head 3 has a plurality of head main bodies 31, a plurality of covers 32, a base member 33, a flow path member 34, and a cover member 35. Here, as illustrated in FIG. 3, the plurality of covers 32 are provided so as to correspond to the plurality of head main bodies 31. In other words, the print head 3 has a plurality of sets of the head main body 31 and the cover 32. It should be noted that the print head 3 that has six head main bodies 31 and six covers 32 is exemplified in FIG. 3 and yet the present disclosure is not limited thereto.

Figure 4:
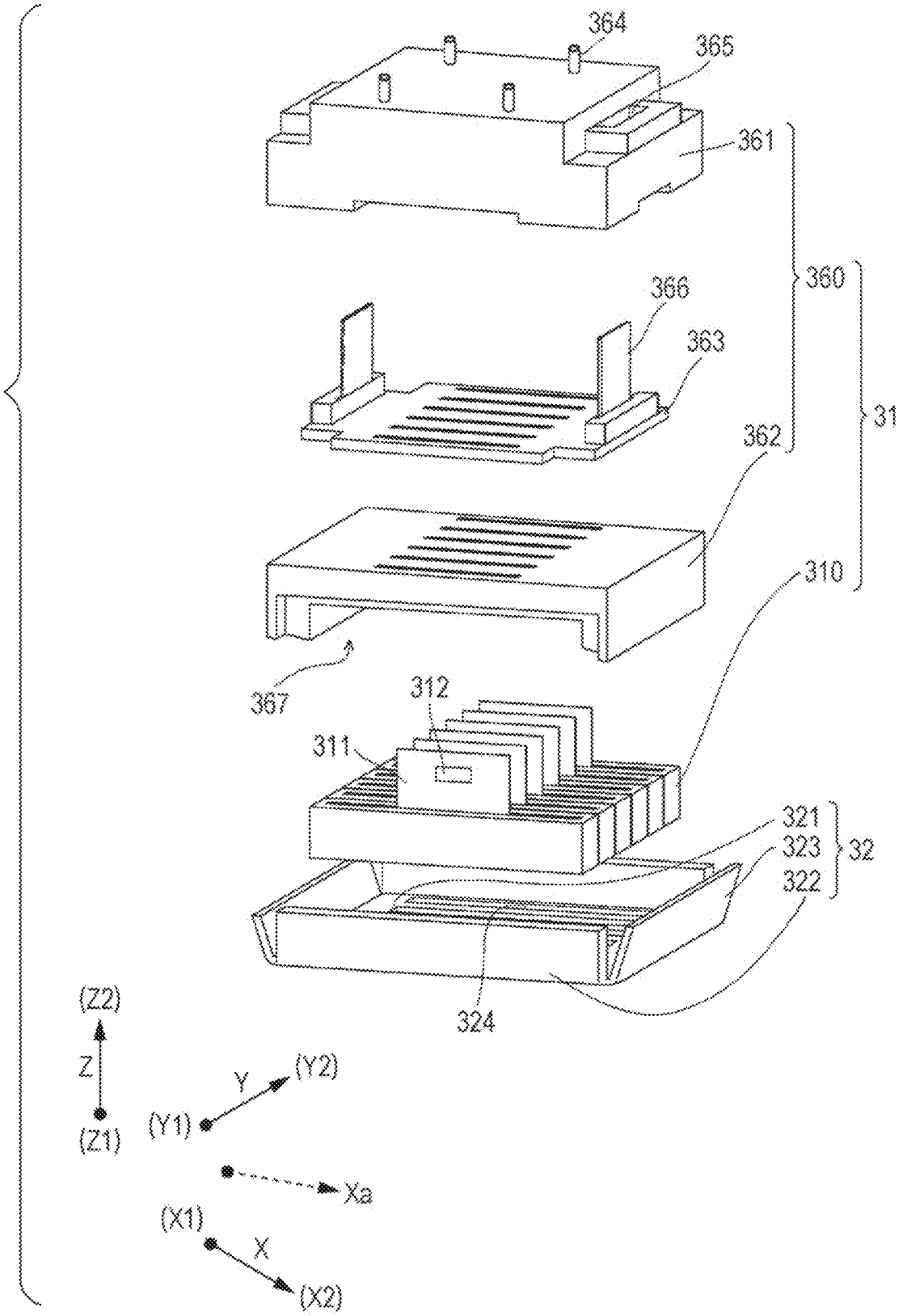
FIG. 4 is an exploded perspective view of a head main body.
Figure 5:
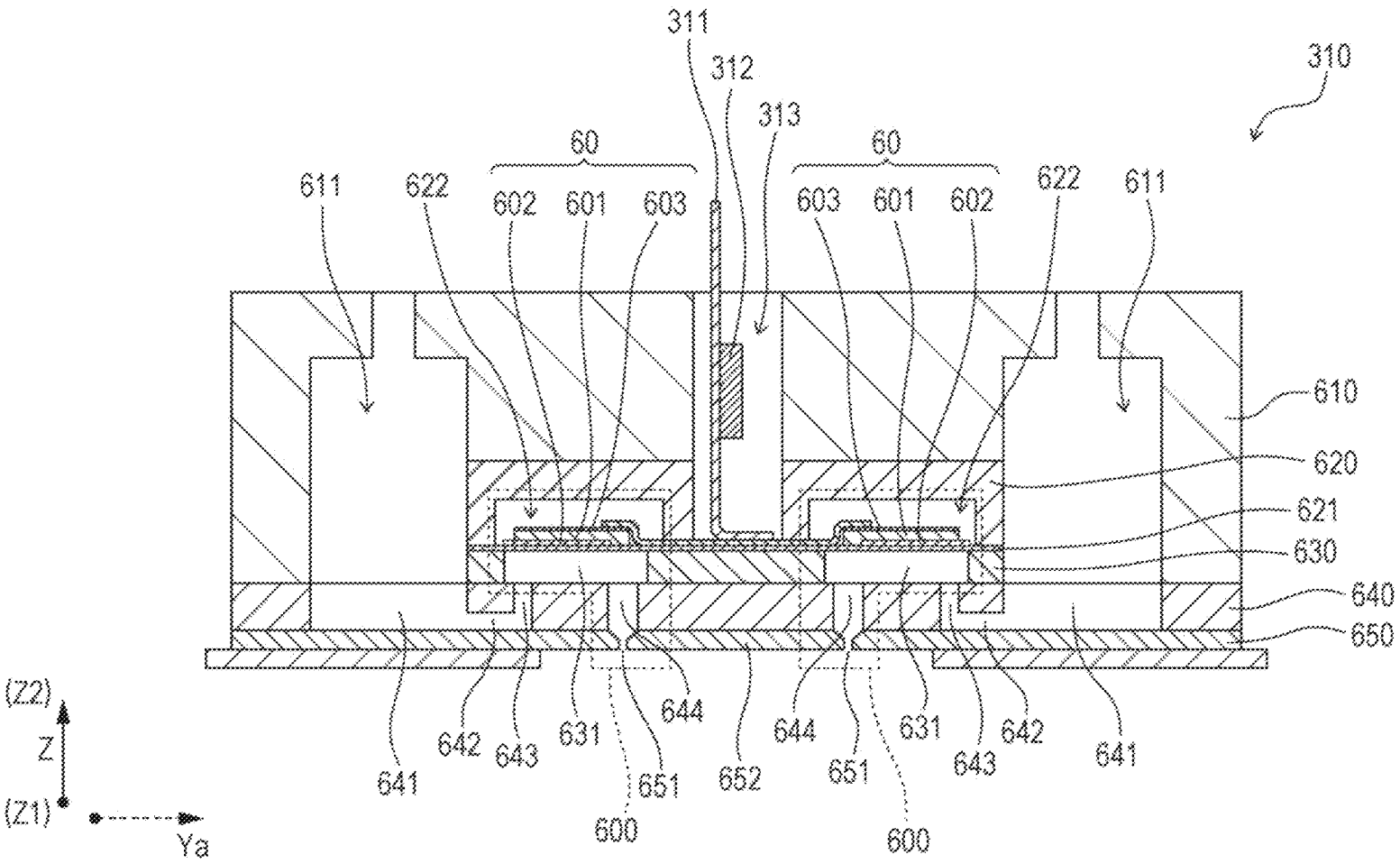
FIG. 5 is a cross-sectional view of a head chip included in the head main body.

First, the structure of the head main body 31 will be described with reference to FIGS. 4 and 5. FIG. 4 is an exploded perspective view of the head main body 31. FIG. 5 is a cross-sectional view of a head chip 310 included in the head main body 31. As illustrated in FIG. 4, the head main body 31 has a plurality of the head chips 310 and a holding member 360. It should be noted that the head main body 31 that has six head chips 310 is exemplified in FIG. 4 and yet the present disclosure is not limited thereto.

As illustrated in FIG. 5, each head chip 310 has a case 610, a protective substrate 620, a pressure chamber substrate 630, a flow path substrate 640, and a nozzle plate 650. Further, in the head chip 310, the case 610, the protective substrate 620, the pressure chamber substrate 630, the flow path substrate 640, and the nozzle plate 650 are bonded by an adhesive or the like.

The nozzle plate 650 has a plurality of ink ejecting nozzles 651. Specifically, the nozzle plate 650 is provided with two nozzle rows in a direction along a direction Ya and the plurality of nozzles 651 are arranged in parallel in a direction along a direction Xa in the two nozzle rows. Here, the direction Xa is a direction inclined with respect to the direction X, which is the transport direction of the medium P, and the direction Ya is a direction intersecting with the direction Xa on the X-Y plane defined by the direction X and the direction Y. In other words, the head main body 31 is mounted on the print head 3 such that the direction in which the nozzles 651 of the head chip 310 are arranged in parallel is inclined with respect to the direction X, which is the transport direction of the medium P. It should be noted that the nozzle rows formed by the nozzles 651 are not limited to two rows and may be one row or three or more rows. Here, the Z1-side surface where the nozzle 651 opens in the nozzle plate 650 is referred to as a nozzle surface 652.

The pressure chamber substrate 630 is positioned on the Z2 side of the nozzle plate 650. The pressure chamber substrate 630 has a plurality of pressure generation chambers 631 partitioned by a partition wall or the like. Each pressure generation chamber 631 is positioned so as to correspond to the nozzle 651 included in the nozzle plate 650. In other words, the pressure chamber substrate 630 has the same number of pressure generation chambers 631 as the nozzles 651 provided in the nozzle plate 650. Further, the plurality of pressure generation chambers 631 included in the pressure chamber substrate 630 are arranged in parallel in a direction along the direction Xa. Further, two rows of the pressure generation chambers 631 arranged in parallel are positioned in a direction along the direction Ya.

The flow path substrate 640 is positioned on the Z2 side of the nozzle plate 650 and the Z1 side of the pressure chamber substrate 630. In other words, the flow path substrate 640 is positioned between the nozzle plate 650 and the pressure chamber substrate 630 in a direction along the direction Z. The flow path substrate 640 has a branch flow path 642, a communication flow path 643, an individual flow path 644, and a common flow path 641 for supplying the ink supplied from the storage means 4 to each of the plurality of nozzles 651.

The individual flow path 644 communicates with the corresponding nozzle 651 and pressure generation chamber 631. The common flow path 641 is provided in common with respect to the plurality of pressure generation chambers 631 included in the pressure chamber substrate 630 and the plurality of nozzles 651 included in the nozzle plate 650. Ink is supplied from the storage means 4 to the common flow path 641. The ink supplied to the common flow path 641 is supplied to the pressure generation chamber 631 via the branch flow path 642 and the communication flow path 643 provided so as to correspond to the pressure generation chamber 631. In other words, the branch flow path 642 and the communication flow path 643 allow the common flow path 641 and the corresponding pressure generation chamber 631 to communicate with each other. The flow path substrate 640 configured as described above supplies the ink supplied to the common flow path 641 to the pressure generation chamber 631 via the communication flow path 643 after causing the ink to branch so as to correspond to each of the plurality of pressure generation chambers 631 in the branch flow path 642.

A diaphragm 621 is bonded to the Z2-side surface of the pressure chamber substrate 630. In addition, a plurality of piezoelectric elements 60 corresponding to the plurality of pressure generation chambers 631 are provided on the Z2-side surface of the diaphragm 621. Specifically, each piezoelectric element 60 includes electrodes 602 and 603 and a piezoelectric layer 601, which are stacked in the order of the electrode 602, the piezoelectric layer 601, and the electrode 603 from the Z1 side toward the Z2 side in a direction along the direction Z on the Z2-side surface of the diaphragm 621. Further, one of the electrodes 602 and 603 of each piezoelectric element 60 is configured as a common electrode that supplies a signal of a common potential to the piezoelectric element 60 and the other of the electrodes 602 and 603 is configured as an individual electrode that supplies a signal of an individual potential to each piezoelectric element 60. It should be noted that the electrode 602 is described as an individual electrode and the electrode 603 is described as a common electrode in the present embodiment and yet the present disclosure is not limited thereto.

In the piezoelectric element 60 configured as described above, the piezoelectric layer 601 is deformed in accordance with the potential difference generated between the electrode 602 and the electrode 603. In other words, the piezoelectric element 60 is driven in accordance with the potential difference between the potential of the signal supplied to the electrode 602 and the potential of the signal supplied to the electrode 603. Then, the diaphragm 621 is displaced by the piezoelectric element 60 being driven. The internal pressure of the pressure generation chamber 631 decreases in a case where the diaphragm 621 is displaced to the Z2 side. As a result, ink is supplied from the common flow path 641 to the pressure generation chamber 631 via the branch flow path 642 and the communication flow path 643. On the other hand, the internal pressure of the pressure generation chamber 631 rises in a case where the diaphragm 621 is displaced to the Z1 side. As a result, the ink stored in the pressure generation chamber 631 is ejected from the nozzle 651 via the individual flow path 644. Here, the configuration that includes the piezoelectric element 60, the pressure generation chamber 631, the individual flow path 644, and the nozzle 651 corresponds to an ejecting portion 600 ejecting ink from the print head 3.

The protective substrate 620 is positioned on the Z2 side of the diaphragm 621. The protective substrate 620 has a holding portion 622 that forms a space for protecting the piezoelectric element 60. The space formed by the holding portion 622 has a sufficient size with respect to displacement entailed by the driving of the piezoelectric element 60.

The case 610 is positioned on the Z2 side of the flow path substrate 640 and the protective substrate 620. The case 610 has a manifold 611, which is a common liquid chamber communicating with the common flow path 641 of the flow path substrate 640. The manifold 611 is a space where the ink supplied to the plurality of nozzles 651 is stored and is continuously provided over the plurality of nozzles 651 and the plurality of pressure generation chambers 631. The ink supplied to the manifold 611 is supplied to the common flow path 641.

In addition, in the head main body 31, the protective substrate 620 and the case 610 are provided with a through hole 313 that penetrates the protective substrate 620 and the case 610 in a direction along the direction Z. A wiring substrate 311 is inserted through the through hole 313. Then, one end of the wiring substrate 311 is electrically coupled to a lead electrode pulled out from the electrodes 602 and 603 of the piezoelectric element 60. In other words, a signal for driving the piezoelectric element 60 propagates to the wiring substrate 311. In addition, an integrated circuit 312 is mounted on the wiring substrate 311. A signal for driving the piezoelectric element 60 propagating on the wiring substrate 311 is input to the integrated circuit 312. Then, the integrated circuit 312 controls the timing at which a signal for driving the piezoelectric element 60 is supplied to the electrode 602 based on the input signal. As a result, the drive timing of the piezoelectric element 60 and the drive amount of the piezoelectric element 60 are controlled. Accordingly, a predetermined amount of ink is ejected at a predetermined timing from the ejecting portion 600 including the piezoelectric element 60.

The head chip 310 configured as described above is held by the holding member 360 in the head main body 31. As illustrated in FIG. 4, the holding member 360 includes a flow path member 361, a holder 362, and a wiring substrate 363.

An ink flow path is provided in the flow path member 361 so that the ink supplied from the storage means 4 is supplied to each head chip 310. The ink flow path communicates with an ink supply portion 364 provided on the Z2-side surface of the flow path member 361. In other words, the ink supplied from the storage means 4 is supplied to the flow path member 361 via the ink supply portion 364. It should be noted that the ink flow path provided in the flow path member 361 is provided so as to correspond to each ink supply portion 364. Here, the flow path member 361 that has four ink supply portions 364 is illustrated in FIG. 4 and yet the present disclosure is not limited thereto. In addition, a filter for removing foreign matter such as dust and air bubbles contained in the supplied ink may be provided in the flow path member 361.

Cable insertion holes 365 penetrating the flow path member 361 in the direction Z are provided in both end portions of the flow path member 361 in the direction X. A cable 366 provided on the wiring substrate 363 (described later) is inserted through the cable insertion hole 365.

The holder 362 is positioned on the Z1 side of the flow path member 361 and fixed to the flow path member 361 by a screw 381 illustrated in FIG. 3. The holder 362 has a holding portion 367. The holding portion 367 is a groove-shaped space that is continuous over the direction Y and opens on both side surfaces in the direction Y on the Z1-side surface of the holder 362. Further, the plurality of head chips 310 are bonded to the holding portion 367 by an adhesive (not illustrated). As a result, the plurality of head chips 310 are held by the holding member 360.

In addition, an ink flow path (not illustrated) that communicates with the ink flow path provided in the flow path member 361 is provided in the holder 362. The ink supplied from the ink supply portion 364 is supplied to each head chip 310 via the ink flow path provided in the flow path member 361 and the ink flow path provided in the holder 362.

The wiring substrate 363 is positioned between the flow path member 361 and the holder 362. The wiring substrate 311 included in each head chip 310 is electrically coupled to the wiring substrate 363. In addition, the cable 366 is provided on the wiring substrate 363. The wiring substrate 363 configured as described above propagates a signal input via the cable 366 to the corresponding head chip 310 and outputs a signal output from each head chip 310 via the wiring substrate 311 to the outside of the head main body 31 via the cable 366.

At least a part of the head main body 31 described above is covered with the cover 32. As a result, the risk of ink droplets that float in the liquid ejecting apparatus 1 adhering to each head chip 310 is reduced. In other words, the cover 32 protects the head chip 310 included in the head main body 31 from ink droplets.

The cover 32 is provided on the Z1 side, which is the nozzle surface 652 side of the plurality of head chips 310 provided in the head main body 31. Further, the cover 32 and the head main body 31 are bonded by an adhesive (not illustrated).

As illustrated in FIG. 4, the cover 32 includes a base portion 321 and extending portions 322 and 323. The base portion 321 is a plate-shaped member provided on the nozzle surface 652 side of the head chip 310 of the head main body 31 covered with the cover 32 and is bonded to the Z1-side surface of the head main body 31 by an adhesive (not illustrated). The extending portion 322 is a plate-shaped member extending toward the Z2 side from both end portions of the base portion 321 in the direction Y and has a size that covers the direction Y of the head main body 31. In addition, the extending portion 323 is a plate-shaped member extending toward the Z2 side from both end portions of the base portion 321 in the direction X and has a size that covers the direction Y of the head main body 31. In other words, the cover 32 protects the head chip 310 from ink droplets floating in the liquid ejecting apparatus 1 by a space being formed by the base portion 321 and the extending portions 322 and 323 and the head main body 31 being inserted into the formed space.

In addition, the base portion 321 has an opening portion 324. The opening portion 324 is positioned so as to correspond to the nozzle row formed by the nozzle 651 included in each head chip 310. As a result, the ink ejected from each head chip 310 lands on the medium P without being hindered by the cover 32.

Returning to FIG. 3, an accommodation portion 332 having an accommodation space that is a space opening to the Z1 side is provided in the base member 33. Further, the plurality of head main bodies 31 are accommodated and held in the accommodation space. Specifically, the head main body 31 is accommodated in the accommodation portion 332 of the base member 33 such that the nozzle surface 652 side of the head main body 31 protrudes to the Z1 side beyond the accommodation portion 332. In this case, each of the plurality of head main bodies 31 is accommodated in the accommodation portion 332 such that the nozzle row positioned on the nozzle surface 652 is along the direction Xa, which is inclined with respect to the direction X.

In addition, the head main body 31 is fixed to the base member 33 via a spacer 37 in a case where the head main body 31 is accommodated in the base member 33. The spacer 37 is fixed to the Z2-side surface of the head main body 31 by a screw 382. In addition, the spacer 37 is fixed to the Z1-side surface of the base member 33 by a screw 383. In other words, the head main body 31 is fixed to the base member 33 via the spacer 37. The head main body 31 can be easily attached to and detached from the base member 33 by the spacer 37 fixed to the head main body 31 by the screw 382 being fixed to the base member 33 by the screw 383 as described above. It should be noted that the spacer 37 and the head main body 31 are not limited to being fixed by means of the screw 382, the spacer 37 and the head main body 31 may be fixed by, for example, being bonded by means of an adhesive, and the spacer 37 and the head main body 31 may be integrally configured.

In addition, the base member 33 has a supply hole 331 penetrating the base member 33 in the direction Z. The ink supply portion 364 of the head main body 31 fixed to the base member 33 is inserted through the supply hole 331. In addition, in the base member 33, the cable 366 included in the head main body 31 fixed to the base member 33 is inserted through an opening portion 333 having the opening portion 333 penetrating the base member 33 in the direction Z.

In addition, steps 334 opening to the Z2 side are provided on the outer peripheries of both sides of the accommodation portion 332 that face each other in a direction along the direction X. A wiring substrate 335 is accommodated in each of the steps 334. The cable 366 corresponding to each of the plurality of head main bodies 31 led out from a plurality of the opening portions 333 is electrically coupled to the wiring substrate 335. As a result, a signal input to each of the plurality of head main bodies 31 and a signal output from the plurality of head main bodies 31 propagate to the wiring substrate 335.

In addition, an integrated circuit 336 is mounted on the wiring substrate 335. It should be noted that only one of two wiring substrates 335 may include the integrated circuit 336 although each of the two wiring substrates 335 includes the integrated circuit 336 in the print head 3 according to the present embodiment.

Further, the cable 17 electrically coupled to the print head drive circuit substrate 7 fixed to the apparatus main body 2 is coupled to the wiring substrate 335. As a result, various signals generated by the print head drive circuit substrate 7 are input to the print head 3.

The flow path member 34 is provided on the Z2 side of the base member 33. The flow path member 34 distributes and supplies the ink supplied from the storage means 4 to each of the plurality of head main bodies 31. An ink flow path (not illustrated) for supplying the ink supplied from the storage means 4 to the plurality of head main bodies 31 is provided in the flow path member 34. The ink flow path provided in the flow path member 34 communicates with the supply pipe 40 coupled to the storage means 4 and communicates with the ink supply portion 364 of the head main body 31. As a result, the ink supplied from the storage means 4 is supplied to the corresponding head main body 31.

The cover member 35 is provided on the Z2 side of the flow path member 34. The cover member 35 is a box-shaped member that covers the flow path member 34 and the wiring substrate 335. The cover member 35 is provided with an opening portion 351 for inserting the cable 17 and an opening portion 352 for inserting the supply pipe 40. The cover member 35 as described above is fixed to the accommodation portion 332 of the base member 33 by a screw 385.

As described above, the print head 3 is the print head 3 that is assembled to the liquid ejecting apparatus 1 ejecting ink with respect to the medium P and includes the ejecting portion 600 ejecting ink in response to a signal supplied to the electrode 602 that is an individual electrode. In addition, the print head 3 includes the plurality of head main bodies 31 and the wiring substrate 335 coupled in common to the plurality of head main bodies 31.

Here, any of the plurality of head main bodies 31 included in the print head 3 is an example of a first ejecting module and any of a plurality of the ejecting portions 600 included in the head main body 31 corresponding to the first ejecting module is an example of a first ejecting portion. In addition, any of the rest of the plurality of head main bodies 31 included in the print head 3 is an example of a second ejecting module and any of the plurality of ejecting portions 600 included in the head main body 31 corresponding to the second ejecting module is an example of a second ejecting portion. Further, the wiring substrate 335 coupled in common to the head main body 31 corresponding to the first ejecting module and the head main body 31 corresponding to the second ejecting module is an example of a circuit substrate.

1.3 Functional Configuration of Liquid Ejecting Apparatus

Figure 6:
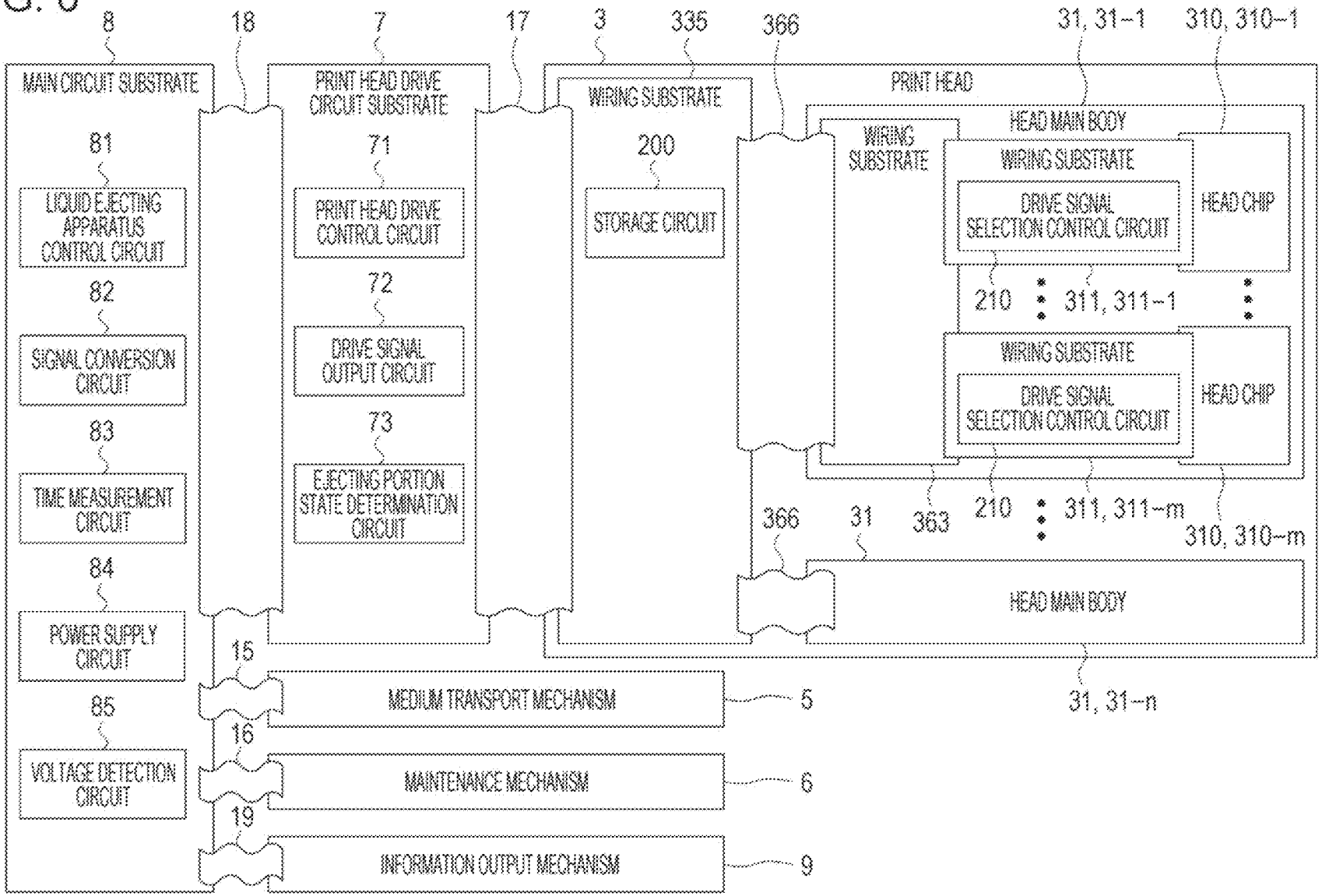
FIG. 6 is a diagram illustrating the functional configuration of the liquid ejecting apparatus.

Next, the functional configuration of the liquid ejecting apparatus 1 will be described. FIG. 6 is a diagram illustrating the functional configuration of the liquid ejecting apparatus 1. As illustrated in FIG. 6, the liquid ejecting apparatus 1 has the print head 3, a medium transport mechanism 5, a maintenance mechanism 6, the print head drive circuit substrate 7, a main circuit substrate 8, and an output mechanism 9. In addition, the liquid ejecting apparatus 1 has the cable 17 and cables 15, 16, 18, and 19 electrically coupling the print head 3, the medium transport mechanism 5, the maintenance mechanism 6, the print head drive circuit substrate 7, the main circuit substrate 8, and the output mechanism 9. The cable 15 electrically couples the main circuit substrate 8 and the medium transport mechanism 5, the cable 16 electrically couples the main circuit substrate 8 and the maintenance mechanism 6, the cable 17 electrically couples the print head drive circuit substrate 7 and the print head 3, the cable 18 electrically couples the main circuit substrate 8 and the print head drive circuit substrate 7, and the cable 19 electrically couples the main circuit substrate 8 and the output mechanism 9.

It should be noted that the print head 3 has n head main bodies 31 and each head main body 31 has m head chips 310, as illustrated in FIG. 6, in the following description of the functional configuration of the liquid ejecting apparatus 1. In other words, the print head 3 has a total of n×m head chips 310 in the following description. Further, in the following description, the n head main bodies 31 may be referred to as head main bodies 31-1 to **31-*n* in a case where the n head main bodies 31 are distinguished and, similarly, the m head chips 310 may be referred to as head chips 310-1 to 310-*m* in a case where the m head chips 310** are distinguished.

1.3.1 Functional Configuration of Main Circuit Substrate

The main circuit substrate 8 generates a signal for controlling each configuration of the liquid ejecting apparatus 1 based on image data input from a host computer or the like provided outside the liquid ejecting apparatus 1 and outputs the signal to the corresponding configuration.

Figure 7:
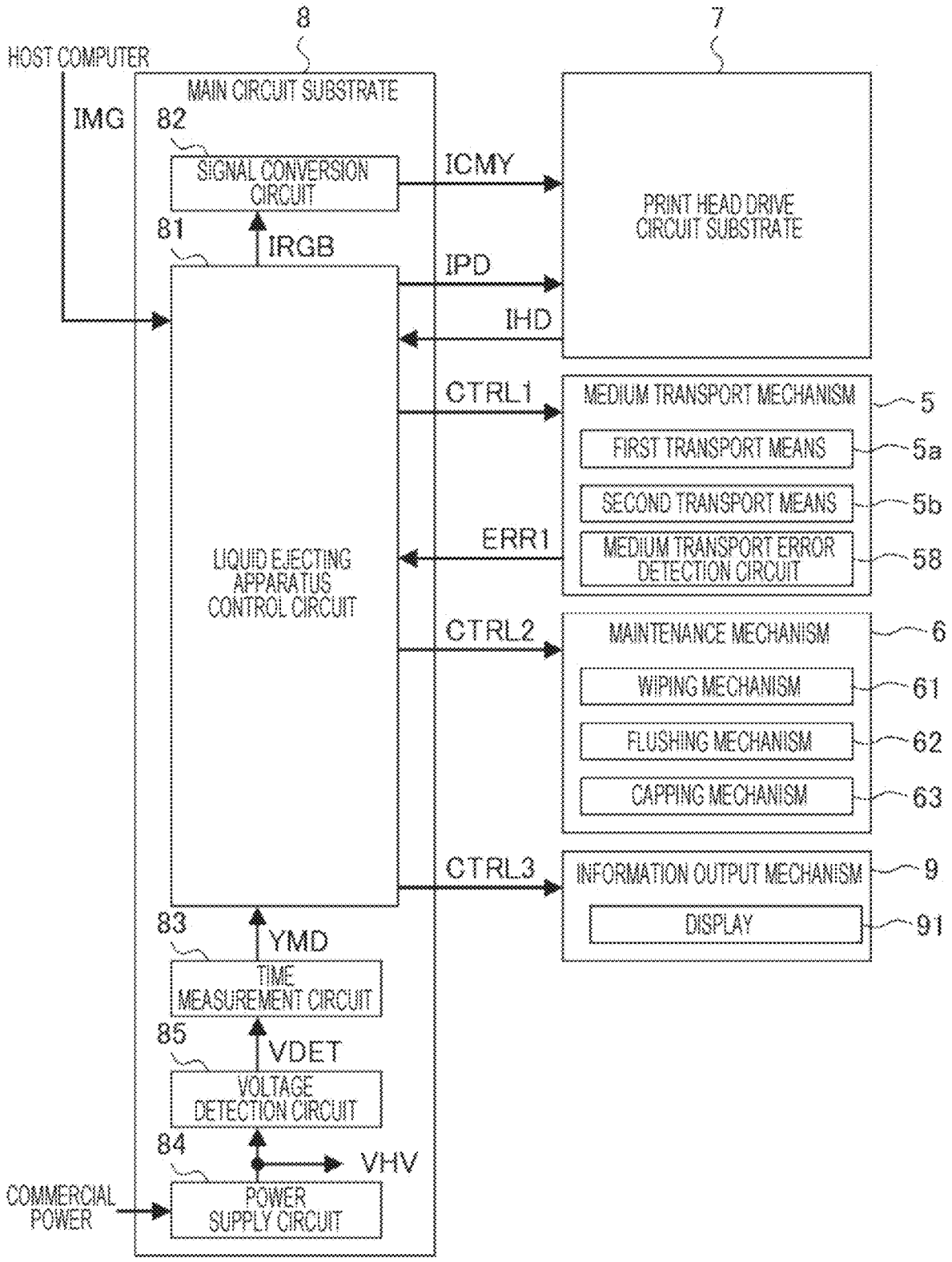
FIG. 7 is a diagram for describing details of a main circuit substrate.

FIG. 7 is a diagram for describing details of the main circuit substrate 8. As illustrated in FIG. 7, the main circuit substrate 8 has a liquid ejecting apparatus control circuit 81, a signal conversion circuit 82, a time measurement circuit 83, a power supply circuit 84, and a voltage detection circuit 85.

Commercial power is input to the power supply circuit 84. Then, the power supply circuit 84 converts the input commercial power into a voltage VHV, which is a direct current voltage of 42 V or the like, and outputs the voltage VHV. The voltage VHV output from the power supply circuit 84 is input to the voltage detection circuit 85 and used as the power supply voltage of each configuration of the liquid ejecting apparatus 1. Here, in each configuration of the liquid ejecting apparatus 1, the voltage VHV may be used as it is as the power supply voltage and a drive voltage and a voltage signal converted into various voltage values such as 3.3 V, 5 V, and 7.5 V by a voltage conversion circuit (not illustrated) may be used as the power supply voltage and the drive voltage.

The voltage detection circuit 85 detects, based on the voltage value of the voltage VHV, whether or not the power supply voltage of commercial power or the like is supplied in the liquid ejecting apparatus 1. Then, the voltage detection circuit 85 generates a voltage detection signal VDET having a logic level corresponding to the result of the detection and outputs the voltage detection signal VDET to the time measurement circuit 83. For example, the voltage detection circuit 85 outputs the H-level voltage detection signal VDET to the time measurement circuit 83 in a case where the voltage value of the voltage VHV exceeds a predetermined value and outputs the L-level voltage detection signal VDET to the time measurement circuit 83 in a case where the voltage value of the voltage VHV is equal to or lower than the predetermined value. It should be noted that the voltage detection circuit 85 may change the logic level of the voltage detection signal VDET based on a voltage value different from the voltage VHV and may change the logic level of the voltage detection signal VDET based on whether or not commercial power is supplied.

The time measurement circuit 83 determines, based on the voltage detection signal VDET, whether or not the power supply voltage is supplied in the liquid ejecting apparatus 1. Then, in a case where the time measurement circuit 83 determines based on the voltage detection signal VDET that the power supply voltage is supplied in the liquid ejecting apparatus 1, the time measurement circuit 83 generates elapsed time information YMD and outputs the elapsed time information YMD to the liquid ejecting apparatus control circuit 81.

The liquid ejecting apparatus control circuit 81 generates various signals for controlling the operation of the liquid ejecting apparatus 1 and outputs the signals to the corresponding configurations included in the liquid ejecting apparatus 1.

Specifically, the liquid ejecting apparatus control circuit 81 generates a control signal CTRL1 for controlling the operation of the medium transport mechanism 5 and outputs the control signal CTRL1 to the medium transport mechanism 5. The medium transport mechanism 5 includes the first transport means **5*a* and the second transport means 5*b* described above. In other words, the control signal CTRL1 is a signal for controlling the driving of the drive motor 53*a* included in the first transport means 5*a* and the drive motor 53*b* included in the second transport means 5*b*. It should be noted that the medium transport mechanism 5 may include a driver circuit (not illustrated) for converting the control signal CTRL1 into a signal for driving the drive motors 53***a* and 53*b*.

In addition, the medium transport mechanism 5 includes a medium transport error detection circuit 58 that detects a transport error of the medium P. The medium transport error detection circuit 58 detects whether or not a transport error has occurred in the medium P transported to the print head 3. Examples of the transport error include a so-called jam in which the medium P cannot be normally supplied or discharged as the medium P is caught in the liquid ejecting apparatus 1 in a case where the medium P transported in the liquid ejecting apparatus 1 is broken or wrinkled. Further, in a case where a transport error such as the jam has occurred in the medium transport mechanism 5, the medium transport error detection circuit 58 generates a medium transport error signal ERR1 indicating that the transport error has occurred and outputs the medium transport error signal ERR1 to the liquid ejecting apparatus control circuit 81.

In addition, the liquid ejecting apparatus control circuit 81 generates a control signal CTRL2 for controlling the operation of the maintenance mechanism 6 and outputs the control signal CTRL2 to the maintenance mechanism 6. The maintenance mechanism 6 has a wiping mechanism 61, a flushing mechanism 62, and a capping mechanism 63. The wiping mechanism 61 executes wiping processing of wiping the nozzle surface 652 in order to remove a paper piece or the like attached to the nozzle surface 652 of the print head 3. The flushing mechanism 62 executes flushing processing of ejecting the ink stored in the print head 3 from the nozzle 651 in order to maintain the viscosity of the ink stored in the print head 3 in an appropriate range or in order to recover an appropriate ink viscosity in a case where the viscosity of the ink stored in the print head 3 is abnormal. The capping mechanism 63 executes capping processing of attaching a cap to the ink ejecting nozzle 651 and the nozzle surface 652 where the nozzle 651 is formed in order to reduce a change in the characteristics of the ink stored in the print head 3 in a case where no ink is ejected from the print head 3 for a long time, examples of which include a case where the liquid ejecting apparatus 1 is not used for a long time.

It should be noted that the maintenance mechanism 6 may include a configuration in which various types of processing are executed so that the ejecting portion 600 of the print head 3 is kept in a normal state or the ejecting portion 600 is recovered to the normal state in addition to the wiping mechanism 61, the flushing mechanism 62, and the capping mechanism 63 described above.

In addition, the liquid ejecting apparatus control circuit 81 generates a control signal CTRL3 for controlling the operation of the output mechanism 9 and outputs the control signal CTRL3 to the output mechanism 9. The output mechanism 9 has a display 91. The display 91 provides notification of various types of information, such as information indicating the operation state of the liquid ejecting apparatus 1, information indicating the operation state of the maintenance mechanism 6, and information regarding the use history of the print head 3, in accordance with the control signal CTRL3. It should be noted that the output mechanism 9 may be a configuration capable of notifying a user of various types of information and may be a configuration notifying a user of information by voice, light, or the like.

In addition, the liquid ejecting apparatus control circuit 81 generates an RGB signal IRGB based on an image data signal IMG input from the host computer or the like provided outside the liquid ejecting apparatus 1 and outputs the RGB signal IRGB to the signal conversion circuit 82. The RGB signal IRGB includes information on the red, green, and blue included in image data corresponding to the input image data signal IMG. The signal conversion circuit 82 converts the input RGB signal IRGB into an image signal ICMY corresponding to the ink color used in the liquid ejecting apparatus 1 and outputs the image signal ICMY to the print head drive circuit substrate 7.

It should be noted that the signal conversion circuit 82 may output a signal subjected to signal processing such as halftone processing as the image signal ICMY and may convert the signal subjected to the halftone processing into a signal corresponding to a plurality of the ejecting portions 600 included in the print head 3 and output the signal as the image signal ICMY after converting the signal generated based on the RGB signal IRGB input from the liquid ejecting apparatus control circuit 81 into a signal corresponding to the ink color used in the liquid ejecting apparatus 1.

In addition, the signal conversion circuit 82 may convert the image signal ICMY into a pair of differential signals and then output the differential signals to the print head drive circuit substrate 7 and may convert the image signal ICMY into an optical signal or the like and then output the optical signal or the like to the print head drive circuit substrate 7. It should be noted that the main circuit substrate 8 in a case where the signal conversion circuit 82 converts the image signal ICMY into the differential signal, the optical signal, and the like and outputs the signals to the print head drive circuit substrate 7 has a conversion circuit for converting the signals and the print head drive circuit substrate 7 to which the image signal ICMY is input has a restoration circuit for restoring the signal converted into the differential signal, the optical signal, and the like in that case.

In addition, the liquid ejecting apparatus control circuit 81 outputs various types of information on the liquid ejecting apparatus 1, which include transport information on the medium P transported by the medium transport mechanism 5, transport error information based on the medium transport error signal ERR1 input from the medium transport mechanism 5, execution information on the maintenance executed by the maintenance mechanism 6, and operation time information based on the elapsed time information YMD indicating the operation time of the liquid ejecting apparatus 1, to the print head drive circuit substrate 7 as a liquid ejecting apparatus operation information signal IPD.

In addition, a print head operation information signal IHD including the drive situation of the print head 3 is input to the liquid ejecting apparatus control circuit 81 from the print head drive circuit substrate 7. The liquid ejecting apparatus control circuit 81 generates the control signals CTRL1, CTRL2, and CTRL3 for respectively controlling the medium transport mechanism 5, the maintenance mechanism 6, and the output mechanism 9 based on the input print head operation information signal IHD and outputs the control signals CTRL1, CTRL2, and CTRL3.

It should be noted that the main circuit substrate 8 is not limited to being constituted by one substrate and may be constituted by a plurality of substrates. Specifically, at least some of the plurality of circuits mounted on the main circuit substrate 8 including the liquid ejecting apparatus control circuit 81, the signal conversion circuit 82, the time measurement circuit 83, the power supply circuit 84, and the voltage detection circuit 85 included in the main circuit substrate 8 may be mounted on different substrates and electrically coupled by a connector (not illustrated), a cable (not illustrated), or the like in an alternative configuration.

1.3.2 Functional Configuration of Print Head Drive Circuit Substrate

Figure 8:
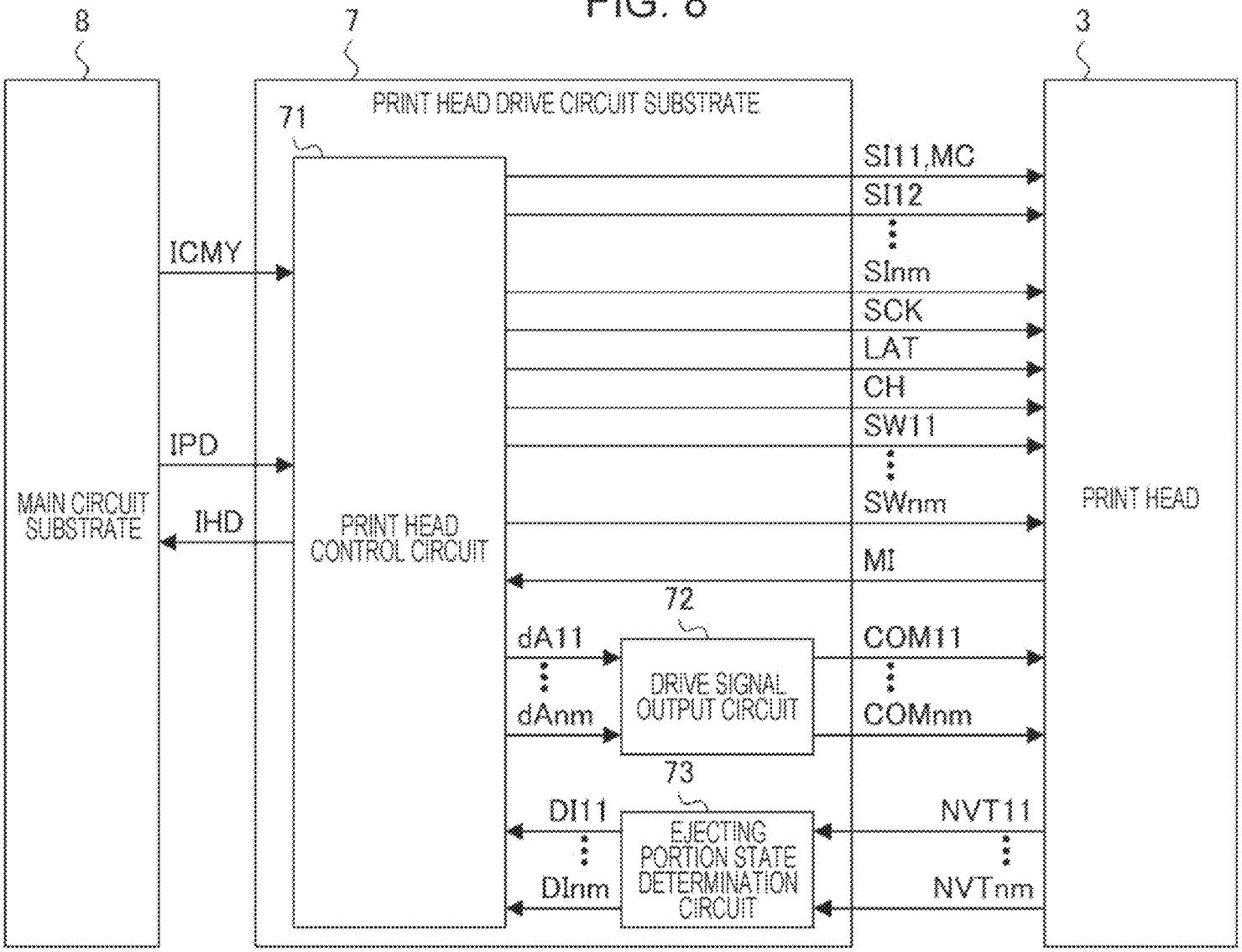
FIG. 8 is a diagram for describing details of a print head drive circuit substrate.

FIG. 8 is a diagram for describing details of the print head drive circuit substrate 7. As illustrated in FIG. 8, the print head drive circuit substrate 7 has a print head control circuit 71, a drive signal output circuit 72, and an ejecting portion state determination circuit 73. Further, the print head drive circuit substrate 7 generates, based on the image signal ICMY, drive signals COM11 to COMnm for driving the plurality of piezoelectric elements 60 of the print head 3 and a clock signal SCK, a latch signal LAT, a change signal CH, switching signals SW11 to SWnm, and printing data signals SI11 to SInm for controlling timings at which the drive signals COM11 to COMnm are supplied to the piezoelectric element 60 and outputs the generated signals to the print head 3.

Here, in the following description, the printing data signals SI11 to SInm may be simply referred to as a printing data signal SI in a case where it is not necessary to particularly distinguish the printing data signals SI11 to SInm, the switching signals SW11 to SWnm may be simply referred to as a switching signal SW in a case where it is not necessary to particularly distinguish the switching signals SW11 to SWnm, and the drive signals COM11 to COMnm may be simply referred to as a drive signal COM in a case where it is not necessary to particularly distinguish the drive signals COM11 to COMnm. In addition, drive data signals dA11 to dAnm may be simply referred to as a drive data signal dA in a case where it is not necessary to particularly distinguish the drive data signals dA11 to dAnm respectively corresponding to the drive signals COM11 to COMnm.

The image signal ICMY is input to the print head control circuit 71. Then, the print head control circuit 71 generates, from the image signal ICMY, the clock signal SCK, the latch signal LAT, the change signal CH, the switching signals SW11 to SWnm, and the printing data signals SI11 to SInm corresponding to the ejecting portion 600 and the plurality of head chips 310 of the print head 3 and outputs the generated signals to the print head 3.

Here, the printing data signal SI11 means the printing data signal SI input to the head chip 310-1 included in the head main body 31-1 and the printing data signal SInm means the printing data signal SI input to the head chip 310-*m* included in the head main body 31-*n*. Likewise, the switching signal SW11 means the switching signal SW input to the head chip 310-1 included in the head main body 31-1 and the switching signal SWnm means the switching signal SW input to the head chip 310-*m* included in the head main body 31-*n*.

In other words, the print head control circuit 71 generates and outputs the printing data signal SI and the switching signal SW corresponding to each of a total of n×m head chips 310 included in the print head 3.

In addition, the print head control circuit 71 generates the drive data signals dA11 to dAnm that define the waveforms of the drive signals COM11 to COMnm for driving the piezoelectric element 60 and outputs the drive data signals dA11 to dAnm to the drive signal output circuit 72.

The drive signal output circuit 72 performs digital-analog signal conversion on each of the input drive data signals dA11 to dAnm and then generates the drive signals COM11 to COMnm by performing class-D amplification on the converted analog signals. In other words, the drive data signals dA11 to dAnm are digital signals respectively defining the waveforms of the drive signals COM11 to COMnm and the drive signal output circuit 72 generates and outputs the drive signals COM11 to COMnm by performing class-D amplification on the waveforms respectively defined by the drive data signals dA11 to dAnm. In other words, the drive signal output circuit 72 has a total of n×m class-D amplifier circuits. Here, the drive data signals dA11 to dAnm may be signals capable of respectively defining the waveforms of the drive signals COM11 to COMnm and may be, for example, analog signals. In addition, the drive signal output circuit 72 may be capable of amplifying the waveforms respectively defined by the drive data signals dA11 to dAnm and may be configured to include, for example, a class-A amplifier circuit, a class-B amplifier circuit, or a class-AB amplifier circuit.

Here, the drive signal COM11 means the drive signal COM input to the head chip 310-1 included in the head main body 31-1 and the drive signal COMnm means the drive signal COM input to the head chip 310-*m* included in the head main body 31-*n*. Further, the drive data signal dA11 is a digital signal that defines the waveform of the drive signal COM11 and the drive data signal dAnm is a digital signal that defines the waveform of the drive signal COMnm.

In addition, ejecting portion state signals DI11 to DInm indicating the state of the ejecting portion 600 included in the print head 3 are input from the ejecting portion state determination circuit 73 to the print head control circuit 71. Residual vibration signals NVT11 to NVTnm corresponding to the residual vibration generated in the ejecting portion 600 included in the print head 3 are input to the ejecting portion state determination circuit 73, which will be described in detail later. Then, the ejecting portion state determination circuit 73 outputs the ejecting portion state signals DI11 to DInm indicating the state of the corresponding ejecting portion 600 based on the input residual vibration signals NVT11 to NVTnm. The print head control circuit 71 determines, based on the input ejecting portion state signals DI11 to DInm, whether or not to cause the maintenance mechanism 6 to execute the wiping processing, the flushing processing, or the like and outputs the print head operation information signal IHD indicating the result of the determination to the liquid ejecting apparatus control circuit 81.

Here, in the following description, the residual vibration signals NVT11 to NVTnm may be simply referred to as a residual vibration signal NVT in a case where it is not necessary to particularly distinguish the residual vibration signals NVT11 to NVTnm and the ejecting portion state signals DI11 to DInm may be simply referred to as an ejecting portion state signal DI in a case where it is not necessary to particularly distinguish the ejecting portion state signals DI11 to DInm. In addition, the residual vibration signal NVT11 means the residual vibration signal NVT corresponding to the ejecting portion 600 included in the head chip 310-1 of the head main body 31-1 and the residual vibration signal NVTnm means the residual vibration signal NVT corresponding to the ejecting portion 600 included in the head chip 310-*m* of the head main body 31-*n*. Further, the ejecting portion state signal DI11 indicates the state of the ejecting portion 600 corresponding to the residual vibration signal NVT11 and the ejecting portion state signal DInm indicates the state of the ejecting portion 600 corresponding to the residual vibration signal NVTnm.

In addition, the print head control circuit 71 outputs a memory control signal MC for controlling a storage circuit 200 included in the wiring substrate 335, which will be described later. Here, examples of the control of the storage circuit 200 include reading of information stored in the storage circuit 200 and information writing to the storage circuit 200. Further, in a case where the memory control signal MC for reading the information stored in the storage circuit 200 is output from the print head control circuit 71, a storage data signal MI corresponding to the read information is input to the print head control circuit 71.

Here, the memory control signal MC output from the print head control circuit 71 propagates through wiring common with the printing data signal SI11 and is input to the print head 3. Specifically, the memory control signal MC for reading the information stored in the storage circuit 200 output by the print head control circuit 71 is output in a case where the printing data signal SI11 is not output. As a result, it is not necessary to newly provide wiring for controlling the storage circuit 200 and it is possible to reduce the number of wires of the cable 17 included in the liquid ejecting apparatus 1.

It should be noted that the print head drive circuit substrate 7 is not limited to being constituted by one substrate and may be constituted by a plurality of substrates. Specifically, at least some of the plurality of circuits mounted on the print head drive circuit substrate 7 including the print head control circuit 71, the drive signal output circuit 72, and the ejecting portion state determination circuit 73 included in the print head drive circuit substrate 7 may be mounted on different substrates and electrically coupled by a connector (not illustrated), a cable (not illustrated), or the like in an alternative configuration.

1.3.3 Functional Configuration of Print Head

Next, the functional configuration of the print head will be described. As illustrated in FIG. 6, the print head 3 has the wiring substrate 335 and the n head main bodies 31. Further, each of the n head main bodies 31 and the wiring substrate 335 are electrically coupled by the cable 366.

Figure 9:
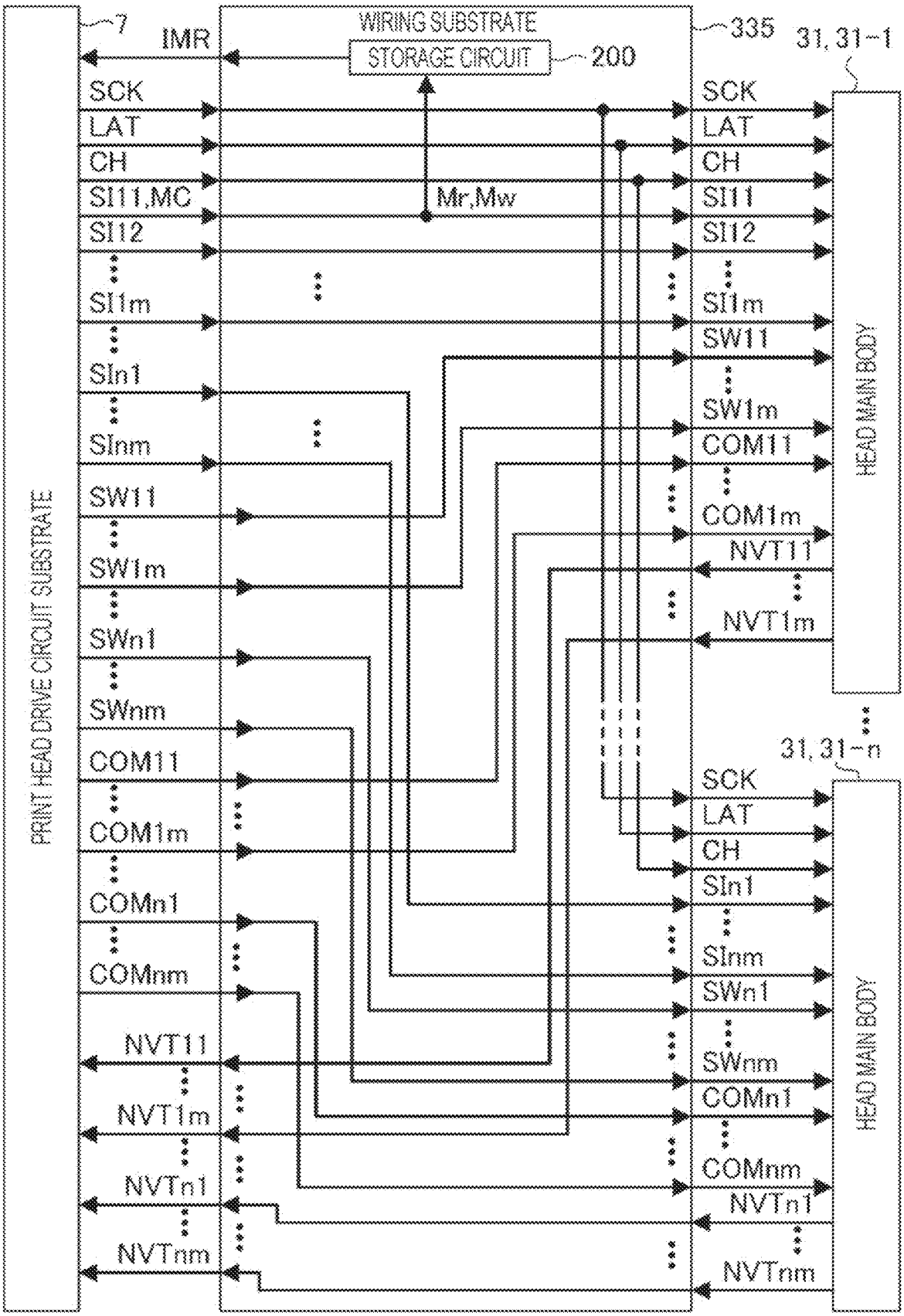
FIG. 9 is a diagram for describing details of a wiring substrate 335.

First, the functional configuration of the wiring substrate 335 will be described with reference to FIG. 9. FIG. 9 is a diagram for describing details of the wiring substrate 335. The drive signals COM11 to COMnm, the printing data signals SI11 to SInm, the clock signal SCK, the latch signal LAT, the change signal CH, and the switching signals SW11 to SWnm are input to the wiring substrate 335 from the print head drive circuit substrate 7. Then, each of the drive signals COM11 to COMnm, the printing data signals SI11 to SInm, the clock signal SCK, the latch signal LAT, the change signal CH, and the switching signals SW11 to SWnm propagates through the wiring substrate 335 and then is input to the corresponding head main body 31.

Specifically, the wiring substrate 335 outputs the printing data signals SI11 to Slim, the clock signal SCK, the latch signal LAT, the change signal CH, the switching signals SW11 to SW1*m*, and the drive signals COM11 to COM1*m* corresponding to the head main body 31-1 to the head main body 31-1. Likewise, the wiring substrate 335 outputs the printing data signals SIn1 to SInm, the clock signal SCK, the latch signal LAT, the change signal CH, the switching signals SWn1 to SWnm, and the drive signals COMn1 to COMnm corresponding to the head main body 31-*n* to the head main body 31-*n*.

In other words, the wiring substrate 335 functions as a relay substrate that allows the drive signals COM11 to COMnm, the printing data signals SI11 to SInm, the clock signal SCK, the latch signal LAT, the change signal CH, and the switching signals SW11 to SWnm to branch and be relayed between the print head drive circuit substrate 7 and the n head main bodies 31.

In addition, the wiring substrate 335 has the storage circuit 200. In other words, the storage circuit 200 is disposed on the wiring substrate 335. History information indicating the operation state of the print head is stored in the storage circuit 200, which will be described in detail later. It should be noted that the history information of the print head 3 stored in the storage circuit 200 may be referred to as ejecting portion-related information in the following description. Here, the storage circuit 200 in the present embodiment is an electrically erasable non-volatile memory and, specifically, an EEPROM, a flash memory, or the like is used. The electrically erasable non-volatile memory is a non-volatile memory in which a charge stored in a gate of a transistor can be released by voltage application to the gate of the transistor (not illustrated) included in the storage circuit 200, which is a non-volatile memory. Further, the storage circuit 200 configured as described above is mounted on the integrated circuit 336 illustrated in FIG. 3.

In addition, the storage circuit 200 is controlled by the memory control signal MC input from the print head drive circuit substrate 7. Specifically, in a case where the memory control signal MC input to the storage circuit 200 is a signal for reading information stored in a predetermined region of the storage circuit 200, the storage circuit 200 reads information corresponding to the input memory control signal MC and outputs the information as the storage data signal MI. In addition, in a case where the memory control signal MC input to the storage circuit 200 is a signal for storing new information in a predetermined region of the storage circuit 200, the storage circuit 200 stores information corresponding to the input memory control signal MC in a predetermined memory region. It should be noted that information stored in the memory circuit 200 and specific examples of information stored in the memory circuit 200 will be described later.

Next, the functional configuration of the head main body 31 electrically coupled to the wiring substrate 335 via the cable 366 will be described with reference to FIG. 10. Here, the head main bodies 31-1 to 31-*n* of the print head 3 have the same configuration. Accordingly, the head main body 31-1 will be described as an example in the description of FIG. 10 and the head main bodies 31-2 to 31-*n* will not be described.

Figure 10:
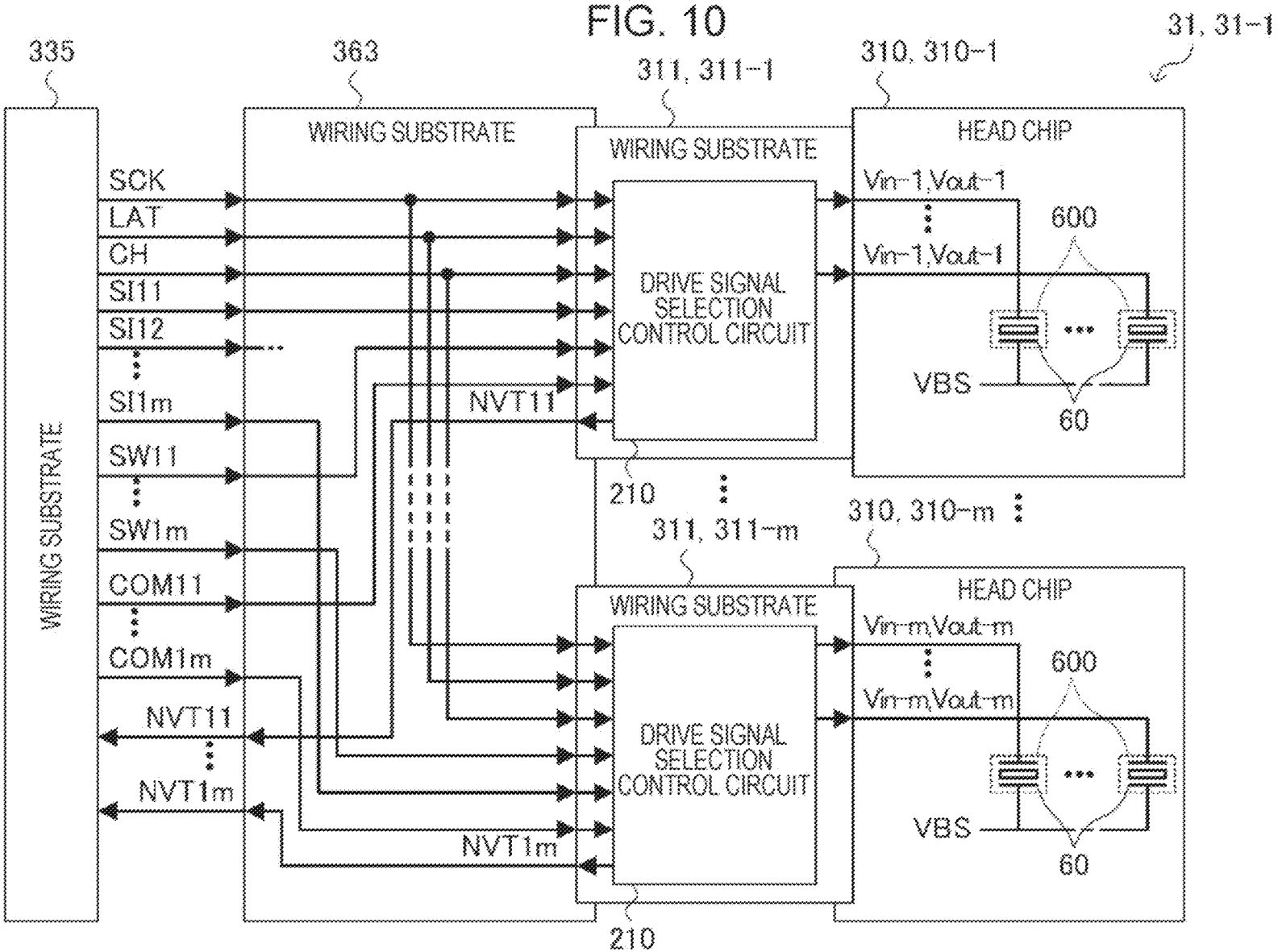
FIG. 10 is a diagram for describing details of the head main body.

FIG. 10 is a diagram for describing details of the head main body 31-1. As illustrated in FIG. 10, the head main body 31-1 has the wiring substrate 363, the head chips 310-1 to 310-*m*, and the wiring substrates 311-1 to 311-*m*. Further, the wiring substrates 311-1 to 311-*m* are coupled in common to the wiring substrate 363 and the wiring substrates 311-1 to 311-*m* are electrically and respectively coupled to the head chips 310-1 to 310-*m*. Specifically, the wiring substrate 363 and the head chip 310-1 are electrically coupled via the wiring substrate 311-1 and the wiring substrate 363 and the head chip 310-*m* are electrically coupled via the wiring substrate 311-*m*.

Each of the drive signals COM11 to COM1*m*, the printing data signals SI11 to Slim, the clock signal SCK, the latch signal LAT, the change signal CH, and the switching signals SW11 to SW1*m* is input to the wiring substrate 363 from the wiring substrate 335. Then, each of the drive signals COM11 to COM1*m*, the printing data signals SI11 to Slim, the clock signal SCK, the latch signal LAT, the change signal CH, and the switching signals SW11 to SW1*m* propagates through the wiring substrate 363 and then is input to the corresponding wiring substrate 311.

Specifically, the wiring substrate 363 outputs the printing data signal SI11, the clock signal SCK, the latch signal LAT, the change signal CH, the switching signal SW11, and the drive signal COM11 corresponding to the wiring substrate 311-1 and the head chip 310-1 electrically coupled to the wiring substrate 311-1 to the wiring substrate 311-1. Likewise, the wiring substrate 363 outputs the printing data signal Slim, the clock signal SCK, the latch signal LAT, the change signal CH, the switching signal SW1*m*, and the drive signal COM1*m* corresponding to the wiring substrate 311-*m* and the head chip 310-*m* electrically coupled to the wiring substrate 311-*m* to the wiring substrate 311-*m*.

In other words, the wiring substrate 363 functions as a relay substrate that allows the drive signals COM11 to COM1*m*, the printing data signals SI11 to Slim, the clock signal SCK, the latch signal LAT, the change signal CH, and the switching signals SW11 to SW1*m* to branch and be relayed between the wiring substrate 335 and the m head chips 310.

Each of the wiring substrates 311-1 to 311-*m* has a drive signal selection control circuit 210. In addition, the head chips 310-1 to 310-*m* have the plurality of ejecting portions 600. Here, the drive signal selection control circuit 210 included in each of the wiring substrates 311-1 to 311-*m* is mounted on the integrated circuit 312 provided in each of the wiring substrates 311-1 to 311-*m*.

The drive signal COM11, the printing data signal SI11, the clock signal SCK, the latch signal LAT, the change signal CH, and the switching signal SW11 input to the wiring substrate 311-1 are input to the drive signal selection control circuit 210 included in the wiring substrate 311-1. Then, the drive signal selection control circuit 210 included in the wiring substrate 311-1 controls whether or not to select a signal waveform included in the drive signal COM11 at the timing defined by the printing data signal SI11, the clock signal SCK, the latch signal LAT, and the change signal CH. As a result, the drive signal selection control circuit 210 included in the wiring substrate 311-1 generates a drive signal Vin-1 and outputs the drive signal Vin-1 to the electrode 602 of the piezoelectric element 60 included in the ejecting portion 600 included in the head chip 310-1. In addition, a reference voltage signal VBS is supplied to the electrode 603 of the piezoelectric element 60. Accordingly, the piezoelectric element 60 included in the ejecting portion 600 included in the head chip 310-1 is driven in accordance with the potential difference between the drive signal Vin-1 supplied to the electrode 602 and the reference voltage signal VBS supplied to the electrode 603. As a result, ink is ejected from the corresponding ejecting portion 600 by an amount corresponding to the driving of the piezoelectric element 60.

In addition, a residual vibration Vout-1 generated in the ejecting portion 600 driven based on the drive signal Vin-1 is input to the drive signal selection control circuit 210 included in the wiring substrate 311-1. The drive signal selection control circuit 210 included in the wiring substrate 311-1 generates the residual vibration signal NVT11 based on the input residual vibration Vout-1. The residual vibration signal NVT11 is input to the ejecting portion state determination circuit 73 included in the print head drive circuit substrate 7 via the wiring substrates 363 and 335.

The switching signal SW11 input to the wiring substrate 311-1 switches between whether the drive signal selection control circuit 210 outputs the drive signal Vin-1 or the residual vibration Vout-1 generated in the corresponding ejecting portion 600 is input to the drive signal selection control circuit 210.

The drive signal COM1*m*, the printing data signal Slim, the clock signal SCK, the latch signal LAT, the change signal CH, and the switching signal SW1*m* input to the wiring substrate 311-*m* are input to the drive signal selection control circuit 210 included in the wiring substrate 311-*m*. Then, the drive signal selection control circuit 210 included in the wiring substrate 311-*m* controls whether or not to select a signal waveform included in the drive signal COM1*m* at the timing defined by the printing data signal Slim, the clock signal SCK, the latch signal LAT, and the change signal CH. As a result, the drive signal selection control circuit 210 included in the wiring substrate 311-*m* generates a drive signal Vin-m and outputs the drive signal Vin-m to the electrode 602 of the piezoelectric element 60 included in the ejecting portion 600 included in the head chip 310-*m*. In addition, a reference voltage signal VBS is supplied to the electrode 603 of the piezoelectric element 60. Accordingly, the piezoelectric element 60 included in the ejecting portion 600 included in the head chip 310-*m* is driven in accordance with the potential difference between the drive signal Vin-m supplied to the electrode 602 and the reference voltage signal VBS supplied to the electrode 603. As a result, ink is ejected from the corresponding ejecting portion 600 by an amount corresponding to the driving of the piezoelectric element 60.

In addition, a residual vibration Vout-m generated in the ejecting portion 600 driven based on the drive signal Vin-m is input to the drive signal selection control circuit 210 included in the wiring substrate 311-*m*. The drive signal selection control circuit 210 included in the wiring substrate 311-*m* generates the residual vibration signal NVT1*m* based on the input residual vibration Vout-m. The residual vibration signal NVT1*m* is input to the ejecting portion state determination circuit 73 included in the print head drive circuit substrate 7 via the wiring substrates 363 and 335.

The switching signal SW1*m* input to the wiring substrate 311-*m* switches between whether the drive signal selection control circuit 210 outputs the drive signal Vin-m or the residual vibration Vout-m generated in the corresponding ejecting portion 600 is input to the drive signal selection control circuit 210.

Here, the reference voltage signal VBS is a potential signal that serves as a reference for displacement of the piezoelectric element 60 and is, for example, a signal of a ground potential or a potential of DC 5.5 V, DC 6 V, or the like. In addition, the reference voltage signal VBS is generated by, for example, the drive signal output circuit 72 or a voltage generation circuit (not illustrated). In addition, in the following description, the drive signals Vin-1 to Vin-m may be simply referred to as a drive signal Vin in a case where it is not necessary to particularly distinguish the drive signals Vin-1 to Vin-m and the residual vibrations Vout-1 to Vout-m may be simply referred to as a residual vibration Vout in a case where it is not necessary to particularly distinguish the residual vibrations Vout-1 to Vout-m.

Here, the residual vibration Vout generated in the ejecting portion 600 will be described. After ink is ejected from the ejecting portion 600, damped vibration occurs in the diaphragm 621 included in the ejecting portion 600. Specifically, the internal pressure of the pressure generation chamber 631 changes by the ink being ejected from the ejecting portion 600. When the supply of the drive signal Vin to the electrode 602 is subsequently stopped, the damped vibration occurs in the diaphragm 621 in accordance with the change in the internal pressure of the pressure generation chamber 631. Then, the piezoelectric element 60 provided on the diaphragm 621 is displaced in accordance with the damped vibration as a result of the damped vibration of the diaphragm 621. As a result, a signal corresponding to the damped vibration is output from the piezoelectric element 60. The residual vibration Vout is the signal that is output from the piezoelectric element 60 based on the damped vibration resulting from the change in the internal pressure of the pressure generation chamber 631.

At least one of the cycle and the vibration frequency of the residual vibration Vout described above varies with the state of the ejecting portion 600, examples of which include a case where the ejecting portion 600 is normal, a case where the viscosity of the ink ejected from the ejecting portion 600 is abnormal, a case where air bubbles are mixed in the pressure generation chamber 631 of the ejecting portion 600, and a case where paper dust or the like adheres to the vicinity of the nozzle 651 of the ejecting portion 600. In other words, the ejecting portion state determination circuit 73 included in the print head drive circuit substrate 7 determines the cycle and the vibration frequency of the corresponding residual vibration Vout based on the input residual vibration signals NVT11 to NVTnm and outputs the ejecting portion state signals DI11 to DInm indicating the state of the corresponding ejecting portion 600 based on the result of the determination.

1.3.4 Functional Configuration of Drive Signal Line Selection Control Circuit

Next, the functional configuration of the drive signal selection control circuit 210 included in the head main body 31 will be described. It should be noted that each drive signal selection control circuit 210 included in the print head 3 has the same configuration, the drive signal selection control circuit 210 included in the wiring substrate 311-1 of the head main body 31-1 will be described as an example in the following description, and the rest of the drive signal selection control circuits 210 will not be described.

Figure 11:
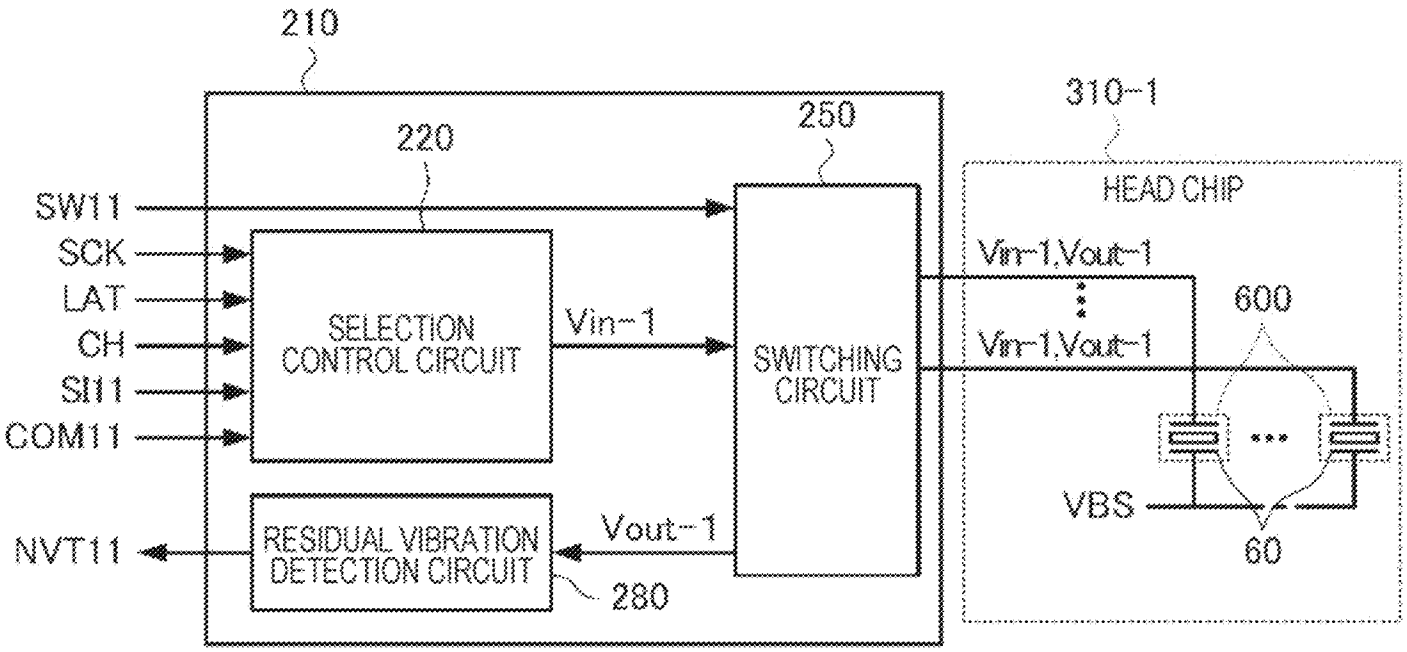
FIG. 11 is a diagram for describing details of a drive signal selection control circuit.

FIG. 11 is a diagram for describing details of the drive signal selection control circuit 210. As illustrated in FIG. 11, the drive signal selection control circuit 210 includes a selection control circuit 220, a switching circuit 250, and a residual vibration detection circuit 280.

The clock signal SCK, the latch signal LAT, the change signal CH, the printing data signal SI11, and the drive signal COM11 are input to the selection control circuit 220. Then, the selection control circuit 220 generates and outputs the drive signal Vin-1 by controlling whether or not to select a signal waveform included in the drive signal COM11 based on the clock signal SCK, the latch signal LAT, the change signal CH, and the printing data signal SI11. The switching circuit 250 switches, based on the switching signal SW11, between whether to supply the drive signal Vin-1 to the head chip 310 or to supply the residual vibration Vout-1 generated after the drive signal Vin-1 is supplied to the head chip 310 to the residual vibration detection circuit 280. Then, the residual vibration detection circuit 280 detects the input residual vibration Vout-1 and outputs the residual vibration signal NVT11 based on the detected residual vibration Vout-1.

Figure 12:
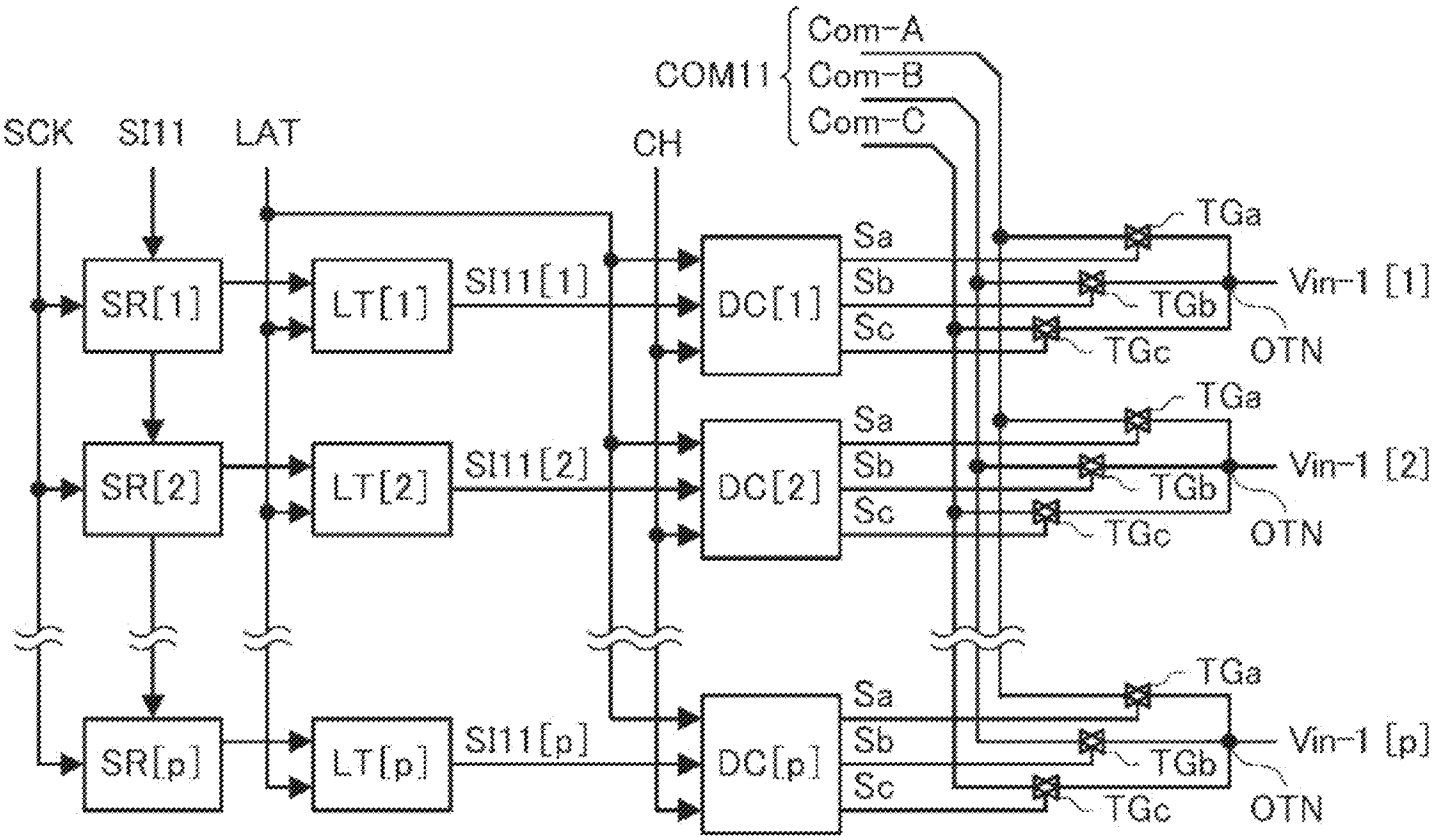
FIG. 12 is a block diagram illustrating the configuration of a selection control circuit.

First, the configuration and operation of the selection control circuit 220 will be described. FIG. 12 is a block diagram illustrating the configuration of the selection control circuit 220. As illustrated in FIG. 12, the selection control circuit 220 includes the same number of shift registers SR, latch circuits LT, decoders DC, and transmission gates TGa, TGb, and TGc as the ejecting portions 600 included in the head chip 310-1. In other words, the selection control circuit 220 includes the same number of sets of the shift register SR, the latch circuit LT, the decoder DC, and the transmission gates TGa, TGb, and TGc as the ejecting portion 600 included in the head chip 310-1.

It should be noted that the head chip 310-1 is assumed to include p ejecting portions 600 in the following description. Further, the respective elements of the shift register SR, the latch circuit LT, the decoder DC, and the transmission gates TGa, TGb, and TGc of the selection control circuit 220 are referred to as a first stage, a second stage, . . . , a p stage in order from the upper side in FIG. 12 so as to respectively correspond to the p ejecting portions 600. Here, in FIG. 12, the shift registers SR respectively corresponding to the first stage, the second stage, . . . , the p stage are indicated as SR[1], SR[2], . . . , SR[*p*], the latch circuits LT respectively corresponding to the first stage, the second stage, . . . , the p stage are indicated as LT[1], LT[2], . . . , LT[*p*], the decoders DC respectively corresponding to the first stage, the second stage, . . . , the p stage are indicated as DC[1], DC[2], . . . , DC[*p*], and the drive signals Vin-1 respectively corresponding to the first stage, the second stage, . . . , the p stage are indicated as Vin-1[1], Vin-1[2], . . . , Vin-1[*p*].

The clock signal SCK, the printing data signal SI11, the latch signal LAT, the change signal CH, and the drive signal COM11 are supplied to the selection control circuit 220. In addition, as illustrated in FIG. 12, the drive signal COM11 includes three drive signals Com-A, Com-B, and Com-C.

The printing data signal SI11 is a digital signal defining the amount of ink ejected from the nozzle 651 of the corresponding ejecting portion 600 in a case where one dot of an image is formed. Specifically, the printing data signal SI11 includes three-bit printing data [b1, b2, b3] corresponding to each of the p ejecting portions 600. In other words, the printing data signal SI11 includes a total of 3p bits of data. Further, the amount of ink ejected from the ejecting portion 600 is defined by the printing data [b1, b2, b3]. The printing data signal SI11 is input to the selection control circuit 220 in synchronization with the clock signal SCK. The selection control circuit 220 outputs the drive signal Vin-1 corresponding to the amount of ink ejected from the ejecting portion 600 based on the input printing data signal SI11. The drive signal Vin-1 is supplied to the piezoelectric element 60 included in the corresponding ejecting portion 600. Then, the four gradations of non-recording, small-dot, medium-dot, and large-dot are expressed on the medium P by the drive signal Vin-1 being supplied to the corresponding piezoelectric element 60. In addition, the selection control circuit 220 also generates the drive signal Vin-1 for inspection for inspecting the state of the ejecting portion 600 based on the input printing data signal SI11.

Each of the shift registers SR temporarily holds the three-bit printing data [b1, b2, b3] included in the printing data signal SI11 and sequentially transfers the three-bit printing data [b1, b2, b3] to the subsequent shift register SR in accordance with the clock signal SCK. Specifically, the p shift registers SR respectively corresponding to the p ejecting portions 600 are coupled in cascade. Further, the serially supplied printing data signal SI11 is sequentially transferred to the subsequent shift register SR in accordance with the clock signal SCK. Subsequently, the supply of the clock signal SCK is stopped at the point in time when the printing data signal SI11 is transferred to all of the p shift registers SR. As a result, each of the p shift registers SR holds the three-bit printing data [b1, b2, b3] corresponding to each of the p ejecting portions 600.

Each of the p latch circuits LT latches the three-bit printing data [b1, b2, b3] held by each of the p shift registers SR in synchronization with the rise of the latch signal LAT. Here, the SI11[1] to SI11[*p*] that are illustrated in FIG. 12 indicate p pieces of printing data [b1, b2, b3] respectively held by the p shift registers SR[1] to SR[*p*] and latched by the corresponding latch circuits LT[1] to LT[*p*].

By the way, the operation period in which the liquid ejecting apparatus 1 executes printing includes a plurality of unit operation periods Tu. In addition, each unit operation period Tu includes a control period Ts1 and a control period Ts2 subsequent to the control period Ts1. The plurality of unit operation periods Tu include, for example, the unit operation period Tu in which printing processing is executed, the unit operation period Tu in which ejection abnormality detection processing is executed, and the unit operation period Tu in which both the printing processing and the ejection abnormality detection processing are executed.

The printing data signal SI11 is supplied to the selection control circuit 220 for each unit operation period Tu, and the latch circuit LT latches the printing data signal SI11 for each unit operation period Tu. In other words, the drive signal Vin-1 is supplied to the piezoelectric elements 60 included in the p ejecting portions 600 for each unit operation period Tu.

Specifically, in a case where the print head 3 executes only the printing processing in the unit operation period Tu, the selection control circuit 220 supplies the drive signal Vin-1 for printing with respect to the piezoelectric elements 60 included in the p ejecting portions 600. In this case, ink is ejected to the medium P by an amount corresponding to the image that is formed from each nozzle 651.

On the other hand, in a case where the print head 3 executes only the ejection abnormality detection processing in the unit operation period Tu, the selection control circuit 220 supplies the drive signal Vin-1 for inspection with respect to the piezoelectric elements 60 included in the p ejecting portions 600. In this case, detection processing is executed as to whether or not an abnormality has occurred in the corresponding ejecting portion 600.

In addition, in a case where the print head 3 executes both the printing processing and the ejection abnormality detection processing in the unit operation period Tu, the selection control circuit 220 supplies the drive signal Vin-1 for printing with respect to some of the piezoelectric elements 60 included in the p ejecting portions 600 and supplies the drive signal Vin-1 for inspection with respect to the piezoelectric elements 60 included in the rest of the ejecting portions 600.

The decoder DC decodes the three-bit printing data [b1, b2, b3] latched by the latch circuit LT and outputs H-level or L-level selection signals Sa, Sb, and Sc in each of the control periods Ts1 and Ts2.

FIG. 13 is a diagram illustrating the content of the decoding performed by the decoder DC. As illustrated in FIG. 13, in a case where the input printing data [b1, b2, b3] is [1, 0, 0], the decoder DC sets the selection signals Sa, Sb, and Sc respectively to the H, L, and L levels in the control period Ts1 and sets the selection signals Sa, Sb, and Sc respectively to the L, H, and L levels in the control period Ts2.

Returning to FIG. 12, the selection signal Sa is input to the transmission gate TGa. Then, the transmission gate TGa becomes conductive in a case where the input selection signal Sa is at the H level and becomes non-conductive in a case where the input selection signal Sa is at the L level. In addition, the selection signal Sb is input to the transmission gate TGb. The transmission gate TGb becomes conductive in a case where the input selection signal Sb is at the H level and becomes non-conductive in a case where the input selection signal Sb is at the L level. In addition, the selection signal Sc is input to the transmission gate TGc. The transmission gate TGc becomes conductive in a case where the input selection signal Sc is at the H level and becomes non-conductive in a case where the input selection signal Sc is at the L level.

In other words, in a case where the printing data [b1, b2, b3] is [1, 0, 0], the transmission gate TGa is controlled to be conductive, the transmission gate TGb is controlled to be non-conductive, and the transmission gate TGc is controlled to be non-conductive in the control period Ts1. In addition, in the control period Ts2, the transmission gate TGa is controlled to be non-conductive, the transmission gate TGb is controlled to be conductive, and the transmission gate TGc is controlled to be non-conductive.

As illustrated in FIG. 12, the drive signal Com-A in the drive signal COM11 is supplied to one end of the transmission gate TGa, the drive signal Com-B in the drive signal COM11 is supplied to one end of the transmission gate TGb, and the drive signal Com-C in the drive signal COM11 is supplied to one end of the transmission gate TGc. In addition, the other respective ends of the transmission gates TGa, TGb, and TGc are coupled in common to an output end OTN. Accordingly, the drive signals Com-A, Com-B, and Com-C included in the drive signal COM11 are selectively output to the output end OTN by the transmission gates TGa, TGb, and TGc becoming conductive or non-conductive in each of the control periods Ts1 and Ts2. The signal of the output end OTN is supplied to the switching circuit 250 as the drive signal Vin-1.

Figure 14:
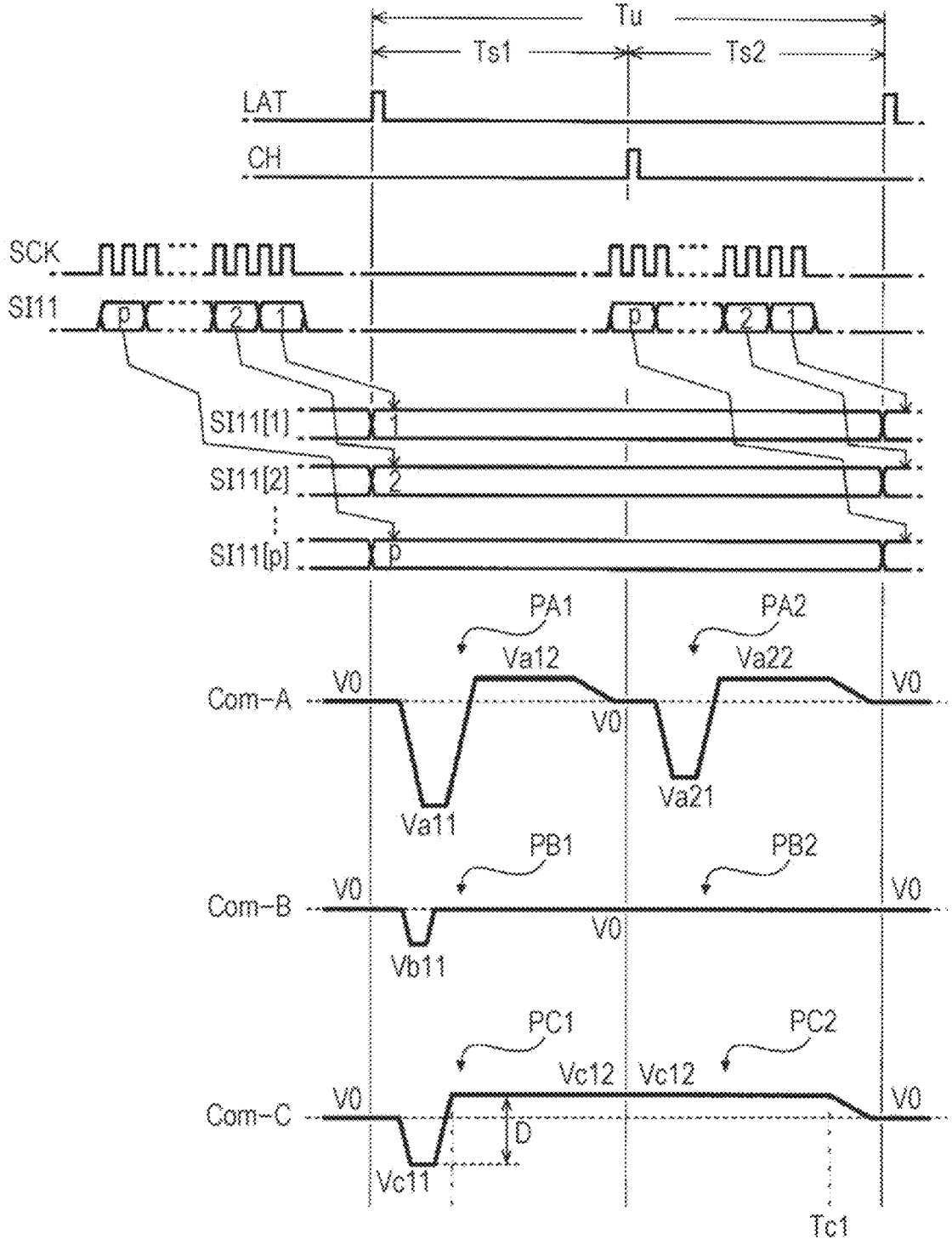
FIG. 14 is a diagram for describing the operation of the selection control circuit in a unit operation period.

FIG. 14 is a diagram for describing the operation of the selection control circuit 220 in the unit operation period Tu. As illustrated in FIG. 14, the unit operation period Tu is defined by the latch signal LAT. In addition, the control periods Ts1 and Ts2 included in the unit operation period Tu are defined by the latch signal LAT and the change signal CH.

Of the drive signals COM11 input to the selection control circuit 220, the drive signal Com-A is a signal for generating the drive signal Vin-1 for printing in the unit operation period Tu. Specifically, the drive signal Com-A includes a waveform in which a unit waveform PA1 disposed in the control period Ts1 and a unit waveform PA2 disposed in the control period Ts2 are continuous. As for the unit waveform PA1 and the unit waveform PA2, each of the potentials at the start and end timings is a reference potential V0. In addition, the potential difference between a potential Va11 and a potential Va12 of the unit waveform PA1 is larger than the potential difference between a potential Va21 and a potential Va22 of the unit waveform PA2. Accordingly, the amount of ink ejected from the corresponding nozzle 651 in a case where the unit waveform PA1 is supplied to the piezoelectric element 60 is larger than the amount of ink ejected from the corresponding nozzle 651 in a case where the unit waveform PA2 is supplied to the piezoelectric element 60. Here, in the following description, the amount of ink ejected from the nozzle 651 based on the unit waveform PA1 is referred to as a medium amount and the amount of ink ejected from the nozzle 651 based on the unit waveform PA2 is referred to as a small amount.

In addition, of the drive signals COM11 input to the selection control circuit 220, the drive signal Com-B is a signal for generating the drive signal Vin-1 for printing in the unit operation period Tu. Specifically, the drive signal Com-B includes a waveform in which a unit waveform PB1 disposed in the control period Ts1 and a unit waveform PB2 disposed in the control period Ts2 are continuous. The potential of the unit waveform PB1 is the reference potential V0 at both the start and end timings, and the potential of the unit waveform PB2 is the reference potential V0 over the control period Ts2. In addition, the potential difference between a potential Vb11 of the unit waveform PB1 and the reference potential V0 is smaller than the potential difference between the potential Va21 of the unit waveform PA2 and the reference potential V0 and the potential difference between the potential Va22 and the reference potential V0. In a case where the unit waveform PB1 is supplied to the piezoelectric element 60, the piezoelectric element 60 is driven to the extent that no ink is ejected from the corresponding nozzle 651. In addition, in a case where the unit waveform PB2 is supplied to the piezoelectric element 60, the piezoelectric element 60 is not displaced. Accordingly, no ink is ejected from the nozzle 651.

In addition, of the drive signals COM11 input to the selection control circuit 220, the drive signal Com-C is a signal for generating the drive signal Vin for inspection in the unit operation period Tu. Specifically, the drive signal Com-C includes a waveform in which a unit waveform PC1 disposed in the control period Ts1 and a unit waveform PC2 disposed in the control period Ts2 are continuous. Both the potential at the start timing of the unit waveform PC1 and the potential at the end timing of the unit waveform PC2 are the reference potential V0. In addition, the potential of the unit waveform PC1 transitions from the reference potential V0 to a potential Vc11 and then from the potential Vc11 to a potential Vc12. After maintaining the potential Vc12 until a control time Tc1, the unit waveform PC2 transitions from the potential Vc12 to the reference potential V0 before the control period Ts2 ends.

As illustrated in FIG. 14, the printing data signals SI11[1] to SI11[*p*] supplied as serial signals are sequentially propagated to the shift register SR by the clock signal SCK. When the clock signal SCK is subsequently stopped, the corresponding printing data signals SI11[1] to SI11[*p*] are held by the shift registers SR[1] to SR[*p*]. Then, the p latch circuits LT latch the printing data signals SI11[1] to SI11[*p*] respectively held by the shift registers SR[1] to SR[*p*] at the rise timing of the latch signal LAT, that is, the start timing of the unit operation period Tu. In each of the control periods Ts1 and Ts2, each of the p decoders DC outputs the selection signals Sa, Sb, and Sc of the logic levels corresponding to the printing data signals SI11[1] to SI11[*p*] latched by the latch circuit LT in accordance with the content of FIG. 13. Each of the p sets of transmission gates TGa, TGb, and TGc is controlled to be conductive or non-conductive based on the logic levels of the input selection signals Sa, Sb, and Sc. As a result, each of the drive signals Com-A, Com-B, and Com-C included in the drive signal COM11 is controlled to be selected or non-selected and the drive signal Vin-1 is output to the output end OTN as a result of the control.

Figure 15:
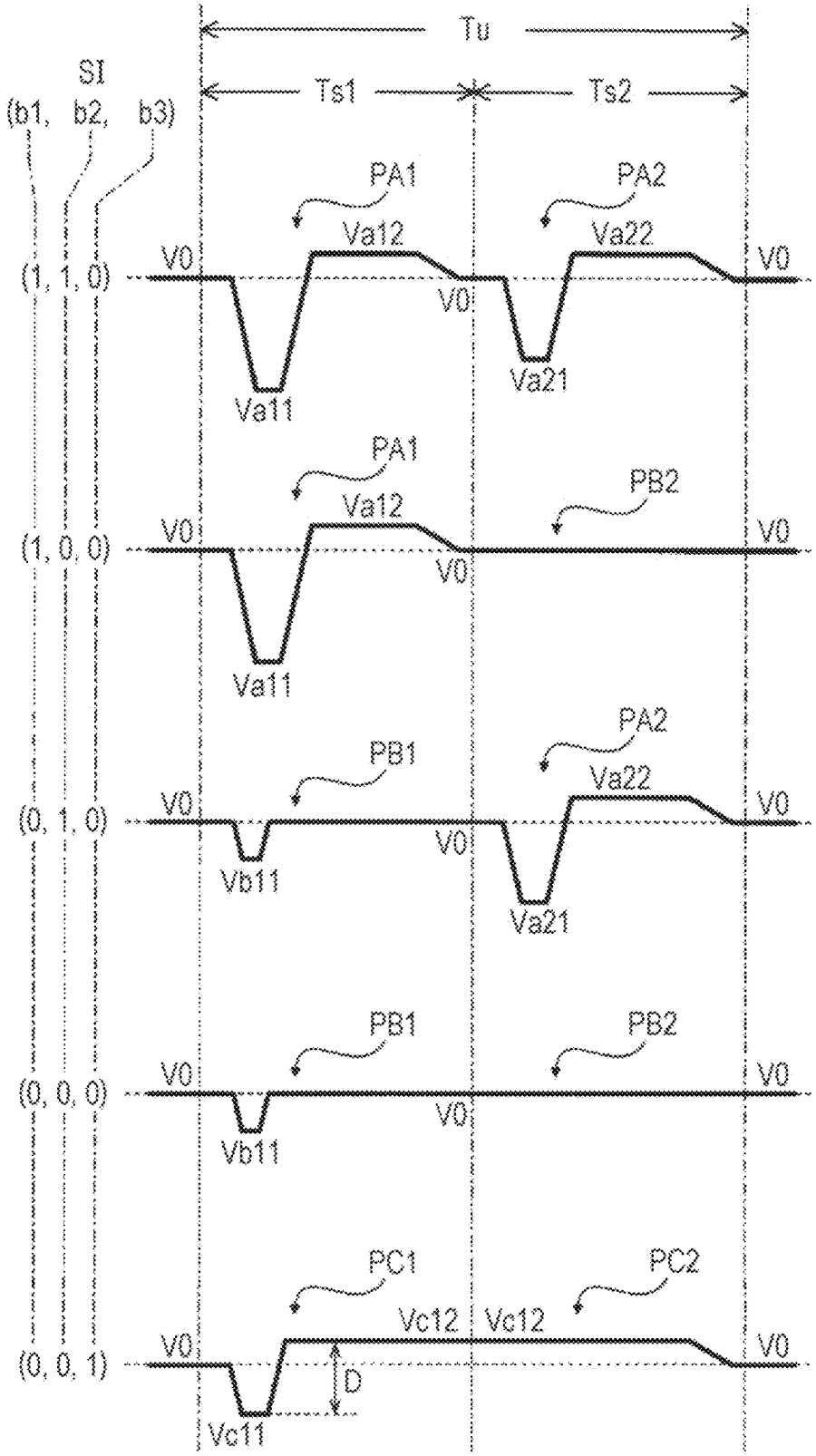
FIG. 15 is a diagram illustrating an example of the waveform of a drive signal Vin-1.

An example of the waveform of the drive signal Vin-1 output in the unit operation period Tu from the selection control circuit 220 configured as described above will be described. FIG. 15 is a diagram illustrating an example of the waveform of the drive signal Vin-1.

In a case where the printing data [b1, b2, b3] included in the printing data signal SI11 supplied to the selection control circuit 220 in the unit operation period Tu is [1, 1, 0], the decoder DC sets the logic levels of the selection signals Sa, Sb, and Sc in the control period Ts1 to the H, L, and L levels and sets the logic levels of the selection signals Sa, Sb, and Sc in the control period Ts2 to the H, L, and L levels. Accordingly, the drive signal Com-A is selected in the control period Ts1 and the drive signal Com-A is selected in the control period Ts2. As a result, the selection control circuit 220 outputs the drive signal Vin-1 having a waveform in which the unit waveform PA1 and the unit waveform PA2 are continuous in the unit operation period Tu. Accordingly, in the unit operation period Tu, the medium amount of ink based on the unit waveform PA1 and the small amount of ink based on the unit waveform PA2 are ejected from the nozzle 651 included in the ejecting portion 600 to which the drive signal Vin-1 is supplied. Then, large dots are formed on the medium P by the ink ejected from the nozzle 651 being joined on the medium P.

In addition, in a case where the printing data [b1, b2, b3] included in the printing data signal SI11 supplied to the selection control circuit 220 in the unit operation period Tu is [1, 0, 0], the decoder DC sets the logic levels of the selection signals Sa, Sb, and Sc in the control period Ts1 to the H, L, and L levels and sets the logic levels of the selection signals Sa, Sb, and Sc in the control period Ts2 to the L, H, and L levels. Accordingly, the drive signal Com-A is selected in the control period Ts1 and the drive signal Com-B is selected in the control period Ts2. As a result, the selection control circuit 220 outputs the drive signal Vin-1 having a waveform in which the unit waveform PA1 and the unit waveform PB2 are continuous in the unit operation period Tu. Accordingly, in the unit operation period Tu, the medium amount of ink based on the unit waveform PA1 is ejected from the nozzle 651 included in the ejecting portion 600 to which the drive signal Vin-1 is supplied and medium dots are formed on the medium P.

In addition, in a case where the printing data [b1, b2, b3] included in the printing data signal SI11 supplied to the selection control circuit 220 in the unit operation period Tu is [0, 1, 0], the decoder DC sets the logic levels of the selection signals Sa, Sb, and Sc in the control period Ts1 to the L, H, and L levels and sets the logic levels of the selection signals Sa, Sb, and Sc in the control period Ts2 to the H, L, and L levels. Accordingly, the drive signal Com-B is selected in the control period Ts1 and the drive signal Com-A is selected in the control period Ts2. As a result, the selection control circuit 220 outputs the drive signal Vin-1 having a waveform in which the unit waveform PB1 and the unit waveform PA2 are continuous in the unit operation period Tu. Accordingly, in the unit operation period Tu, the small amount of ink based on the unit waveform PA2 is ejected from the nozzle 651 included in the ejecting portion 600 to which the drive signal Vin-1 is supplied and small dots are formed on the medium P.

In addition, in a case where the printing data [b1, b2, b3] included in the printing data signal SI11 supplied to the selection control circuit 220 in the unit operation period Tu is [0, 0, 0], the decoder DC sets the logic levels of the selection signals Sa, Sb, and Sc in the control period Ts1 to the L, H, and L levels and sets the logic levels of the selection signals Sa, Sb, and Sc in the control period Ts2 to the L, H, and L levels. Accordingly, the drive signal Com-B is selected in the control period Ts1 and the drive signal Com-B is selected in the control period Ts2. As a result, the selection control circuit 220 outputs the drive signal Vin-1 having a waveform in which the unit waveform PB1 and the unit waveform PB2 are continuous in the unit operation period Tu. Accordingly, in the unit operation period Tu, no ink is ejected from the nozzle 651 included in the ejecting portion 600 to which the drive signal Vin-1 is supplied. Accordingly, no dot is formed on the medium P. In this case, the drive signal Vin-1 output by the selection control circuit 220 drives the piezoelectric element 60 to the extent that no ink is ejected from the nozzle 651. As a result, it is possible to prevent thickening of the ink near the nozzle.

In addition, in a case where the printing data [b1, b2, b3] included in the printing data signal SI11 supplied to the selection control circuit 220 in the unit operation period Tu is [0, 0, 1], the decoder DC sets the logic levels of the selection signals Sa, Sb, and Sc in the control period Ts1 to the L, L, and H levels and sets the logic levels of the selection signals Sa, Sb, and Sc in the control period Ts2 to the L, L, and H levels. Accordingly, the drive signal Com-C is selected in the control period Ts1 and the drive signal Com-C is selected in the control period Ts2. As a result, the selection control circuit 220 outputs the drive signal Vin-1 having a waveform in which the unit waveform PC1 and the unit waveform PC2 are continuous in the unit operation period Tu. Accordingly, in the unit operation period Tu, no ink is ejected from the nozzle 651 included in the ejecting portion 600 to which the drive signal Vin-1 is supplied. Accordingly, no dot is formed on the medium P. In this case, the drive signal Vin-1 output by the selection control circuit 220 corresponds to a waveform for inspection for detecting the residual vibration of the piezoelectric element 60.

Figure 16:
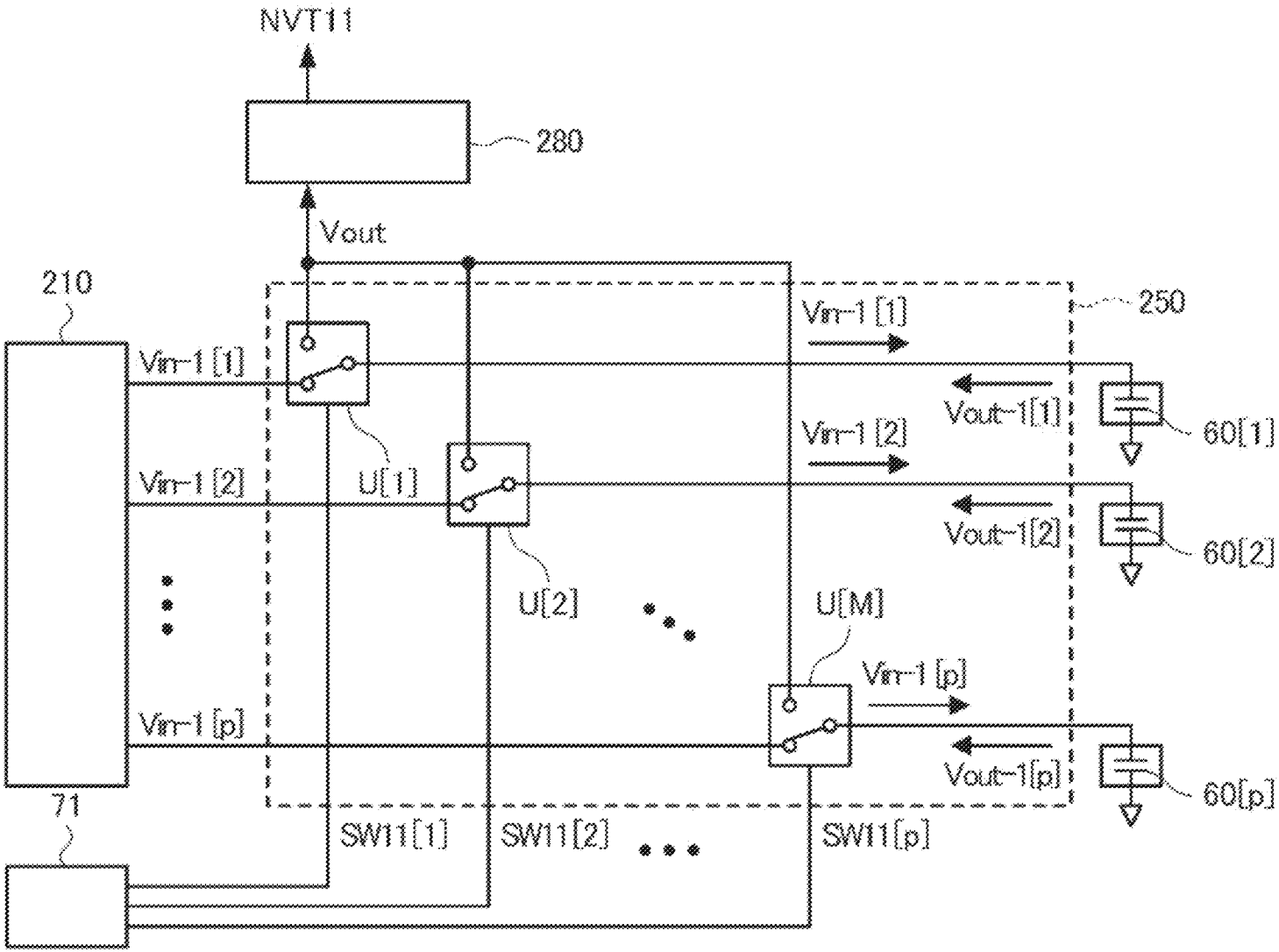
FIG. 16 is a diagram illustrating the electrical configuration of a switching circuit.

Next, the configuration and operation of the switching circuit 250 will be described. FIG. 16 is a diagram illustrating the electrical configuration of the switching circuit 250. The switching circuit 250 includes p changeover switches U as many as the p ejecting portions 600 included in the head chip 310-1. It should be noted that the changeover switches U to which the drive signals Vin-1[1], Vin-1[2], . . . , Vin-1[*p*] output from the selection control circuit 220 are input are indicated as U[1], U[2], . . . , U[*p*] in FIG. 16. Further, of the p piezoelectric elements 60 included in the p ejecting portions 600, the piezoelectric elements 60 to which the drive signals Vin-1[1], Vin-1[2], . . . , Vin-1[*p*] are input are indicated as 60[1], 60[2], . . . , 60[*p*].

Each of the changeover switches U switches, based on the switching signal SW11, between whether to supply the drive signal Vin-1 input from the selection control circuit 220 to the piezoelectric element 60 included in the corresponding ejecting portion 600 or to supply the residual vibration Vout-1 generated after the drive signal Vin-1 is supplied to the piezoelectric element 60 to the residual vibration detection circuit 280.

Specifically, the switching signal SW11[1] is input to the changeover switch U[1]. Then, the changeover switch U[1] switches, based on the switching signal SW11[1], whether to supply the drive signal Vin-1[1] to the piezoelectric element 60[1] or to supply the residual vibration Vout-1[1] generated in the piezoelectric element 60[1] after the drive signal Vin-1[1] is supplied to the piezoelectric element 60[1] to the residual vibration detection circuit 280.

Likewise, the switching signal SW11[*p*] is input to the changeover switch U[*i*]. Then, the changeover switch U[*p*] switches, based on the switching signal SW11[*p*], whether to supply the drive signal Vin-1[*p*] to the piezoelectric element 60[*p*] or to supply the residual vibration Vout-1[*p*] generated in the piezoelectric element 60[*p*] after the drive signal Vin-1[*p*] is supplied to the piezoelectric element 60[*p*] to the residual vibration detection circuit 280.

Here, in the unit operation period Tu, the switching signals SW11[1] to SW11[*p*] switch the changeover switches U[1] to U[*p*] such that any one of the piezoelectric elements 60[1] to 60[*p*] is electrically coupled to the residual vibration detection circuit 280. In other words, the residual vibration detection circuit 280 detects any one of the residual vibrations Vout-1[1] to Vout-1[*p*] respectively corresponding to the p piezoelectric elements 60[1] to 60[*p*] based on the switching signal SW11 and generates the residual vibration signal NVT11 in the corresponding ejecting portion 600. Accordingly, the switching signal SW11 may be capable of controlling the changeover switches U[1] to U[*p*] to be sequentially turned ON and may be a configuration sequentially controlling the p changeover switches U by sequentially propagating the switching signal SW11 by a register (not illustrated) or the like. It should be noted that the residual vibration Vout-1 is assumed to be input from the switching circuit 250 to the residual vibration detection circuit 280 in the following description.

Figure 17:
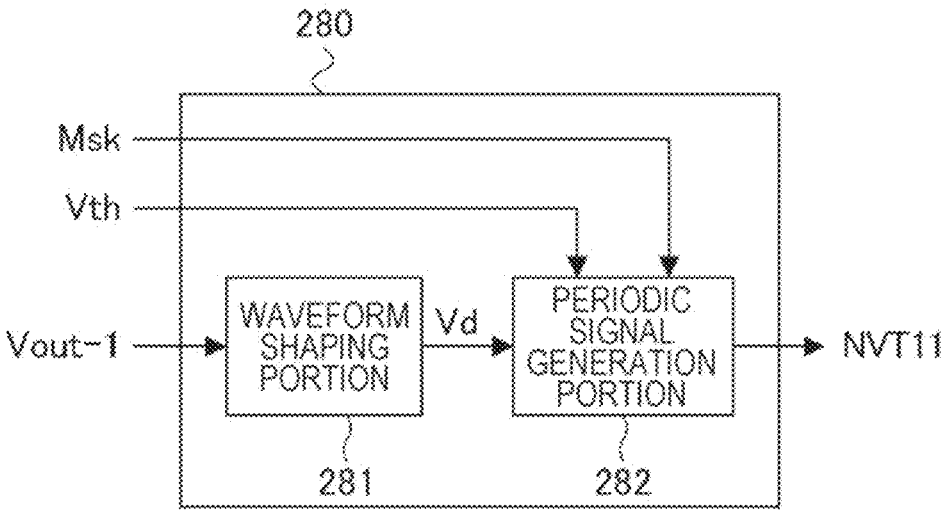
FIG. 17 is a block diagram illustrating the configuration of a residual vibration detection circuit.

Next, the configuration of the residual vibration detection circuit 280 will be described. FIG. 17 is a block diagram illustrating the configuration of the residual vibration detection circuit 280. The residual vibration detection circuit 280 detects the residual vibration Vout-1 and generates and outputs the residual vibration signal NVT11 indicating at least one of the cycle and the vibration frequency of the detected residual vibration Vout-1.

As illustrated in FIG. 17, the residual vibration detection circuit 280 includes a waveform shaping portion 281 and a periodic signal generation portion 282. The waveform shaping portion 281 generates a shaped waveform signal Vd, which is obtained by a noise component being removed from the residual vibration Vout-1. The waveform shaping portion 281 includes, for example, a high-pass filter for outputting a signal in which a frequency component lower in frequency band than the residual vibration Vout-1 is attenuated or a low-pass filter for outputting a signal in which a frequency component higher in frequency band than the residual vibration Vout-1 is attenuated. As a result, the waveform shaping portion 281 limits the frequency range of the residual vibration Vout-1 and outputs the noise component-removed shaped waveform signal Vd. In addition, the waveform shaping portion 281 may include a negative feedback-type amplifier circuit for adjusting the amplitude of residual vibration Vout-1, an impedance conversion circuit for converting the impedance of the residual vibration Vout-1, or the like.

The periodic signal generation portion 282 generates and outputs the residual vibration signal NVT11 indicating the cycle and the vibration frequency of the residual vibration Vout-1 based on the shaped waveform signal Vd. The shaped waveform signal Vd, a mask signal Msk, and a threshold potential Vth are input to the periodic signal generation portion 282. Here, the mask signal Msk and the threshold potential Vth may be supplied from, for example, the print head control circuit 71 or may be supplied to the periodic signal generation portion 282 by information stored in a storage portion (not illustrated) being read.

Figure 18:
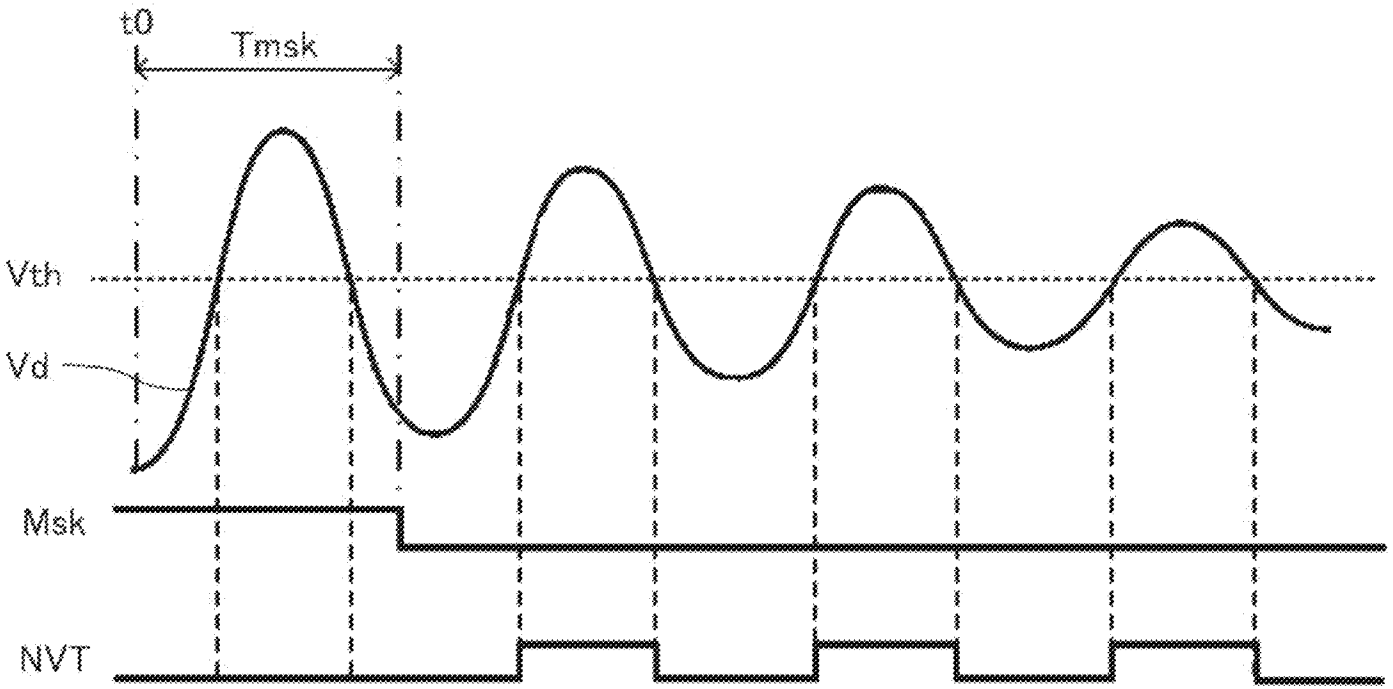
FIG. 18 is a diagram for describing the operation of a periodic signal generation portion.

FIG. 18 is a diagram for describing the operation of the periodic signal generation portion 282. Here, the threshold potential Vth illustrated in FIG. 18 is a threshold that is set to a potential of a predetermined level within the amplitude of the shaped waveform signal Vd and is set to, for example, a potential at the center level of the amplitude of the shaped waveform signal Vd. The periodic signal generation portion 282 generates and outputs the residual vibration signal NVT11 based on the input shaped waveform signal Vd and threshold potential Vth.

Specifically, the periodic signal generation portion 282 compares the potential of the shaped waveform signal Vd with the threshold potential Vth. Then, the periodic signal generation portion 282 generates the residual vibration signal NVT11 that becomes the H level in a case where the potential of the shaped waveform signal Vd is equal to or higher than the threshold potential Vth and becomes the L level in a case where the potential of the shaped waveform signal Vd is lower than the threshold potential Vth.

The residual vibration signal NVT11 generated by the residual vibration detection circuit 280 is input to the ejecting portion state determination circuit 73 illustrated in FIG. 8. The ejecting portion state determination circuit measures the cycle and the vibration frequency of the residual vibration Vout-1 by detecting the period until the logic level of the input residual vibration signal NVT11 becomes the H level again after a transition from the H level to the L level. Then, the ejecting portion state determination circuit 73 generates the ejecting portion state signal DI11 indicating the corresponding ejecting portion 600 based on the result of the cycle and vibration frequency measurement and inputs the ejecting portion state signal DI11 to the print head control circuit 71.

The mask signal Msk is a signal that is at the H level for a predetermined period Tmsk from time t0 when the supply of the shaped waveform signal Vd is started. The periodic signal generation portion 282 stops the generation of the residual vibration signal NVT11 while the mask signal Msk is at the H level and generates the residual vibration signal NVT11 while the mask signal Msk is at the H level. In other words, the periodic signal generation portion 282 generates the residual vibration signal NVT11 only for the shaped waveform signal Vd after the elapse of the period Tmsk among the shaped waveform signals Vd. As a result, the periodic signal generation portion 282 is capable of excluding a noise component that is superimposed immediately after the residual vibration Vout-1 is generated and is capable of generating the high-precision residual vibration signal NVT11.

As described above, the ejecting portion 600 ejects ink in response to the drive signal Vin. In other words, the drive signal Vin is an example of a drive signal. In addition, the drive signal Vin is generated depending on whether or not the signal waveform of the drive signal COM is selected. In other words, the drive signal COM, which is the basis of the drive signal Vin, is also an example of the drive signal.

1.4 Ejecting Portion-Related Information and Operation of Liquid Ejecting Apparatus and Print Head In the liquid ejecting apparatus 1 configured as described above, it is determined, based on the ejecting portion-related information stored in the storage circuit 200 of the print head 3, whether the print head 3 assembled in the liquid ejecting apparatus 1 is a newly manufactured print head or a recycled or reused print head.

From the viewpoint of environmental load reduction in recent years, attention has been focused on so-called refurbished products in which a product having an initial defective product, a used product, or the like is refurbished, finished so as to become comparable to an unused product, and then re-distributed in a market. The amount of waste can be reduced by such refurbished products, and a reduction in environmental load can be achieved as a result. Regarding such efforts and liquid ejecting apparatuses such as ink jet printers, efforts for re-market distribution as recycled machines have been made by, for example, refurbishing and finishing of used ink cartridges, print heads, and so on into a state comparable to a state of non-use.

For example, in a case where an ink cartridge is refurbished, the used ink cartridge is collected and the collected ink cartridge is replenished with ink suitable for the structure of the ink cartridge and the specifications of a liquid ejecting apparatus in which the ink cartridge is used. When the ink with which the ink cartridge has been replenished is in a proper state in a case where the ink cartridge refurbished as described above is used in the liquid ejecting apparatus, it is possible to perform operation comparable to an unused product without applying an excessive load to the liquid ejecting apparatus. In addition, because the ink cartridge in the liquid ejecting apparatus is mostly a structure that can be easily attached and detached, a user can easily replace the ink cartridge with an ink cartridge replenished with proper ink in a case where the ink with which the ink cartridge has been replenished is not in a proper state.

On the other hand, in a case where a print head is refurbished, a liquid ejecting apparatus in which an initial defective product has occurred, a used liquid ejecting apparatus, or the like is collected and the print head is removed from the collected liquid ejecting apparatus. Then, replacement of a deteriorated component in the print head or the like is conducted. However, as a plurality of components constitute the print head, the components constituting the print head may have different remaining service lives in the refurbished print head. Further, in a case where a print head including a component having a short remaining service life is assembled in a liquid ejecting apparatus, ink ejection characteristics in the liquid ejecting apparatus may deteriorate in a short period of time.

It is difficult to visually confirm the remaining service lives of components constituting such print heads, a single head chip may be provided with hundreds to thousands of ink ejecting nozzles in particular, and it is extremely laborious to visually confirm the remaining service lives of all of the nozzles. Further, in the case of market distribution of a liquid ejecting apparatus provided with a refurbished print head including a component having a short remaining service life, it may be impossible to obtain sufficient ejection characteristics and the service life of the liquid ejecting apparatus may decrease. As described above, there is room for improvement in terms of refurbishing a print head and re-distributing a liquid ejecting apparatus including the refurbished print head in a market.

Regarding the above-described problems in the case of re-market distribution of a liquid ejecting apparatus including a refurbished print head, the print head 3 in the present embodiment stores the ejecting portion-related information including the history information indicating a past operation state. Further, it is possible to perform optimal maintenance in recycling or reusing the print head 3 by grasping the state of the print head 3 and the state of the ejecting portion 600 that are not visually confirmed with ease based on the ejecting portion-related information stored in the print head 3 and, in a case where the print head 3 that has been refurbished is incorporated into the liquid ejecting apparatus 1, the liquid ejecting apparatus 1 is capable of driving the print head 3 after grasping the past operation state of the print head 3. Accordingly, from the viewpoint of re-market distribution of the liquid ejecting apparatus 1 including the refurbished print head 3, a manufacturer can perform refurbishing based on the information stored in the print head 3 and can reduce the risk of accidentally discarding the recyclable or reusable print head 3. Further, a user can select the liquid ejecting apparatus 1 that is equipped with the print head 3 which is optimum for the period of use or applications, and thus the convenience of the user can be enhanced.

As described above, the print head 3 in the present embodiment is capable of solving at least one of the problems arising in the print head 3 that is recycled or reused by the storage circuit 200 storing the history information indicating the past operation state as the ejecting portion-related information. In this regard, an example of the ejecting portion-related information stored in the print head 3 will be described with reference to FIG. 19.

FIG. 19 is a diagram illustrating an example of the ejecting portion-related information stored in the storage circuit 200 included in the print head 3. As illustrated in FIG. 19, information on a cumulative printing surface count TP, information on an elapsed day count LD, information on an error count EC, information on a transport error count CEC, information on a capping processing count CP, information on a cleaning processing count CL, and information on a wiping processing count WP are stored as the ejecting portion-related information in the storage circuit 200. Specifically, the history information indicating how many times the above-described various types of processing and operation have been executed and three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP are stored in the storage circuit 200.

The information on the cumulative printing surface count TP is information indicating the number of surfaces printed after the print head 3 is assembled to the liquid ejecting apparatus 1 and is stored in storage regions M1 to M4 of the storage circuit 200. Here, the number of printing surfaces is the number of surfaces of the medium P where an image is formed with ink ejected from the ejecting portion 600 of the print head 3, is counted as "2" in a case where, for example, an image has been formed by the liquid ejecting apparatus 1 ejecting ink with respect to both surfaces of the medium P, and is counted as "1" in a case where, for example, printing has been performed by the liquid ejecting apparatus 1 allocating two pages included in the image data signal IMG with respect to one surface of the medium P.

Of the information on the cumulative printing surface count TP stored in the storage circuit 200, cumulative printing surface count first threshold information TPth1 as a piece of the threshold information of the cumulative printing surface count TP is stored in the storage region M1. The cumulative printing surface count first threshold information TPth1 is set to, for example, "1". In other words, in a case where the print head 3 has ejected ink at least once with respect to the medium P, the cumulative printing surface count TP exceeds the cumulative printing surface count first threshold information TPth1. The cumulative printing surface count first threshold information TPth1 is also threshold information for determining whether or not the print head 3 has a use history.

Of the information on the cumulative printing surface count TP stored in the storage circuit 200, cumulative printing surface count second threshold information TPth2 as a piece of the threshold information of the cumulative printing surface count TP is stored in the storage region M2. In addition, of the information on the cumulative printing surface count TP stored in the storage circuit 200, cumulative printing surface count third threshold information TPth3 as a piece of the threshold information of the cumulative printing surface count TP is stored in the storage region M3. Here, the value of the cumulative printing surface count second threshold information TPth2 stored in the storage circuit 200 is larger than the value of the cumulative printing surface count first threshold information TPth1 and smaller than the value of the cumulative printing surface count third threshold information TPth3.

The cumulative printing surface count third threshold information TPth3 is threshold information for determining whether or not the print head 3 can be recycled or reused. In other words, a case where the cumulative printing surface count TP indicating the number of surfaces printed after the print head 3 is assembled to the liquid ejecting apparatus 1 exceeds the cumulative printing surface count third threshold information TPth3 means that the print head 3 is not suitable for recycle or reuse.

The cumulative printing surface count second threshold information TPth2 is threshold information for dividing the state of the print head 3 to be recycled or reused. The ejection state in the print head 3 greatly fluctuates in an initial state and becomes stable after a predetermined number of ejections. In this regard, by using the cumulative printing surface count second threshold information TPth2 as the threshold information for dividing whether or not the ejection state of the print head 3 is stable, it is possible to divide the operation of the print head 3, such as whether or not to perform the processing of correcting the fluctuating ejection characteristic, in a case where the liquid ejecting apparatus 1 drives the print head 3. As a result, it is possible to stabilize the ink ejection state in the liquid ejecting apparatus 1 including the print head 3 to be recycled or reused.

In addition, the cumulative printing surface count second threshold information TPth2 may be threshold information indicating whether or not the number of surfaces printed until the cumulative printing surface count TP reaches the threshold information defined by the cumulative printing surface count third threshold information TPth3 is equal to or greater than a predetermined printing surface count. As a result, it is possible to estimate the remaining service life of each portion of the print head 3 to be recycled or reused. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load as a result.

Of the information on the cumulative printing surface count TP stored in the storage circuit 200, cumulative printing surface count information TPc as the history information of the cumulative printing surface count TP is stored in the storage region M4. The cumulative printing surface count information TPc varies with the state of ink ejection from the ejecting portion 600 of the print head 3.

Specifically, the print head control circuit 71 outputs, to the storage circuit 200, the memory control signal MC for reading the cumulative printing surface count first threshold information TPth1, the cumulative printing surface count second threshold information TPth2, the cumulative printing surface count third threshold information TPth3, and the cumulative printing surface count information TPc corresponding to the information on the cumulative printing surface count TP written in the storage circuit 200. As a result, the cumulative printing surface count first threshold information TPth1, the cumulative printing surface count second threshold information TPth2, the cumulative printing surface count third threshold information TPth3, and the cumulative printing surface count information TPc stored in the storage circuit 200 are read by the print head control circuit 71.

In addition, the print head control circuit 71 counts the number of printing surfaces of the medium P where ink has been ejected from the ejecting portion 600 of the print head 3. Then, the print head control circuit 71 calculates the sum of the cumulative printing surface count information TPc read from the storage circuit 200 and the counted number of the printing surfaces and compares the result of the calculation with each of the cumulative printing surface count first threshold information TPth1, the cumulative printing surface count second threshold information TPth2, and the cumulative printing surface count third threshold information TPth3. Then, the print head control circuit 71 controls the print head 3 and the liquid ejecting apparatus 1 based on the result of the comparison between the sum of the cumulative printing surface count information TPc and the counted number of the printing surfaces and each of the cumulative printing surface count first threshold information TPth1, the cumulative printing surface count second threshold information TPth2, and the cumulative printing surface count third threshold information TPth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the cumulative printing surface count information TPc and the counted number of the printing surfaces in the storage region M4 of the storage circuit 200 at a predetermined timing. Here, the timing of the writing in the storage region M4 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the cumulative printing surface count TP of the medium P where ink has been ejected by the ejecting portion 600 since the assembly of the print head 3 to the liquid ejecting apparatus 1 and the cumulative printing surface count information TPc as information on the cumulative printing surface count TP stored in the storage region M4 of the storage circuit 200 changes in accordance with the state of ink ejection from the ejecting portion 600 of the print head 3.

Here, the state of ink ejection from the ejecting portion 600 of the print head 3 is an example of an operation state.

The information on the elapsed day count LD is information indicating the number of days that have elapsed since the assembly of the print head 3 to the liquid ejecting apparatus 1 and is stored in storage regions M5 to M8 of the storage circuit 200. Here, the information on the elapsed day count LD may be calculated based on the elapsed time information YMD measured by the time measurement circuit 83 with the print head 3 assembled in the liquid ejecting apparatus 1 or may be calculated based on date and time information stored in a storage portion (not illustrated) and date information input from an external device such as a host computer with the storage portion storing the date and time of the assembly of the print head 3 to the liquid ejecting apparatus 1.

Of the information on the elapsed day count LD stored in the storage circuit 200, elapsed day count first threshold information LDth1 as a piece of the threshold information of the elapsed day count LD is stored in the storage region M5. The elapsed day count first threshold information LDth1 is set to, for example, "1". In other words, in a case where one or more days have elapsed since the assembly of the print head 3 to the liquid ejecting apparatus 1, the elapsed day count LD exceeds the elapsed day count first threshold information LDth1. The elapsed day count first threshold information LDth1 is also threshold information for determining whether or not the print head 3 has a use history.

Of the information on the elapsed day count LD stored in the storage circuit 200, elapsed day count second threshold information LDth2 as a piece of the threshold information of the elapsed day count LD is stored in the storage region M6. In addition, of the information on the elapsed day count LD stored in the storage circuit 200, elapsed day count third threshold information LDth3 as a piece of the threshold information of the elapsed day count LD is stored in the storage region M7. Here, the value of the elapsed day count second threshold information LDth2 stored in the storage circuit 200 is larger than the value of the elapsed day count first threshold information LDth1 and smaller than the value of the elapsed day count third threshold information LDth3.

The elapsed day count third threshold information LDth3 is threshold information for determining whether or not the print head 3 can be recycled or reused. In other words, a case where the elapsed day count LD indicating the number of days from the assembly of the print head 3 to the liquid ejecting apparatus 1 exceeds the elapsed day count third threshold information LDth3 means that the print head 3 is not suitable for recycle or reuse.

The elapsed day count second threshold information LDth2 is threshold information for dividing the state of the print head 3 to be recycled or reused. For example, the elapsed day count second threshold information LDth2 may be threshold information indicating whether or not the number of days until the elapsed day count LD reaches the threshold information defined by the elapsed day count third threshold information LDth3 is equal to or greater than a predetermined number of days. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

Of the information on the elapsed day count LD stored in the storage circuit 200, elapsed day count information LDc as the history information of the elapsed day count LD is stored in the storage region M8. The elapsed day count information LDc varies with the state where the print head 3 is incorporated in the liquid ejecting apparatus 1.

Specifically, the print head control circuit 71 outputs, to the storage circuit 200, the memory control signal MC for reading the elapsed day count first threshold information LDth1, the elapsed day count second threshold information LDth2, the elapsed day count third threshold information LDth3, and the elapsed day count information LDc corresponding to the information on the elapsed day count LD written in the storage circuit 200. As a result, the elapsed day count first threshold information LDth1, the elapsed day count second threshold information LDth2, the elapsed day count third threshold information LDth3, and the elapsed day count information LDc stored in the storage circuit 200 are read by the print head control circuit 71.

In addition, the print head control circuit 71 counts the number of days that have elapsed since the assembly of the print head 3 to the liquid ejecting apparatus 1. Then, the print head control circuit 71 calculates the sum of the elapsed day count information LDc read from the storage circuit 200 and the counted number of the elapsed days and compares the result of the calculation with each of the elapsed day count first threshold information LDth1, the elapsed day count second threshold information LDth2, and the elapsed day count third threshold information LDth3. Then, the print head control circuit 71 controls the print head 3 and the liquid ejecting apparatus based on the result of the comparison between the calculation result on the sum of the elapsed day count information LDc and the counted number of the elapsed days and each of the elapsed day count first threshold information LDth1, the elapsed day count second threshold information LDth2, and the elapsed day count third threshold information LDth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the elapsed day count information LDc and the counted number of the elapsed days in the storage region M8 of the storage circuit 200 at a predetermined timing. Here, the timing of the writing in the storage region M8 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the elapsed day count LD indicating the number of days that have elapsed since the assembly of the print head 3 to the liquid ejecting apparatus 1 and the elapsed day count information LDc as information on the elapsed day count LD stored in the storage region M8 of the storage circuit 200 changes in accordance with the number of days that have elapsed since the assembly of the print head 3 to the liquid ejecting apparatus 1.

Here, the state where the print head 3 is assembled in the liquid ejecting apparatus 1 is another example of the operation state.

The information on the error count EC is information indicating the number of errors that have occurred in the print head 3 since the assembly of the print head 3 to the liquid ejecting apparatus 1 and is stored in storage regions M9 to M12 of the storage circuit 200. Here, the information on the error count EC is information indicating a state where an error has occurred in the print head 3 and specifically includes, for example, an ejecting portion abnormality in which no ink is ejected from the nozzle 651 in the ejecting portion 600, overvoltage and overcurrent abnormalities in the print head 3, and a transport abnormality in which the medium P is not transported normally. Further, the error count EC is calculated based on, for example, the ejecting portion state signal DI based on the residual vibration signal NVT output from the ejecting portion state determination circuit 73 described above, the medium transport error signal ERR1 output from the medium transport error detection circuit 58, and signals output from overvoltage and overcurrent detection circuits (not illustrated) and indicating the presence or absence of overvoltage and overcurrent abnormalities.

Of the information on the error count EC stored in the storage circuit 200, error count first threshold information ECth1 as a piece of the threshold information of the error count EC is stored in the storage region M9. The error count first threshold information ECth1 is set to, for example, "1". In other words, in a case where an error has occurred once or more since the assembly of the print head 3 to the liquid ejecting apparatus 1, the error count EC exceeds the error count first threshold information ECth1. The error count first threshold information ECth1 is also threshold information for determining whether or not the print head 3 has a use history.

Of the information on the error count EC stored in the storage circuit 200, error count second threshold information ECth2 as a piece of the threshold information of the error count EC is stored in the storage region M10. In addition, of the information on the error count EC stored in the storage circuit 200, error count third threshold information ECth3 as a piece of the threshold information of the error count EC is stored in the storage region M11. Here, the value of the error count second threshold information ECth2 stored in the storage circuit 200 is larger than the value of the error count first threshold information ECth1 and smaller than the value of the error count third threshold information ECth3.

The error count third threshold information ECth3 is threshold information for determining whether or not the print head 3 can be recycled or reused. In other words, a case where the error count EC indicating the number of errors that have occurred since the assembly of the print head 3 to the liquid ejecting apparatus 1 exceeds the error count third threshold information ECth3 means that the print head 3 is not suitable for recycle or reuse.

The error count second threshold information ECth2 is threshold information for dividing the state of the print head 3 to be recycled or reused. For example, the error count second threshold information ECth2 may be threshold information indicating whether or not the number of errors until the error count EC reaches the threshold information defined by the error count third threshold information ECth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

Of the information on the error count EC stored in the storage circuit 200, error count information ECc as the history information of the error count EC is stored in the storage region M12. The error count information ECc varies with the state where an error has occurred in the print head 3.

Specifically, the print head control circuit 71 outputs, to the storage circuit 200, the memory control signal MC for reading the error count first threshold information ECth1, the error count second threshold information ECth2, the error count third threshold information ECth3, and the error count information ECc corresponding to the information on the error count EC written in the storage circuit 200. As a result, the error count first threshold information ECth1, the error count second threshold information ECth2, the error count third threshold information ECth3, and the error count information ECc stored in the storage circuit 200 are read by the print head control circuit 71.

In addition, the print head control circuit 71 counts the number of errors that have occurred in the print head 3 since the assembly of the print head 3 to the liquid ejecting apparatus 1. Then, the print head control circuit calculates the sum of the error count information ECc read from the storage circuit 200 and the counted number of the errors that have occurred in the print head 3 and compares the result of the calculation with each of the error count first threshold information ECth1, the error count second threshold information ECth2, and the error count third threshold information ECth3. Then, the print head control circuit 71 controls the print head 3 and the liquid ejecting apparatus 1 based on the result of the comparison between the calculation result on the sum of the error count information ECc and the counted number of the errors that have occurred in the print head 3 and each of the error count first threshold information ECth1, the error count second threshold information ECth2, and the error count third threshold information ECth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the error count information ECc and the counted number of the errors that have occurred in the print head 3 in the storage region M12 of the storage circuit 200 at a predetermined timing. Here, the timing of the writing in the storage region M12 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the error count EC indicating the number of errors that have occurred in the print head 3 since the assembly of the print head 3 to the liquid ejecting apparatus 1 and the error count information ECc as information on the error count EC stored in the storage region M12 of the storage circuit 200 changes in accordance with the number of errors that have occurred in the print head 3 since the assembly of the print head 3 to the liquid ejecting apparatus 1.

Here, the state where an error has occurred in the print head 3 since the assembly of the print head 3 to the liquid ejecting apparatus 1 is another example of the operation state.

The information on the transport error count CEC is information indicating the number of errors that have occurred during the transport of the medium P after the assembly of the print head 3 to the liquid ejecting apparatus 1 and is stored in storage regions M13 to M16 of the storage circuit 200. Here, the information on the transport error count CEC is information indicating a state where a transport error has occurred in the medium P transported to the print head 3 and specifically includes, for example, a so-called jam that occurs after the assembly of the print head 3 to the liquid ejecting apparatus 1 and in which the medium P cannot be normally supplied or discharged in the medium transport mechanism 5. Further, the transport error count CEC is calculated based on the medium transport error signal ERR1 output from the medium transport error detection circuit 58 described above.

In the case of the so-called jam or the like in which the medium P cannot be normally supplied or discharged in the medium transport mechanism 5, the medium P comes into contact with the nozzle surface 652 of the print head 3 and the nozzle 651 may be damaged as a result. Accordingly, in the print head 3 to be recycled or reused, it is possible to enhance the precision of determination as to whether the print head 3 can be recycled or reused by individually storing the information on the transport error count CEC.

Of the information on the transport error count CEC stored in the storage circuit 200, transport error count first threshold information CECth1 as a piece of the threshold information of the transport error count CEC is stored in the storage region M13. The transport error count first threshold information CECth1 is set to, for example, "1". In other words, in a case where a transport error has occurred once or more since the assembly of the print head 3 to the liquid ejecting apparatus 1, the transport error count CEC exceeds the transport error count first threshold information CECth1. The transport error count first threshold information CECth1 is also threshold information for determining whether or not the print head 3 has a use history.

Of the information on the transport error count CEC stored in the storage circuit 200, transport error count second threshold information CECth2 as a piece of the threshold information of the transport error count CEC is stored in the storage region M14. In addition, of the information on the transport error count CEC stored in the storage circuit 200, transport error count third threshold information CECth3 as a piece of the threshold information of the transport error count CEC is stored in the storage region M15. Here, the value of the transport error count second threshold information CECth2 stored in the storage circuit 200 is larger than the value of the transport error count first threshold information CECth1 and smaller than the value of the transport error count third threshold information CECth3.

The transport error count third threshold information CECth3 is threshold information for determining whether or not the print head 3 can be recycled or reused. In other words, a case where the transport error count CEC indicating the number of transport errors that have occurred since the assembly of the print head 3 to the liquid ejecting apparatus 1 exceeds the transport error count third threshold information CECth3 means that the print head 3 is not suitable for recycle or reuse.

The transport error count second threshold information CECth2 is threshold information for dividing the state of the print head 3 to be recycled or reused. For example, the transport error count second threshold information CECth2 may be threshold information indicating whether or not the number of transport errors until the transport error count CEC reaches the threshold information defined by the transport error count third threshold information CECth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

Of the information on the transport error count CEC stored in the storage circuit 200, transport error count information CECc as the history information of the transport error count CEC is stored in the storage region M16. The transport error count information CECc varies with the state where a transport error of the medium P has occurred in the medium transport mechanism 5.

Specifically, the print head control circuit 71 outputs, to the storage circuit 200, the memory control signal MC for reading the transport error count first threshold information CECth1, the transport error count second threshold information CECth2, the transport error count third threshold information CECth3, and the transport error count information CECc corresponding to the information on the transport error count CEC written in the storage circuit 200. As a result, the transport error count first threshold information CECth1, the transport error count second threshold information CECth2, the transport error count third threshold information CECth3, and the transport error count information CECc stored in the storage circuit 200 are read by the print head control circuit 71.

In addition, the print head control circuit 71 counts the number of transport errors of the medium P that have occurred in the medium transport mechanism 5 since the assembly of the print head 3 to the liquid ejecting apparatus 1. Then, the print head control circuit 71 calculates the sum of the transport error count information CECc read from the storage circuit 200 and the counted number of the transport errors of the medium P that have occurred in the medium transport mechanism 5 and compares the result of the calculation with each of the transport error count first threshold information CECth1, the transport error count second threshold information CECth2, and the transport error count third threshold information CECth3. Then, the print head control circuit 71 controls the print head 3 and the liquid ejecting apparatus 1 based on the result of the comparison between the calculation result on the sum of the transport error count information CECc and the counted number of the transport errors of the medium P that have occurred in the medium transport mechanism 5 and each of the transport error count first threshold information CECth1, the transport error count second threshold information CECth2, and the transport error count third threshold information CECth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the transport error count information CECc and the counted number of the transport errors of the medium P that have occurred in the medium transport mechanism 5 in the storage region M16 of the storage circuit 200 at a predetermined timing. Here, the timing of the writing in the storage region M16 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the transport error count CEC indicating the number of transport errors of the medium P that have occurred in the medium transport mechanism 5 since the assembly of the print head 3 to the liquid ejecting apparatus 1 and the transport error count information CECc as information on the transport error count CEC stored in the storage region M16 of the storage circuit 200 changes in accordance with the number of transport errors of the medium P that have occurred in the medium transport mechanism 5 since the assembly of the print head 3 to the liquid ejecting apparatus 1.

Here, the state where a transport error of the medium P has occurred in the medium transport mechanism 5 since the assembly of the print head 3 to the liquid ejecting apparatus 1 is another example of the operation state.

The information on the capping processing count CP is information indicating how many times the capping processing of attaching a cap to the nozzle surface 652 where the nozzle 651 is formed in order to reduce a change in the characteristics of the ink stored in the print head 3 has been executed and is stored in storage regions M17 to M20 of the storage circuit 200. In other words, the information on the capping processing count CP is information indicating the state of execution of the capping processing where the cap is attached to the nozzle 651 and is calculated based on how many times the capping processing of attaching the cap to the nozzle surface 652 has been executed since the assembly of the print head 3 to the liquid ejecting apparatus 1.

In such capping processing, the cap comes into contact with the nozzle surface 652 of the print head 3, and thus the nozzle 651 may be damaged by the cap. Accordingly, in the print head 3 to be recycled or reused, it is possible to enhance the precision of determination as to whether the print head 3 can be recycled or reused by individually storing the information on the capping processing count CP.

Of the information on the capping processing count CP stored in the storage circuit 200, capping processing count first threshold information CPth1 as a piece of the threshold information of the capping processing count CP is stored in the storage region M17. The capping processing count first threshold information CPth1 is set to, for example, "1". In other words, in a case where the capping processing has been executed once or more since the assembly of the print head 3 to the liquid ejecting apparatus 1, the capping processing count CP exceeds the capping processing count first threshold information CPth1. The capping processing count first threshold information CPth1 is also threshold information for determining whether or not the print head 3 has a use history.

Of the information on the capping processing count CP stored in the storage circuit 200, capping processing count second threshold information CPth2 as a piece of the threshold information of the capping processing count CP is stored in the storage region M18. In addition, of the information on the capping processing count CP stored in the storage circuit 200, capping processing count third threshold information CPth3 as a piece of the threshold information of the capping processing count CP is stored in the storage region M19. Here, the value of the capping processing count second threshold information CPth2 stored in the storage circuit 200 is larger than the value of the capping processing count first threshold information CPth1 and smaller than the value of the capping processing count third threshold information CPth3.

The capping processing count third threshold information CPth3 is threshold information for determining whether or not the print head 3 can be recycled or reused. In other words, a case where the capping processing count CP indicating the number of times of the capping processing that has been executed since the assembly of the print head to the liquid ejecting apparatus 1 exceeds the capping processing count third threshold information CPth3 means that the print head 3 is not suitable for recycle or reuse.

The capping processing count second threshold information CPth2 is threshold information for dividing the state of the print head 3 to be recycled or reused. For example, the capping processing count second threshold information CPth2 may be threshold information indicating whether or not the number of times of the capping processing until the capping processing count CP reaches the threshold information defined by the capping processing count third threshold information CPth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

Of the information on the capping processing count CP stored in the storage circuit 200, capping processing count information CPc as the history information of the capping processing count CP is stored in the storage region M20. The capping processing count information CPc varies with the state of execution of the capping processing where the cap is attached to the nozzle 651.

Specifically, the print head control circuit 71 outputs, to the storage circuit 200, the memory control signal MC for reading the capping processing count first threshold information CPth1, the capping processing count second threshold information CPth2, the capping processing count third threshold information CPth3, and the capping processing count information CPc corresponding to the information on the capping processing count CP written in the storage circuit 200. As a result, the capping processing count first threshold information CPth1, the capping processing count second threshold information CPth2, the capping processing count third threshold information CPth3, and the capping processing count information CPc stored in the storage circuit 200 are read by the print head control circuit 71.

In addition, the print head control circuit 71 counts how many times the capping processing of attaching the cap to the nozzle 651 has been executed since the assembly of the print head 3 to the liquid ejecting apparatus 1. Then, the print head control circuit 71 calculates the sum of the capping processing count information CPc read from the storage circuit 200 and the counted number of times of the capping processing execution for attaching the cap to the nozzle 651 and compares the result of the calculation with each of the capping processing count first threshold information CPth1, the capping processing count second threshold information CPth2, and the capping processing count third threshold information CPth3. Then, the print head control circuit 71 controls the print head 3 and the liquid ejecting apparatus 1 based on the result of the comparison between the calculation result on the sum of the capping processing count information CPc and the counted number of times of the capping processing execution for attaching the cap to the nozzle 651 and each of the capping processing count first threshold information CPth1, the capping processing count second threshold information CPth2, and the capping processing count third threshold information CPth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the capping processing count information CPc and the counted number of times of the capping processing execution for attaching the cap to the nozzle 651 in the storage region M20 of the storage circuit 200 at a predetermined timing. Here, the timing of the writing in the storage region M20 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the capping processing count CP indicating how many times the capping processing of attaching the cap to the nozzle 651 has been executed since the assembly of the print head 3 to the liquid ejecting apparatus 1 and the capping processing count information CPc as information on the capping processing count CP stored in the storage region M20 of the storage circuit 200 changes in accordance with how many times the capping processing has been executed since the assembly of the print head 3 to the liquid ejecting apparatus 1.

Here, the state where the capping processing of attaching the cap to the nozzle 651 has been executed since the assembly of the print head 3 to the liquid ejecting apparatus 1 is another example of the operation state.

The information on the cleaning processing count CL is information indicating how many times cleaning processing for normally ejecting ink from the print head 3, examples of which include the wiping processing for removing a paper piece or the like attached to the nozzle surface 652 of the print head 3 and the flushing processing for maintaining the viscosity of the ink stored in the print head 3 in an appropriate range, has been executed and is stored in storage regions M21 to M24 of the storage circuit 200. In other words, the information on the cleaning processing count CL is information indicating a state where the cleaning processing is executed on the ejecting portion 600 and is calculated based on the numbers of times of the wiping processing and the flushing processing that have been executed on the print head 3 since the assembly of the print head 3 to the liquid ejecting apparatus 1.

Of the information on the cleaning processing count CL stored in the storage circuit 200, cleaning processing count first threshold information CLth1 as a piece of the threshold information of the cleaning processing count CL is stored in the storage region M21. The cleaning processing count first threshold information CLth1 is set to, for example, "1". In other words, in a case where the cleaning processing has been executed once or more since the assembly of the print head 3 to the liquid ejecting apparatus 1, the cleaning processing count CL exceeds the cleaning processing count first threshold information CLth1. The cleaning processing count first threshold information CLth1 is also threshold information for determining whether or not the print head 3 has a use history.

Of the information on the cleaning processing count CL stored in the storage circuit 200, cleaning processing count second threshold information CLth2 as a piece of the threshold information of the cleaning processing count CL is stored in the storage region M22. In addition, of the information on the cleaning processing count CL stored in the storage circuit 200, cleaning processing count third threshold information CLth3 as a piece of the threshold information of the cleaning processing count CL is stored in the storage region M23. Here, the value of the cleaning processing count second threshold information CLth2 stored in the storage circuit 200 is larger than the value of the cleaning processing count first threshold information CLth1 and smaller than the value of the cleaning processing count third threshold information CLth3.

The cleaning processing count third threshold information CLth3 is threshold information for determining whether or not the print head 3 can be recycled or reused. In other words, a case where the cleaning processing count CL after the assembly of the print head 3 to the liquid ejecting apparatus 1 exceeds the cleaning processing count third threshold information CLth3 means that the print head 3 is not suitable for recycle or reuse.

The cleaning processing count second threshold information CLth2 is threshold information for dividing the state of the print head 3 to be recycled or reused. For example, the cleaning processing count second threshold information CLth2 may be threshold information indicating whether or not the number of times of the cleaning processing until the cleaning processing count CL reaches the threshold information defined by the cleaning processing count third threshold information CLth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

Of the information on the cleaning processing count CL stored in the storage circuit 200, cleaning processing count information CLc as the history information of the cleaning processing count CL is stored in the storage region M24. The cleaning processing count information CLc varies with the state of execution of the cleaning processing for normally ejecting ink from the print head 3.

Specifically, the print head control circuit 71 outputs, to the storage circuit 200, the memory control signal MC for reading the cleaning processing count first threshold information CLth1, the cleaning processing count second threshold information CLth2, the cleaning processing count third threshold information CLth3, and the cleaning processing count information CLc corresponding to the information on the cleaning processing count CL written in the storage circuit 200. As a result, the cleaning processing count first threshold information CLth1, the cleaning processing count second threshold information CLth2, the cleaning processing count third threshold information CLth3, and the cleaning processing count information CLc stored in the storage circuit 200 are read by the print head control circuit 71.

In addition, the print head control circuit 71 counts how many times the cleaning processing has been executed since the assembly of the print head 3 to the liquid ejecting apparatus 1. Then, the print head control circuit 71 calculates the sum of the cleaning processing count information CLc read from the storage circuit 200 and the counted number of times of the cleaning processing execution and compares the result of the calculation with each of the cleaning processing count first threshold information CLth1, the cleaning processing count second threshold information CLth2, and the cleaning processing count third threshold information CLth3. Then, the print head control circuit 71 controls the print head 3 and the liquid ejecting apparatus 1 based on the result of the comparison between the calculation result on the sum of the cleaning processing count information CLc and the counted number of times of the cleaning processing execution and each of the cleaning processing count first threshold information CLth1, the cleaning processing count second threshold information CLth2, and the cleaning processing count third threshold information CLth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the cleaning processing count information CLc and the counted number of times of the cleaning processing execution in the storage region M24 of the storage circuit 200 at a predetermined timing. Here, the timing of the writing in the storage region M24 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the cleaning processing count CL indicating how many times the cleaning processing has been executed since the assembly of the print head 3 to the liquid ejecting apparatus 1 and the cleaning processing count information CLc as information on the cleaning processing count CL stored in the storage region M24 of the storage circuit 200 changes in accordance with how many times the cleaning processing has been executed since the assembly of the print head 3 to the liquid ejecting apparatus 1.

Here, the state where the cleaning processing has been executed since the assembly of the print head 3 to the liquid ejecting apparatus 1 is another example of the operation state.

The information on the wiping processing count WP is information indicating how many times the wiping processing for removing a paper piece or the like attached to the nozzle surface 652 of the print head 3 has been executed and is stored in storage regions M25 to M28 of the storage circuit 200. In other words, the information on the wiping processing count WP includes information indicating the state of execution of the wiping processing of wiping the nozzle surface 652 provided with the nozzle 651 where ink is ejected from the ejecting portion 600. Here, the information on the wiping processing count WP is calculated based on how many times the wiping processing has been executed since the assembly of the print head 3 to the liquid ejecting apparatus 1. During the wiping processing, the nozzle surface 652 of the print head 3 is directly wiped, and thus the nozzle 651 may be damaged. Accordingly, in the print head 3 to be recycled or reused, it is possible to enhance the precision of determination as to whether the print head 3 can be recycled or reused by individually storing the information on the wiping processing count WP.

Of the information on the wiping processing count WP stored in the storage circuit 200, wiping processing count first threshold information WPth1 as a piece of the threshold information of the wiping processing count WP is stored in the storage region M25. The wiping processing count first threshold information WPth1 is set to, for example, "1". In other words, in a case where the wiping processing has been executed once or more since the assembly of the print head 3 to the liquid ejecting apparatus 1, the wiping processing count WP exceeds the wiping processing count first threshold information WPth1. The wiping processing count first threshold information WPth1 is also threshold information for determining whether or not the print head 3 has a use history.

Of the information on the wiping processing count WP stored in the storage circuit 200, wiping processing count second threshold information WPth2 as a piece of the threshold information of the wiping processing count WP is stored in the storage region M26. In addition, of the information on the wiping processing count WP stored in the storage circuit 200, wiping processing count third threshold information WPth3 as a piece of the threshold information of the wiping processing count WP is stored in the storage region M27. Here, the value of the wiping processing count second threshold information WPth2 stored in the storage circuit 200 is larger than the value of the wiping processing count first threshold information WPth1 and smaller than the value of the wiping processing count third threshold information WPth3.

The wiping processing count third threshold information WPth3 is threshold information for determining whether or not the print head 3 can be recycled or reused. In other words, a case where the wiping processing count WP indicating the number of times of the wiping processing that has been executed since the assembly of the print head 3 to the liquid ejecting apparatus 1 exceeds the wiping processing count third threshold information WPth3 means that the print head 3 is not suitable for recycle or reuse.

The wiping processing count second threshold information WPth2 is threshold information for dividing the state of the print head 3 to be recycled or reused. For example, the wiping processing count second threshold information WPth2 may be threshold information indicating whether or not the number of times of the wiping processing until the wiping processing count WP reaches the threshold information defined by the wiping processing count third threshold information WPth3 is equal to or greater than a predetermined number. As a result, the remaining service life of the print head 3 to be recycled or reused can be grasped in detail. Accordingly, the print head 3 to be recycled or reused can be selected in accordance with the applications of the liquid ejecting apparatus 1 incorporating the print head 3 and it is possible to improve user convenience, reduce the amount of the print heads 3 to be discarded, and further reduce the environmental load.

Of the information on the wiping processing count WP stored in the storage circuit 200, wiping processing count information WPc as the history information of the wiping processing count WP is stored in the storage region M28. The wiping processing count information WPc varies with the state of execution of the wiping processing of wiping the nozzle surface 652 provided with the nozzle 651 where ink is ejected from the ejecting portion 600 of print head 3.

Specifically, the print head control circuit 71 outputs, to the storage circuit 200, the memory control signal MC for reading the wiping processing count first threshold information WPth1, the wiping processing count second threshold information WPth2, the wiping processing count third threshold information WPth3, and the wiping processing count information WPc corresponding to the information on the wiping processing count WP written in the storage circuit 200. As a result, the wiping processing count first threshold information WPth1, the wiping processing count second threshold information WPth2, the wiping processing count third threshold information WPth3, and the wiping processing count information WPc stored in the storage circuit 200 are read by the print head control circuit 71.

In addition, the print head control circuit 71 counts how many times the wiping processing has been executed since the assembly of the print head 3 to the liquid ejecting apparatus 1. Then, the print head control circuit 71 calculates the sum of the wiping processing count information WPc read from the storage circuit 200 and the counted number of times of the wiping processing execution and compares the result of the calculation with each of the wiping processing count first threshold information WPth1, the wiping processing count second threshold information WPth2, and the wiping processing count third threshold information WPth3. Then, the print head control circuit 71 controls the print head 3 and the liquid ejecting apparatus based on the result of the comparison between the calculation result on the sum of the wiping processing count information WPc and the counted number of times of the wiping processing execution and each of the wiping processing count first threshold information WPth1, the wiping processing count second threshold information WPth2, and the wiping processing count third threshold information WPth3.

Here, the control of the print head 3 and the liquid ejecting apparatus 1 that is performed by the print head control circuit 71 based on the result of the comparison may include, for example, control of the output mechanism 9 for notifying a user of the comparison result as well as control of the ejection speed of the ink, the transport speed of the medium P, or the like for image formation on the medium P.

In addition, the print head control circuit 71 outputs the memory control signal MC for writing the total value of the wiping processing count information WPc and the counted number of times of the wiping processing execution in the storage region M28 of the storage circuit 200 at a predetermined timing. Here, the timing of the writing in the storage region M28 of the storage circuit 200 may be any timing when the print head 3 is incorporated in the same liquid ejecting apparatus 1 and may be any of, for example, a timing when a request for removing the print head 3 incorporated in the liquid ejecting apparatus 1 has been made, a timing when the history information has exceeded the value defined by each threshold information, and a timing when a request for writing to the storage circuit 200 has been made as a result of user operation.

As described above, the history information stored in the storage circuit 200 includes the wiping processing count WP indicating how many times the wiping processing has been executed since the assembly of the print head 3 to the liquid ejecting apparatus 1 and the wiping processing count information WPc as information on the wiping processing count WP stored in the storage region M28 of the storage circuit 200 changes in accordance with how many times the wiping processing has been executed since the assembly of the print head 3 to the liquid ejecting apparatus 1.

Here, the state where the wiping processing has been executed since the assembly of the print head 3 to the liquid ejecting apparatus 1 is another example of the operation state.

Here, of the various types of information stored in the storage circuit 200, the three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP may be written in, for example, a step of manufacturing the print head 3. The determination threshold for determining the information on whether or not the print head 3 can be recycled or reused is determined in a step of manufacturing the print head 3. By storing such a determination threshold in the print head 3, it is possible to determine the state of the print head 3 by a uniform reference during refurbishing for recycling or reusing the print head 3. Accordingly, the quality of the liquid ejecting apparatus 1 is stable in the case of re-market distribution of the liquid ejecting apparatus 1 including the recycled or reused print head 3.

It should be noted that the three pieces of threshold information corresponding to each of the information on the cumulative printing surface count TP, the information on the elapsed day count LD, the information on the error count EC, the information on the transport error count CEC, the information on the capping processing count CP, the information on the cleaning processing count CL, and the information on the wiping processing count WP read from the storage circuit 200 may be stored in a storage portion (not illustrated) included in the print head control circuit 71. In this case, writing in the storage portion may be performed in a step of manufacturing the liquid ejecting apparatus 1. As a result, the storage capacity of the storage circuit 200 included in the print head 3 can be reduced.

Further, the respective storage capacities of the storage regions M1 to M28 as illustrated in FIG. 19 may be different storage capacities depending on the capacity of stored data and a controllable address region or the same storage capacity.

1.5 Action and Effect

As described above, the print head 3 according to the present embodiment has the storage circuit 200 in which the ejecting portion-related information is stored as the history information that varies with the operation state of the print head 3. Specifically, the ejecting portion-related information based on the operation state of the print head 3 is stored in the storage regions M4, M8, M12, M16, M20, M24, and M28 of the storage circuit 200. In other words, the storage circuit 200 of the print head 3 according to the present embodiment stores a plurality of pieces of ejecting portion-related information rewritten in accordance with the operation state of the print head 3. As a result, it is possible to precisely grasp the degree of deterioration of the print head 3 and the ejecting portion 600 included in the print head 3 and it is possible as a result to more appropriately recognize the state of the print head 3 to be recycled or reused.

2. Second Embodiment

Next, the liquid ejecting apparatus 1 and the print head 3 in a second embodiment will be described. It should be noted that configurations identical to those of the liquid ejecting apparatus 1 and the print head 3 in the first embodiment will be denoted by the same reference numerals and description thereof will be simplified or omitted in the following description of the liquid ejecting apparatus 1 and the print head 3 of the second embodiment.

Figure 20:
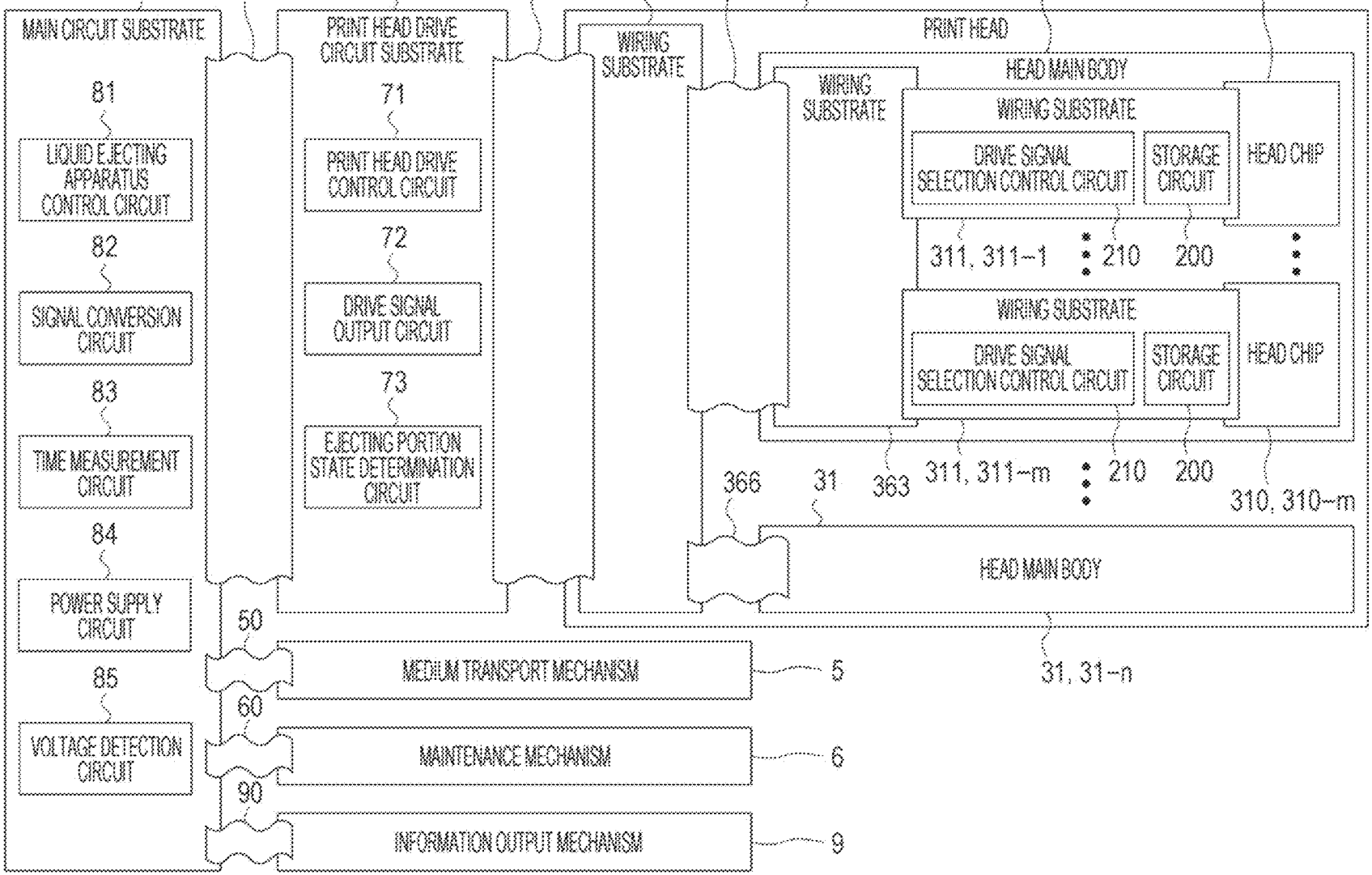
FIG. 20 is a diagram illustrating the functional configuration of the liquid ejecting apparatus according to a second embodiment.

FIG. 20 is a diagram illustrating the functional configuration of the liquid ejecting apparatus 1 of the second embodiment. As illustrated in FIG. 20, the liquid ejecting apparatus 1 in the second embodiment is different from the first embodiment in that the storage circuit 200 is mounted on the integrated circuit 312 provided on the wiring substrate 311. In other words, the print head 3 includes the head chip 310 including the ejecting portion 600, the wiring substrate 311 electrically coupled to the head chip 310, the wiring substrates 335 and 363 to which the wiring substrate 311 is electrically coupled, and the base member 33 to which the wiring substrates 335 and 363, the head chip 310, and the wiring substrate 311 are assembled. Further, the storage circuit 200 storing the ejecting portion-related information is disposed on the wiring substrate 311.

Here, the configuration that includes the wiring substrate 311 and the head chip 310 including the ejecting portion 600 is an example of an ejecting module in the second embodiment and the wiring substrate 363 to which the ejecting module is electrically coupled or the wiring substrate 335 to which the ejecting module is electrically coupled via the cable 366 is an example of a circuit substrate in the second embodiment. Further, the base member 33 to which the wiring substrates 335 and 363, the head chip 310, and the wiring substrate 311 are assembled is an example of a housing.

In the storage circuit 200, the print head 3 in which the head main body 31 including the plurality of head chips 310 is assembled in the base member 33 stores ejecting portion-related information including information on the cumulative printing surface count TP, information on the elapsed day count LD, information on the error count EC, information on the transport error count CEC, information on the capping processing count CP, information on the cleaning processing count CL, and information on the wiping processing count WP for each head chip 310 subsequent to assembly to the liquid ejecting apparatus 1.

In other words, the storage circuit 200 is capable of storing ejecting portion-related information with respect to each of the plurality of head chips 310. Accordingly, in a case where the print head 3 including the plurality of head chips 310 is recycled or reused, it is possible to grasp the recyclability or reusability and the state of each individual head chip 310 stored in the storage circuit 200. Accordingly, the liquid ejecting apparatus 1 incorporating the print head 3 to be recycled or reused is capable of selecting the print head 3 classified in more detail in accordance with applications and it is possible as a result to further improve user convenience, further reduce the amount of the print heads 3 to be discarded, and further reduce the environmental load.

Although embodiments and modification examples have been described above, the present disclosure is not limited to the embodiments and can be implemented in various aspects without departing from the scope of the present disclosure. For example, the above-described embodiments can be combined as appropriate.

The present disclosure includes a configuration that is substantially identical to the configuration described in the embodiments (such as a configuration identical in function, method, and result and a configuration identical in object and effect). In addition, the present disclosure includes a configuration in which a non-essential part of the configuration described in the embodiments has been replaced. In addition, the present disclosure includes a configuration that is identical in action and effect to the configuration described in the embodiments or a configuration that is capable of achieving the same object as the configuration described in the embodiments. In addition, the present disclosure includes a configuration in which a known technique has been added to the configuration described in the embodiments.

What is claimed is:

1. A print head assembled to a liquid ejecting apparatus ejecting a liquid with respect to a medium, the print head comprising:

an ejecting portion ejecting the liquid in response to a drive signal; and an electrically erasable non-volatile memory, wherein the non-volatile memory stores history information which changes in accordance with an operation state of the print head and which includes information on whether the print head can be recycled or reused; and wherein the operation state includes at least one of:

a state where capping processing of attaching a cap to a nozzle where the liquid is ejected from the ejecting portion is executed, and the history information includes how many times the capping processing is executed after the assembly of the print head to the liquid ejecting apparatus;

a state where wiping processing of wiping a nozzle surface provided with a nozzle where the liquid is ejected form the ejecting portion is executed, and the history information includes how many times the wiping processing is executed after the assembly of the print head to the liquid ejecting apparatus; and a state where cleaning processing is executed in the ejecting portion, and the history information includes how many times the cleaning processing is executed after the assembly of the print head to the liquid electing apparatus.

2. The print head according to claim 1, wherein the non-volatile memory is an EEPROM.

3. The print head according to claim 1, wherein the non-volatile memory is a flash memory.

4. The print head according to claim 1, further comprising:

a first ejecting module including a first ejecting portion as the ejecting portion;

a second ejecting module including a second ejecting portion as the ejecting portion; and a circuit substrate electrically coupled to the first ejecting module and the second ejecting module, wherein the non-volatile memory is disposed on the circuit substrate.

5. The print head according to claim 1, wherein the operation state includes a further state where the liquid is ejected from the ejecting portion, and the history information includes a cumulative printing surface count of the medium where the liquid is ejected by the ejecting portion after the assembly of the print head to the liquid ejecting apparatus.

6. The print head according to claim 1, wherein the operation state includes a further state where the print head is assembled in the liquid ejecting apparatus, and the history information includes an elapsed day count since the assembly of the print head to the liquid ejecting apparatus.

7. The print head according to claim 1, wherein the operation state includes a further state where an error occurs in the print head, and the history information includes how many times the error occurs in the print head after the assembly of the print head to the liquid ejecting apparatus.

8. The print head according to claim 1, wherein the operation state includes a further state where a transport error occurs in the medium transported to the print head, and the history information includes how many times the transport error occurs after the assembly of the print head to the liquid ejecting apparatus.

9. A print head assembled to a liquid ejecting apparatus ejecting a liquid with respect to a medium, the print head comprising:

an ejecting portion electing the liquid in response to a drive signal;

an electrically erasable non-volatile memory;

an ejecting module including the ejecting portion;

a circuit substrate electrically coupled to the ejecting module; and a housing to which the circuit substrate and the ejecting module are assembled, wherein the non-volatile memory is disposed in the ejecting module, and the operation state includes at least one of:

a state where capping processing of attaching a cap to a nozzle where the liquid is ejected from the ejecting portion is executed, and the history information includes how many times the capping processing is executed after the assembly of the ejecting module to the housing;

a state where wiping processing of wiping a nozzle surface provided with a nozzle where the liquid is ejected from the ejecting portion is executed, and the history information includes how many times the wiping processing is executed after the assembly of the electing module to the housing; and a state where cleaning processing is executed in the ejecting portion, and the history information includes how many times the cleaning processing is executed after the assembly of the ejecting module to the housing.

10. The print head according to claim 9, wherein the operation state includes a further state where the liquid is ejected from the ejecting portion, and the history information includes a cumulative printing surface count of the medium where the liquid is ejected by the ejecting portion after the assembly of the ejecting module to the housing.

11. The print head according to claim 9, wherein the operation state includes a further state where the ejecting module is assembled in the housing, and the history information includes an elapsed day count since the assembly of the ejecting module to the housing.

12. The print head according to claim 9, wherein the operation state includes a further state where an error occurs in the ejecting module, and the history information includes how many times the error occurs in the ejecting module after the assembly of the ejecting module to the housing.

13. The print head according to claim 9, wherein the operation state includes a further state where a transport error occurs in the medium transported to the print head, and the history information includes how many times the transport error occurs after the assembly of the ejecting module to the housing.

14. A liquid ejecting apparatus comprising:

a drive signal output circuit outputting a drive signal; and a print head assembled to the liquid ejecting apparatus ejecting a liquid with respect to a medium, wherein the print head includes an ejecting portion ejecting the liquid in response to the drive signal and an electrically erasable non-volatile memory, the non-volatile memory stores history information which changes in accordance with an operation state of the print head and which includes information on whether the print head can be recycled or reused, and the operation state includes at least one of:

a state where capping processing of attaching a cap to a nozzle where the liquid is ejected from the ejecting portion is executed, and the history information includes how many times the capping processing is executed after the assembly of the print head to the liquid ejecting apparatus;

a state where wiping processing of wiping a nozzle surface provided with a nozzle where the liquid is ejected from the ejecting portion is executed, and the history information includes how many times the wiping processing is executed after the assembly of the print head to the liquid ejecting apparatus; and a state where cleaning processing is executed in the ejecting portion, and the history information includes how many times the cleaning processing is executed after the assembly of the print head to the liquid ejecting apparatus.

15. The liquid ejecting apparatus according to claim 14, wherein the non-volatile memory is an EEPROM.

16. The liquid ejecting apparatus according to claim 14, wherein the non-volatile memory is a flash memory.

17. The liquid ejecting apparatus according to claim 14, wherein the print head includes:

a first ejecting module including a first ejecting portion as the ejecting portion;

a second ejecting module including a second ejecting portion as the ejecting portion; and a circuit substrate electrically coupled to the first ejecting module and the second ejecting module, and the non-volatile memory is disposed on the circuit substrate.

18. The liquid ejecting apparatus according to claim 14, wherein the operation state includes a further state where the liquid is ejected from the ejecting portion, and the history information includes a cumulative printing surface count of the medium where the liquid is ejected by the ejecting portion after the assembly of the print head to the liquid ejecting apparatus.

19. The liquid ejecting apparatus according to claim 14, wherein the operation state includes a further state where the print head is assembled in the liquid ejecting apparatus, and the history information includes an elapsed day count since the assembly of the print head to the liquid ejecting apparatus.

20. The liquid ejecting apparatus according to claim 14, wherein the operation state includes a further state where an error occurs in the print head, and the history information includes how many times the error occurs in the print head after the assembly of the print head to the liquid ejecting apparatus.

21. The liquid ejecting apparatus according to claim 14, wherein the operation state includes a further state where a transport error occurs in the medium transported to the print head, and the history information includes how many times the transport error occurs after the assembly of the print head to the liquid ejecting apparatus.

22. A liquid ejecting apparatus comprising:

a drive signal output circuit outputting a drive signal; and a print head assembled to the liquid ejecting apparatus ejecting a liquid with respect to a medium, wherein the print head includes:

an electing portion ejecting the liquid in response to the drive signal and an electrically erasable non-volatile memory:

an ejecting module including the ejecting portion;

a circuit substrate electrically coupled to the ejecting module; and a housing to which the circuit substrate and the ejecting module are assembled, the non-volatile memory is disposed in the ejecting module, the non-volatile memory stores history information which changes in accordance with an operation state of the print head and which includes information on whether the print head can be recycled or reused, and the operation state includes at least one of:

a state where capping processing of attaching a cap to a nozzle where the liquid is ejected from the ejecting portion is executed, and the history information includes how many times the capping processing is executed after the assembly of the ejecting module to the housing:

a state where wiping processing of wiping a nozzle surface provided with a nozzle where the liquid is ejected from the ejecting portion is executed, and the history information includes how many times the wiping processing is executed after the assembly of the ejecting module to the housing; and a state where cleaning processing is executed in the ejecting portion, and the history information includes how many times the cleaning processing is executed after the assembly of the ejecting module to the housing.

23. The liquid ejecting apparatus according to claim 22, wherein the operation state includes a further state where the liquid is ejected from the ejecting portion, and the history information includes a cumulative printing surface count of the medium where the liquid is ejected by the ejecting portion after the assembly of the ejecting module to the housing.

24. The liquid ejecting apparatus according to claim 22, wherein the operation state includes a further state where the ejecting module is assembled in the housing, and the history information includes an elapsed day count since the assembly of the ejecting module to the housing.

25. The liquid ejecting apparatus according to claim 22, wherein the operation state includes a further state where an error occurs in the ejecting module, and the history information includes how many times the error occurs in the ejecting module after the assembly of the ejecting module to the housing.

26. The liquid ejecting apparatus according to claim 22, wherein the operation state includes a further state where a transport error occurs in the medium transported to the print head, and the history information includes how many times the transport error occurs after the assembly of the ejecting module to the housing.

* * * * *